US010315435B2

(12) United States Patent
Sato et al.

(10) Patent No.: US 10,315,435 B2
(45) Date of Patent: Jun. 11, 2019

(54) PRINTING APPARATUS, METHOD OF CONTROLLING PRINTING APPARATUS, AND CONTROL PROGRAM OF PRINTING APPARATUS

(71) Applicant: SEIKO EPSON CORPORATION, Tokyo (JP)

(72) Inventors: Akito Sato, Nagano (JP); Yuko Yamamoto, Nagano (JP); Yuichi Yoneyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/405,413

(22) Filed: Jan. 13, 2017

(65) Prior Publication Data

US 2017/0129253 A1 May 11, 2017

Related U.S. Application Data

(63) Continuation of application No. 14/749,969, filed on Jun. 25, 2015, now Pat. No. 9,579,887.

(30) Foreign Application Priority Data

Jun. 26, 2014 (JP) ..... 2014-131189

(51) Int. Cl.

| | |
|---|---|
| ***B41J 2/21*** | (2006.01) |
| ***B41J 2/045*** | (2006.01) |
| *B41J 2/14* | (2006.01) |

(52) U.S. Cl.

CPC ..... *B41J 2/2132* (2013.01); *B41J 2/0451* (2013.01); *B41J 2/04541* (2013.01);
(Continued)

(58) Field of Classification Search

CPC .... B41J 2/2132; B41J 2/04596; B41J 2/0451; B41J 2/04581; B41J 2/04541;
(Continued)

(56) References Cited

U.S. PATENT DOCUMENTS

2005/0275684 A1 12/2005 Yamaguchi et al.
2006/0139394 A1* 6/2006 Wada ..... B41J 2/2139 347/19

(Continued)

FOREIGN PATENT DOCUMENTS

JP 09-024609 A 1/1997
JP 2000-015845 A 1/2000

(Continued)

*Primary Examiner* — Justin Seo

(57) ABSTRACT

A printing apparatus including: a first nozzle group including a first and third nozzles which ejects a first liquid; and a second nozzle group including a second nozzle which ejects a second liquid, in which, when an ejection state of the liquid ejected from the one nozzle which belongs to the first nozzle group is abnormal, complementation is performed using complementation modes of a first complementation mode that increases the amount of a liquid to be ejected from the first nozzle instead of allowing the one nozzle to eject the liquid, a second complementation mode that increases the amount of the liquid to be ejected from the second nozzle instead of allowing the one nozzle to eject the liquid, and a third complementation mode that increases the amount of the liquid to be ejected from the third nozzle instead of allowing the liquid to be ejected from the one nozzle.

20 Claims, 31 Drawing Sheets

(52) U.S. Cl.
CPC ..... *B41J 2/04551* (2013.01); *B41J 2/04581* (2013.01); *B41J 2/04586* (2013.01); *B41J 2/04588* (2013.01); *B41J 2/04595* (2013.01); *B41J 2/04596* (2013.01); *B41J 2/2139* (2013.01); *B41J 2002/14354* (2013.01)

(58) Field of Classification Search
CPC .. B41J 2/04595; B41J 2/04588; B41J 2/2139; B41J 2/04551; B41J 2/04586; B41J 2002/14354
See application file for complete search history.

(56) References Cited

U.S. PATENT DOCUMENTS

| | | | | |
|---|---|---|---|---|
| 2006/0284916 | A1 | 12/2006 | Heiles et al. | |
| 2008/0252673 | A1* | 10/2008 | Wada | B41J 2/04505 347/12 |
| 2012/0114188 | A1 | 5/2012 | Murase et al. | |

FOREIGN PATENT DOCUMENTS

| | | | |
|---|---|---|---|
| JP | 2003-063043 | A | 3/2003 |
| JP | 2004-174816 | A | 6/2004 |
| JP | 2007-001306 | A | 1/2007 |
| JP | 2007-181090 | A | 7/2007 |
| JP | 2011-255594 | A | 12/2011 |

* cited by examiner

TEST VALUE AND CALCULATED VALUE OF RESIDUAL VIBRATION (DRYING)

FIG. 17

| SI (b1, b2, b3) | Ts1 | | | Ts2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0, 0, 1) | L | L | H | L | L | H |

FIG. 23

| Flag | Tc (CONTENTS TO BE COMPARED) | Rs |
|---|---|---|
| 1 | Tc<Tth1 | 2: EJECTION ABNORMALITY (BUBBLE) |
| | Tth1≤Tc≤Tth2 | 1: NORMAL |
| | Tth2<Tc≤Tth3 | 3: EJECTION ABNORMALITY (PAPER DUST) |
| | Tth3<Tc | 4: EJECTION ABNORMALITY (THICKENING) |
| 0 | N/A | 5: EJECTION ABNORMALITY |

PRINTING APPARATUS, METHOD OF CONTROLLING PRINTING APPARATUS, AND CONTROL PROGRAM OF PRINTING APPARATUS

This application is a continuation application of U.S. patent application Ser. No. 14/749,969, filed on Jun. 25, 2015. This application claims priority to Japanese Patent Application No. 2014-131189 filed on Jun. 26, 2014. The entire disclosures of U.S. patent application Ser. No. 14/749,969 and Japanese Patent Application No. 2014-131189 are hereby incorporated herein by reference.

BACKGROUND

1. Technical Field

The present invention relates to a printing apparatus, a method of controlling a printing apparatus, and a control program of a printing apparatus.

2. Related Art

In a printing apparatus that forms an image on a medium by ejecting an ink from a nozzle, there is a case in which the ink is not normally ejected from the nozzle due to thickening of the ink. When ejection abnormality which is a state in which an ink is not normally ejected from a nozzle, that is, the ejection state of the ink from the nozzle becomes abnormal occurs, dots which are expected to be formed by the ink ejected from the nozzle are not formed and the quality of an image formed on a medium is degraded. In order to prevent degradation of the image quality caused by unformed dots, various techniques related to complement in which, in a case where ejection abnormality occurs in one nozzle, dots are formed by ejecting an ink from another nozzle instead of allowing the one nozzle to eject an ink have been suggested.

For example, a technique of complementing the nozzle with another nozzle by increasing the amount of ink to be ejected from another nozzle adjacent to the one nozzle in the case where ejection abnormality occurs in one nozzle is suggested in JP-A-9-024609.

Further, a technique of complementing the one nozzle with another nozzle by increasing the amount of ink to be ejected from another nozzle ejecting another color of ink in a case where ejection abnormality occurs in one nozzle ejecting one color of ink is suggested in JP-A-2004-174816.

As disclosed in JP-A-9-024609, in the case where one nozzle is complemented with another nozzle adjacent to the one nozzle, dots formed by another nozzle are formed in a position different from that of dots formed by the one nozzle. That is, the complementing method disclosed in JP-A-9-024609 is not suitable for a printing process for which accuracy in a position or a shape of an image to be formed on a medium is required such as in a case of printing a bar code or a blueprint. That is, in the case where an image for which accuracy in the position or the shape thereof is required is printed, the image quality of the image to be printed is further degraded when the complementation is performed compared to a case where the complementation is not performed.

Further, as the technique disclosed in JP-A-2004-174816, in the case where one nozzle is complemented with another nozzle ejecting an ink having a color different from that of the ink ejected from the one nozzle, the color of dots formed by another nozzle becomes different from the color of dots formed by the one nozzle. That is, the complementing method disclosed in JP-A-2004-174816 is not suitable for a printing process for which accuracy in a color of an image to be formed on a medium is required such as a case of printing a photo. That is, in the case where an image for which accuracy of the color thereof is required is printed, the image quality of the image to be printed is further degraded when the complementation is performed compared to a case where the complementation is not performed.

As described above, in the case where nozzles are complemented in a printing apparatus according to a single complementing method, the image quality of an image to be formed on a medium may be further degraded when compared to an image to be formed when ejection abnormality has not occurred (in the case where nozzles are not complemented).

Further, in the case where a nozzle is complemented in a printing apparatus according to a single complementing method, when ejection abnormality occurs in another nozzle for complementing one nozzle in which ejection abnormality occurs, the complementation cannot be performed. In the case where complementation cannot be carried out although that ejection abnormality occurs, the image quality of an image is further degraded compared to an image to be formed in the case where ejection abnormality has not occurred.

SUMMARY

An advantage of some aspects of the invention is to provide a technique of forming an image having the image quality, on a medium, to the extent of not being inferior to an image to be formed when ejection abnormality has not occurred in a case of complementing a nozzle in which ejection abnormality has occurred at the time when a printing process is performed.

According to an aspect of the invention, there is provided a printing apparatus that performs a printing process of ejecting a liquid from a nozzle to a medium and forming an image on the medium, the printing apparatus including: a head unit that includes a first nozzle group including a first nozzle which ejects a liquid having a first color, a second nozzle group including a second nozzle which ejects a liquid having a second color, and a third nozzle group including a third nozzle which ejects a liquid having the first color; and a print control unit that controls execution of the printing process, in which, in a case where execution of the printing process is controlled, when an ejection state of the liquid ejected from one nozzle which belongs to the first nozzle group, ejects the liquid having the first color, and is different from the first nozzle is abnormal, the print control unit is capable of performing complementation using at least two or more complementation modes from among a first complementation mode that performs complementation with respect to the one nozzle by increasing the amount of a liquid to be ejected from the first nozzle instead of allowing the one nozzle to eject the liquid, a second complementation mode that performs complementation with respect to the one nozzle by increasing the amount of the liquid to be ejected from the second nozzle instead of allowing the one nozzle to eject the liquid, and a third complementation mode that performs complementation with respect to the one nozzle by increasing the amount of the liquid to be ejected from the third nozzle instead of allowing the one nozzle to eject the liquid from the one nozzle.

BRIEF DESCRIPTION OF THE DRAWINGS

The invention will be described with reference to the accompanying drawings, wherein like numbers reference like elements.

FIG. 17 is an explanatory diagram illustrating decoded contents of a decoder.

FIG. 23 is an explanatory diagram for describing a determination result signal generated in an ejection state determining unit.

DESCRIPTION OF EXEMPLARY EMBODIMENTS

Hereinafter, embodiments for implementing the present invention will be described with reference to the drawings. However, throughout the drawings, dimensions and scales of the respective parts are appropriately different from those of actual parts. Moreover, since embodiments described herein are preferred concrete examples of the present invention, the embodiments are provided with various limitations that are technologically preferred, but the scope of the present invention is not limited to the embodiments unless there is a particularly disclosure which limits the present invention in the following description.

A. First Embodiment

In the present embodiment, a printing apparatus will be described by exemplifying an ink jet printer which is included in a printing system and ejects an ink (an example of a "liquid") to form an image on recording paper P (an example of a "medium").

1. Outline of Printing System

Figure 1:
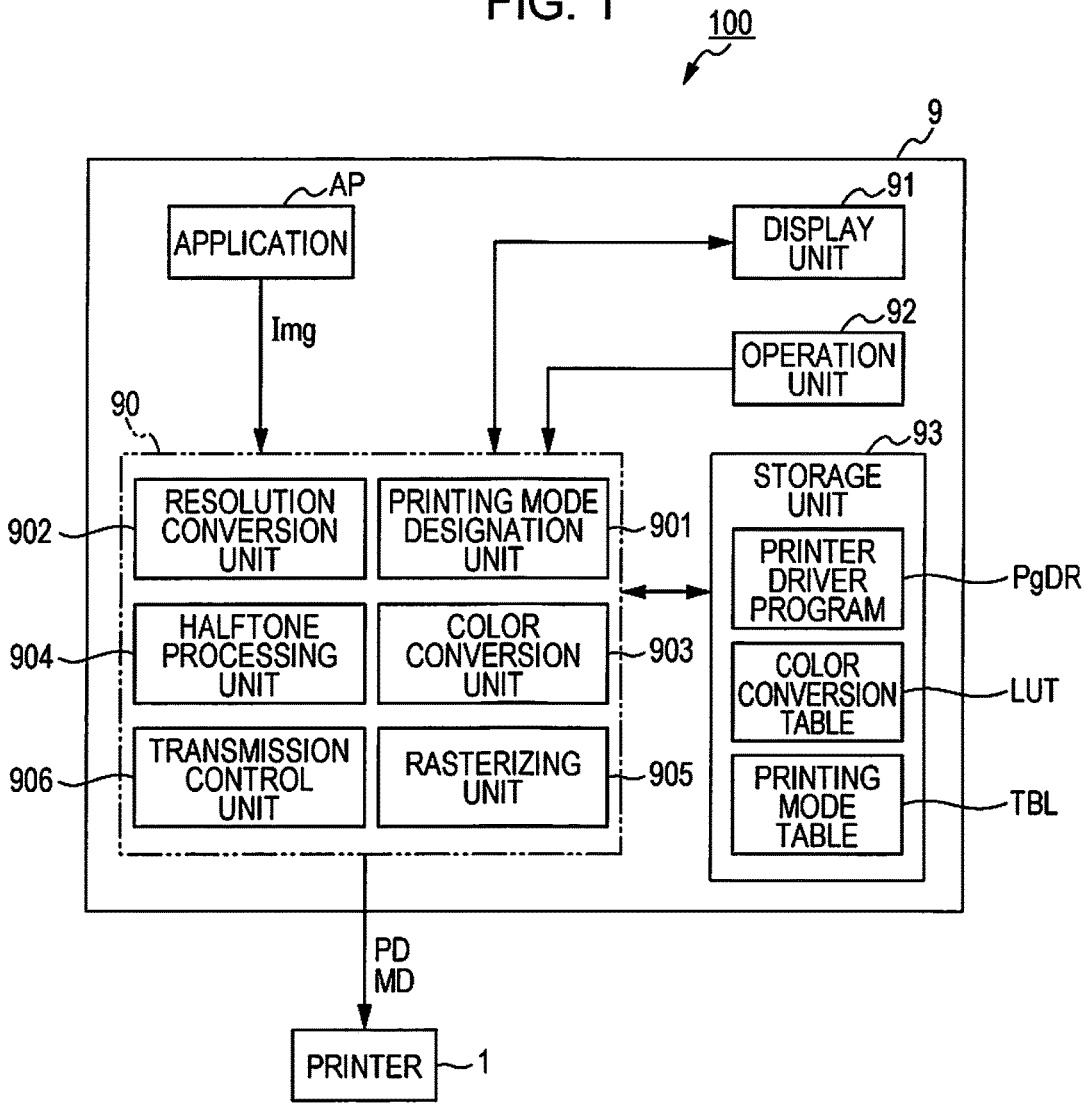
FIG. 1 is a block diagram illustrating the outline of a configuration of a printing system according to a first embodiment of the invention.

FIG. 1 is a block diagram illustrating a configuration of a printing system 100.

As illustrated in FIG. 1, the printing system 100 according to the present embodiment includes an ink jet printer 1 that performs a printing process of forming an image by ejecting an ink onto the recording paper P and a host computer 9 that generates print data PD showing an image to be formed (printed) by the ink jet printer 1.

The ink jet printer 1 according to the present embodiment can perform the printing process using a plurality of printing modes. More specifically, the ink jet printer 1 can perform the printing process using a printing mode according to an image to be printed in a printing process in a case of performing the printing process. Further, in the present embodiment, the description will be made with the assumption that the ink jet printer 1 is a line printer.

The host computer 9 is a personal computer or a digital camera and generates printing mode data MD that designates the printing mode of the ink jet printer 1 and print data PD corresponding to the printing mode designated by the printing mode data MD and then supplies the generated data to the ink jet printer 1.

Hereinafter, the printing mode of the ink jet printer 1 will be described.

1.1. Regarding Printing Mode

As described above, the ink jet printer 1 can perform the printing process using a plurality of printing modes.

More specifically, the ink jet printer 1 has four printing modes such as a bar code printing mode for printing a bar code on the recording paper P; a photo printing mode for printing a photo on the printing paper P; a figure printing mode for printing a figure on the recording paper P; and a normal printing mode for forming an optional image without designating an image to be formed on the recording paper P. Further, the ink jet printer 1 selects the printing mode according to the kind of image to be formed during the printing process and performs the printing process using the selected printing mode.

Moreover, in the present embodiment, a figure is an image that can be shown by basic geometric figures (primitive figures), for example, lines such as a line segment, a straight line, a polyline, and a curve; polygons such as a rectangle and a triangle; closed surfaces such as a circle and an ellipse; and dots, or an image which can be shown by a combination of these basic geometric figures. That is, the figure according to the present embodiment is an image for showing the shape or the position of an object, for example, an image which can be expressed by a vector format.

More specifically, the figures in the present embodiment include images shown by a combination of geometric figures such as a blueprint, a graph, a business form, and the like.

The figure printing mode is a printing mode for printing a figure which is an image for showing the shape or the position of an object.

For example, when the figure includes a straight line, there is a case in which dots are formed in a position different from the position of the straight line when an impact position of an ink ejected from the ink jet printer 1 is shifted to form a part of a straight line. In this case, there is a possibility that formation of dots in a position different from the position of the straight line can be recognized by a user of the printing system 100. In addition, in this case, there is a possibility that the shape or the position of an object cannot be accurately shown by a printed image.

For this reason, in the figure printing mode, the printing process is performed by prioritizing the accuracy of the position or the shape of an image to be formed on the recording paper P more than the reproducibility of the color of an image to be formed on the recording paper P.

Moreover, images to be printed during the printing process using the figure printing mode are not particularly limited to images formed of figures and may include images formed of a bar code, a photo, and characters.

In the presents embodiment, bar codes include a one-dimensional bar code which is an image formed by arranging a plurality of segment lines extending in a predetermined direction and a two-dimensional bar code such as a QR code (registered trademark) which is an image having two-dimensional patterns formed of a plurality of squares. These bar codes show information related to numeric values or characters using the shape (for example, the thickness of each line segment included in a one-dimensional bar code or the shape of a pattern included in a two-dimensional bar code) of a plurality of basic geometric figures constituting an image (bar code) or a relative positional relationship (for example, the intervals between line segments included in a one-dimensional bar code) among a plurality of basic geometric figures constituting an image (bar code).

Moreover, conceptually, a bar code is formed of a combination of basic geometric figures and thus included in a figure described above. However, in the present embodiment, for convenience of the description, an image for showing information of numeric values or characters among images formed of a combination of basic geometric figures is defined as a bar code and this bar code and the figure described above are distinguished from each other by defining an image which is not a bar code as a figure.

The bar code printing mode is a printing mode for printing a bar code which is an image for showing information of numeric values or the like using the shape of a plurality of basic geometric figures or the relative positional relationship.

In a case where a bar code is printed, information of numeric values or characters shown by the printed bar code becomes information different from the information which is expected to be shown by an original bar code in some cases where the impact position of an ink ejected from the ink jet printer 1 is shifted in order to form a part of the bar code. For this reason, in the bar code printing mode, the printing process is performed by prioritizing the accuracy of the position or the shape of an image to be formed on the recording paper P more than the reproducibility of the color of an image to be formed on the recording paper P similar to the figure printing mode.

Further, the image to be printed during the printing process using the bar code printing process is not particularly limited to an image formed of only a bar code and may be an image other than a bar code, for example, an image having a figure, a photo, or characters (for example, see FIG. 6 described below).

In the present embodiment, a photo is an image suitable for expression using a raster format in which a color or the concentration of a color is regulated for each pixel, for example, an image which is difficult to express as a combination of basic geometric figures like an image expressing a photo or a picture.

In general, an image showing a photo does not have basic geometric figures such as a straight line or a polygon. Accordingly, in a case of printing a photo, even when the impact position of an ink ejected from the ink jet printer 1 is shifted in order to form a part of the photo, the shift of the impact position of the ink is not noticeable compared to a figure formed of a straight line and the like. Meanwhile, since colors are important in a photo in many cases, when a dot having a different color from a dot to be formed to show an original photo is formed in the case of printing a photo, the difference between colors of the dots is highly likely to be recognized by the user of the printing system 100.

Therefore, in the photo printing mode, the printing process is performed by prioritizing the reproducibility of colors (accuracy of colors) of an image to be formed on the recording paper P more than the accuracy of the position or the shape of an image to be formed on the recording paper P.

In addition, the image to be printed during the printing process using the photo printing mode is not particularly limited to an image formed of a photo and may be an image other than a photo, for example, an image formed of a figure, a bar code, or characters.

In addition, the above-described bar code printing mode and figure printing mode are examples of a "first printing mode" that performs the printing process prioritizing the accuracy of the position or the shape of an image to be formed on the recording paper P more than the reproducibility of the color of an image to be formed on the recording paper P.

Further, the photo printing mode is an example of a "second printing mode" that performs the printing process prioritizing the reproducibility of the color of an image to be formed on the recording paper P more than the accuracy of the position or the shape of an image to be formed on the recording paper P.

The printing mode of the above-described ink jet printer 1 is designated in the host computer 9. Hereinafter, the host computer 9 will be described.

1.2 Configuration of Host Computer

As illustrated in FIG. 1, the host computer 9 includes a display unit 91 such as a display; an operation unit 92 such as a keyboard or a mouse; a storage unit 93 such as a random access memory (RAM) or a hard disk drive; and a central processing unit (CPU) controlling operations of respective units of the host computer 9. Further, the CPU is not illustrated in FIG. 1.

Moreover, the host computer 9 includes a print data generating unit 90 that performs a print data generating process of converting image data Img output from an application AP which is operated in the host computer 9 into print data PD serving as data which can be used for the printing process performed by the ink jet printer 1.

As illustrated in FIG. 1, a printer driver program PgDR of the ink jet printer 1; various application programs (not illustrated) such as word processing software and image editing software; a color conversion table LUT; and a printing mode table TBL are stored in the storage unit 93.

In the color conversion table LUT, information for expressing colors, which are shown in a color space regulated by three colors (RGB) of red, green, and blue, in a color space regulated by one or a plurality of ink colors used in the printing process performed by the ink jet printer 1, for example, four colors (CMYK) of cyan (CY), magenta (MG), yellow (YL), and black (BK) is stored.

In the printing mode table TBL, various pieces of information necessary for generating the print data PD corresponding to the printing mode in the case where the ink jet printer 1 performs the printing process using various printing modes is stored.

When the CPU of the host computer 9 performs the application program stored in the storage unit 93, the application AP having various functions of creating documents or editing images is activated. The application AP outputs the image data Img showing an image in a case where a request for printing the image, which is to be processed by the application AP, by the ink jet printer 1 is received by the user of the printing system 100.

The print data generating unit 90 is a functional block in which the CPU of the host computer 9 performs the printer driver program PgDR and which is realized by the CPU of the host computer 9 being operated according to the printer driver program PgDR. The print data generating unit 90 converts the image data Img output from the application AP into the print data PD.

As described above, the image data Img is data expressed by RGB. For this reason, in order to print an image shown by the image data Img using the ink jet printer 1, the image needs to be shown in a color space of ink colors used by the ink jet printer 1. Further, in order to print an image shown by the image data Img using the ink jet printer 1, the image needs to be shown in a resolution which can be handled by the ink jet printer 1.

The print data generating unit 90 converts the image shown by the image data Img into an image shown in the resolution and the color space corresponding to the printing process of the ink jet printer 1. More specifically, the print data generating unit 90 generates print data PD showing the size of dots to be formed on the recording paper P or the dot arrangement in order to form an image shown by the image data Img by performing the printing process using the printing mode designated by the ink jet printer 1. In this manner, the ink jet printer 1 can print the image shown by the image data Img in the printing process using the designated printing mode based on the print data PD generated by the print data generating unit 90.

As illustrated in FIG. 1, the print data generating unit 90 includes a printing mode designation unit 901 that generates printing mode data MD designating the printing mode of the printing process performed by the ink jet printer 1; a resolution conversion unit 902 that converts the resolution of an image shown by the image data Img into the resolution corresponding to the printing mode designated by the printing mode data MD; a color conversion unit 903 that converts data of colors of an image shown by the image data Img into data shown in a color space regulated by ink colors used by the ink jet printer 1; a halftone processing unit 904 that performs halftone processing determining the arrangement or the size of dots to be formed on the recording paper P when an image shown by the image data Img is printed by the ink jet printer 1; a rasterizing unit 905 that performs a rasterizing process of arranging image data which is halftone-processed in order of data to be transferred to the ink jet printer 1 and generates print data PD based on the rasterized image data; and a transmission control unit 906 that controls transmission of the print data PD and the printing mode data MD to the ink jet printer 1.

Figure 2:
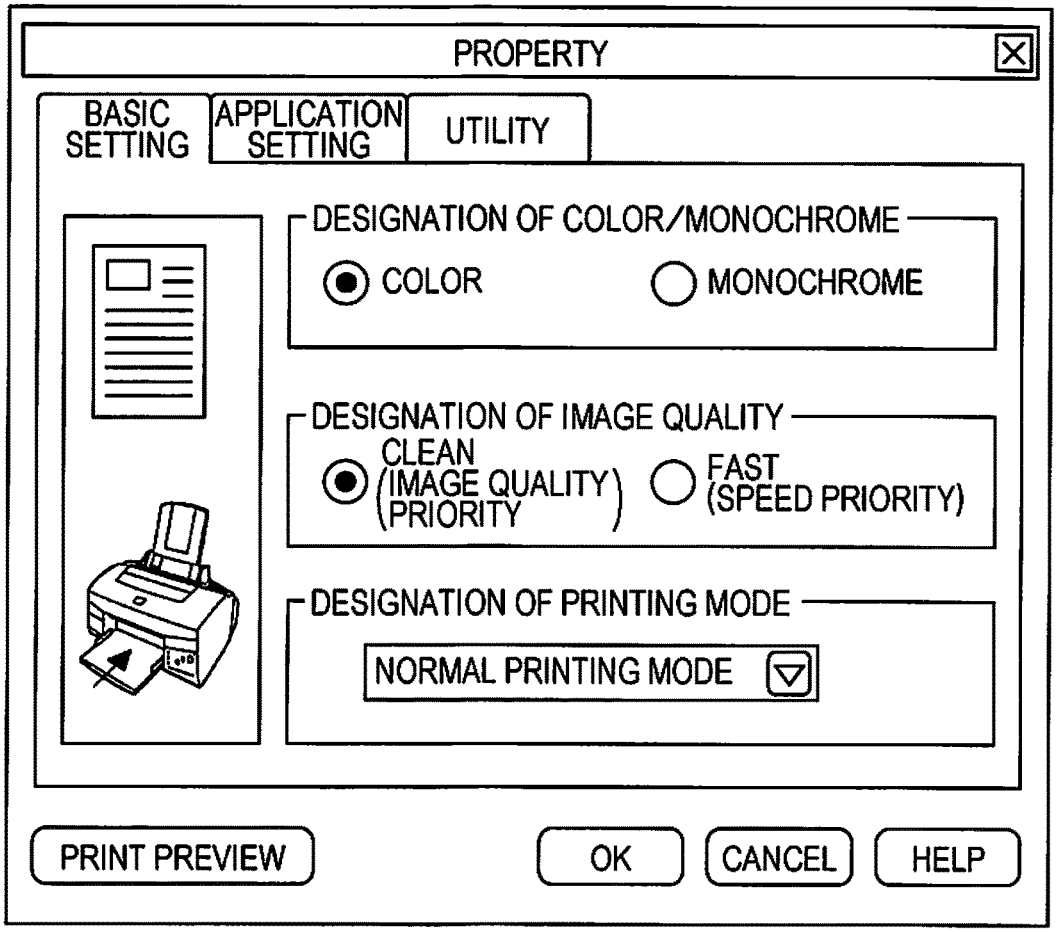
FIG. 2 is an explanatory diagram illustrating an example of a screen for designating printing conditions.

The printing mode designation unit 901 performs an application program stored in the storage unit 93 by the CPU of the host computer 9 and generates screen display information for displaying a screen for designating printing conditions (a so-called property screen of a printer) illustrated in FIG. 2 on the display unit 91 in a case where the application AP outputs the image data Img. The CPU of the host computer 9 displays the screen for designating printing conditions on the display unit 91 based on the screen display information. In addition, the user of the printing system 100 can designate the printing mode on the screen for designating printing conditions using the operation unit 92. In a case where the printing mode is designated on the screen for designating printing conditions by the user of the printing system 100, the printing mode designation unit 901 generates printing mode data MD showing the designated printing mode.

Further, the screen for designating printing conditions may be a screen capable of designating various printing conditions other than the printing mode. For example, as illustrated in FIG. 2, the screen for designating printing conditions may be a screen capable of designating color printing or monochrome printing. Further, as illustrated in FIG. 2, the screen may be a screen capable of selecting a printing process prioritizing the image quality or a printing process prioritizing the printing speed. Moreover, the screen may be a screen capable of selecting the size of the recording paper P or the number of print copies.

In addition, in the present embodiment, the printing mode is designated by the user of the printing system 100 in the screen for designating printing conditions, but the printing mode may be determined by the printing mode designation unit 901 based on the content shown by the image data Img.

1.3. Configuration of Ink Jet Printer

Next, the configuration of the ink jet printer 1 according to the present embodiment will be described with reference to FIGS. 3 and 4.

Figure 3:
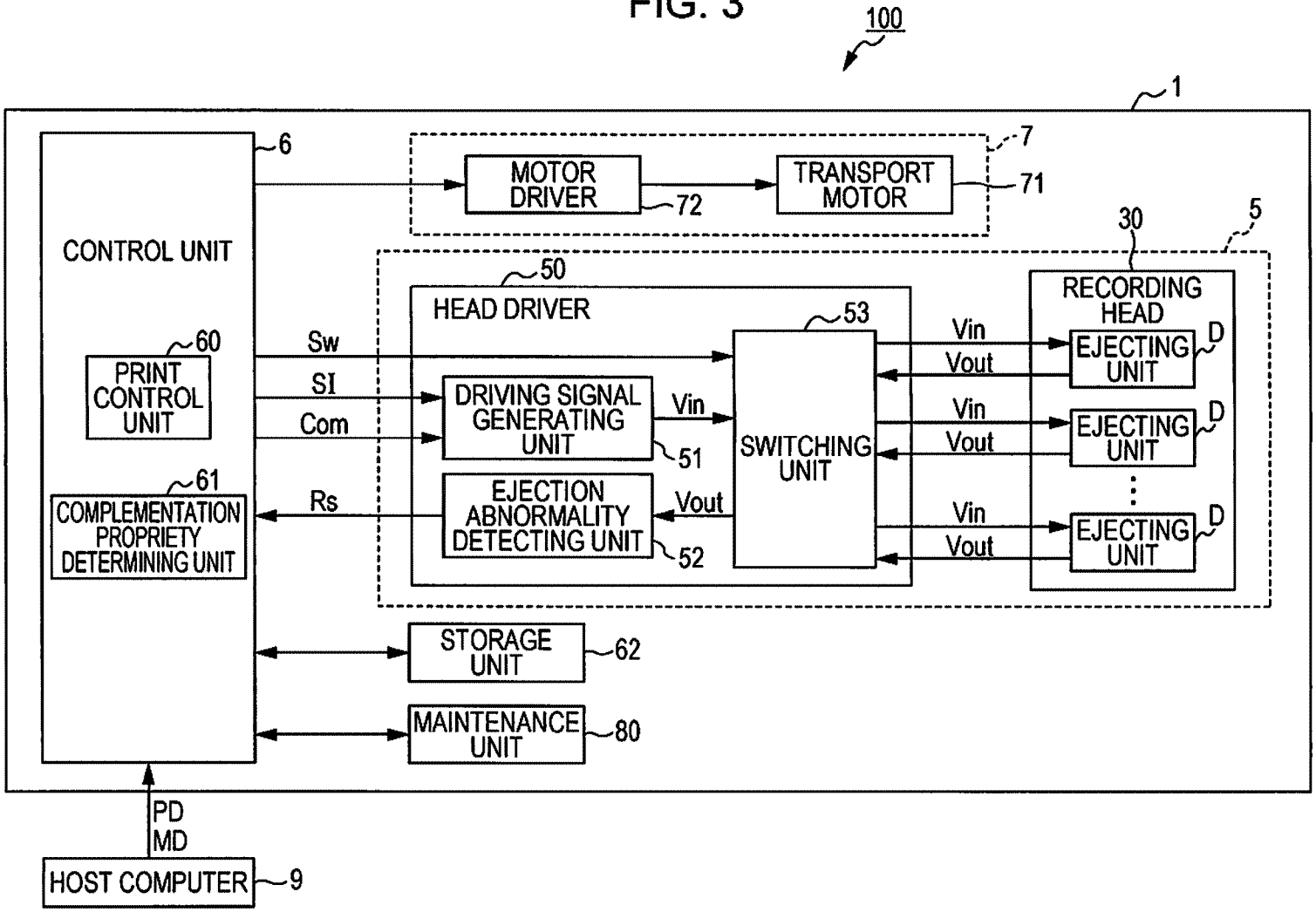
FIG. 3 is a block diagram illustrating a configuration of an ink jet printer.

FIG. 3 is a functional block diagram illustrating the configuration of the ink jet printer 1. FIG. 4 is a cross-sectional view schematically illustrating the internal configuration of the ink jet printer 1.

As illustrated in FIG. 3, the ink jet printer 1 includes a head unit 5 for which an ejection unit D ejecting an ink is provided; a transport mechanism 7 for changing a relative position of the recording paper P with respect to the head unit 5; a control unit 6 that controls operations of respective units of the ink jet printer 1; a storage unit 62 that stores a control program of the ink jet printer 1 or various pieces of information; and a maintenance unit 80 that performs a maintenance process for recovering the ejection state of an ink in the ejection unit D into a normal state in a case where ejection abnormality is detected in the ejection unit D.

Here, ejection abnormality is a general term for a state in which an ink is abnormally ejected from a nozzle N (see FIGS. 5 and 6 described below) included in the ejection unit D, that is, a state in which the ejection unit D is not capable of accurately ejecting an ink from the nozzle N.

More specifically, the ejection abnormality includes a state in which the ejection unit D cannot eject an ink; a state in which the ejection unit D cannot eject an ink of an amount necessary for forming an image shown by the print data PD because the amount of an ink to be ejected is small even when the ink can be ejected from the ejection unit D; and a state in which an ink of an amount more than necessary for forming an image shown by the print data PD is ejected from the ejection unit D; and a state in which an ink ejected from the ejection unit D is impacted at a position different from the impact position prepared for forming an image shown by the print data PD.

Further, the maintenance process is a general term including a wiping process of wiping foreign matters such as paper dust or the like adhered to the vicinity of the nozzle N of the ejection unit D using a wiper (not illustrated); a flushing process of allowing an ink to be preliminarily ejected from the ejection unit D; a pumping process of absorbing an ink which has thickened in the ejection unit D or bubbles using a tube pump (not illustrated); and a process of retuning the ejection state of an ink of the ejection unit D into a normal state.

Figure 4:
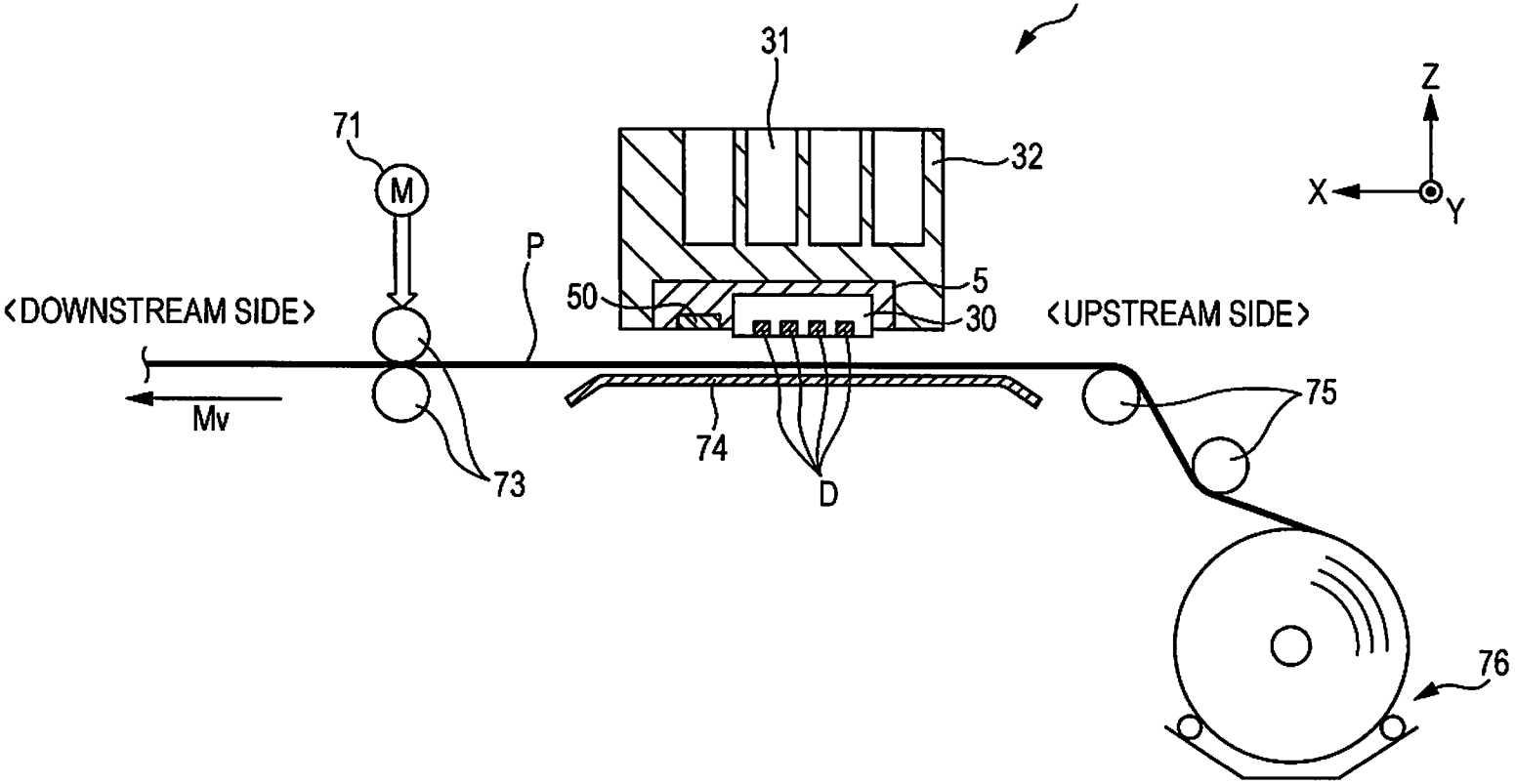
FIG. 4 is a partial cross-sectional view schematically illustrating the ink jet printer.

As illustrated in FIG. 4, the ink jet printer 1 includes a carriage 32 on which the head unit 5 is mounted. Four ink cartridges 31 are mounted on the carriage 32 in addition to the head unit 5.

Four ink cartridges 31 are provided in a one-to-one correspondence with four colors of black (BK), cyan (CY), magenta (MG), and yellow (YL) and the respective ink cartridges 31 are filled with inks of colors corresponding to the ink cartridges 31.

In addition, each of the ink cartridges 31 may be provided in a different area of the ink jet printer 1 instead of being mounted on the carriage 32.

As illustrated in FIG. 3, the transport mechanism 7 includes a transport motor 71 serving as a driving source for transporting the recording paper P and a motor driver 72 for driving the transport motor 71.

Further, as illustrated in FIG. 4, the transport mechanism 7 includes a platen 74 provided on the lower side (−Z direction in FIG. 4) of the carriage 32; a transport roller 73 rotating by the operation of the transport motor 71; a guide roller 75 provided so as to be freely rotatable around a Y axis in FIG. 4; and a storing unit 76 that stores the recording paper P in a state of winding the recording paper in a roll shape.

The transport mechanism 7 transports the recording paper P to a +X direction (to the downstream side from the upstream side) in the figure along a transport path regulated by the guide roller 75, the platen 74, and the transport roller 73 after the recording paper P is drawn out from the storing unit 76. In the present embodiment, the transport mechanism 7 transports the recording paper P to the +X direction (an example of a "first direction") at a transporting speed My in a case where the ink jet printer 1 performs the printing process.

The storage unit 62 includes an electrically erasable programmable read-only memory (EEPROM) which is a kind of non-volatile semiconductor memory that stores the print data PD and the printing mode data MD supplied from the host computer 9, a random access memory (RAM) that temporarily stores data required to perform various processes such as a printing process and the like and temporarily develops a control program for executing various processes such as a printing process and the like, and a PROM which is a kind of non-volatile semiconductor memory that stores the control program for controlling respective units of the ink jet printer 1.

The control unit 6 includes the CPU or a field-programmable gate array (FPGA) and controls operations of respective units of the ink jet printer 1 by the CPU or the like being operated according to a control program stored in the storage unit 62.

Specifically, the control unit 6 controls execution of the printing process of forming an image on the recording paper P according to the print data PD by controlling the head unit 5 and the transport mechanism 7 based on the print data PD and the printing mode data MD supplied from the host computer 9.

More specifically, the control unit 6 stores the print data PD and the printing mode data MD supplied from the host computer 9 in the storage unit 62. Next, the control unit 6 generates signals such as a printing signal SI and a driving waveform signal Com for driving the ejection unit D by controlling the operation of the head unit 5 based on various kinds of data stored in the storage unit 62 such as print data PD. Further, the control unit 6 generates the printing signal SI or signals for controlling the operation of the motor driver 72 based on the various kinds of data stored in the storage unit 62 and outputs the generated various signals. In addition, the driving waveform signals Com include driving waveform signals Com-A, Com-B, and Com-C according to the present embodiment and details will be described below.

As described above, the control unit 6 drives the transport motor 71 such that the recording paper P is transported to the +X direction by controlling the motor driver 72 and controls presence of ink ejection from the ejection unit D, the amount of an ink to be ejected, and the timing of ejecting an ink by controlling the head unit 5. In this manner, the control unit 6 adjusts the size and the arrangement of dots to be formed by the ink ejected on the recording paper P and controls execution of the printing process of forming an image corresponding to the print data PD on the recording paper P.

Moreover, the control unit 6 controls execution of various processes such as a maintenance process, a complementing process, a complementation propriety determining process, and an ejection state determining process.

Although the details will be described below, the complementing process is a process of complementing one ejection unit D with another ejection unit D which is different from the one ejection unit D in a case where ejection abnormality occurs in the one ejection unit D. More specifically, the complementing process is a process of complementing the one ejection unit D with another ejection unit D (allowing another ejection unit D to substitute the role of the one ejection unit D) by increasing the amount of an ink to be ejected from another ejection unit D different from the one ejection unit D instead of allowing the one ejection unit D to eject an ink. The control unit 6 is capable of continuously performing the printing process by controlling operation of respective units of the ink jet printer 1 such that the complementing process is performed without stopping the printing process and performing the maintenance process even when the ejection abnormality occurs.

Hereinafter, complementing one ejection unit D having one nozzle N with another ejection unit D having another nozzle N is referred to as "complementing one nozzle N with another nozzle N."

In addition, in the case of complementing one ejection unit D with another ejection unit D, "increasing the amount of an ink to be ejected from another ejection unit D" includes a case in which another ejection unit D which is not expected to eject an ink when the complementing process is not performed ejects an ink due to the complementing process being performed.

In addition, although the details will be described below, the ejection state determining process is a process of determining whether normal ejection of an ink from the ejection unit D is possible. Further, the complementation propriety determining process is a process of determining whether complementing of one ejection unit D with another ejection unit D is possible in a case of complementing one ejection unit D with another ejection unit D, that is, determining whether the ejection state in another ejection unit D is normal and normal ejection of an ink from another ejection unit D is possible. That is, the complementation propriety determining process is a process performed at the time of the complementing process.

As illustrated in FIG. 3, the head unit 5 includes a recording head 30 having 8M ejection units D and a head driver 50 that drives respective ejection units D included in the recording head 30 and detects ejection abnormality of the respective ejection units D (M is a natural number of 2 or higher). In addition, in order to distinguish each of the 8M ejection units D, expressions of a first stage, a second stage, . . . , an 8M-th stage in sequence from the top are used.

Each of the 8M ejection units D receives supply of an ink from any of four ink cartridges 31.

The inside of each of the ejection units D is filled with an ink supplied from the ink cartridge 31 and the ink filling the inside thereof can be ejected from the nozzle N included in the ejection unit D. Further, each ejection unit D forms an image on the recording paper P by ejecting an ink to the recording paper P at the timing at which the transport, mechanism 7 transports the recording paper P to the platen 74. In this manner, four colors of inks of CMYK can be ejected from the 8M ejection units D as a whole, so that full color printing is realized.

The head driver 50 includes a driving signal generating unit 51, an ejection abnormality detecting unit 52, and a switching unit 53.

The driving signal generating unit 51 generates a driving signal Vin for driving each of the 8M ejection units D included in the recording head 30 based on the signal such as the printing signal SI and the driving waveform signal Com supplied from the control unit 6. When the driving signal Vin is supplied, each ejection unit D is driven based on the supplied driving signal Vin and an ink filling the inside thereof can be ejected to the recording paper P.

The ejection abnormality detecting unit 52 detects, as a residual vibration signal Vout, a change of an internal pressure of the ejection unit D caused by vibration of the ink in the inside of the ejection unit D which is generated after the ejection unit D is driven by the driving signal Vin. Moreover, the ejection abnormality detecting unit 52 determines an ejection state of the ink in the ejection unit D such as whether the ejection abnormality occurs in the ejection unit D based on the detected residual vibration signal Vout, and outputs a determination result signal Rs representing the determination result.

The switching unit 53 electrically connects the respective ejection units D to any one of the driving signal generating unit 51 and the ejection abnormality detecting unit 52, based on the switching control signal Sw supplied from the control unit 6.

Further, the head driver 50 will be described in detail.

1.4. Configuration of Recording Head

Next, the recording head 30 and the ejection unit D provided in the recording head 30 will be described with reference to FIGS. 5 and 6.

Figure 5:
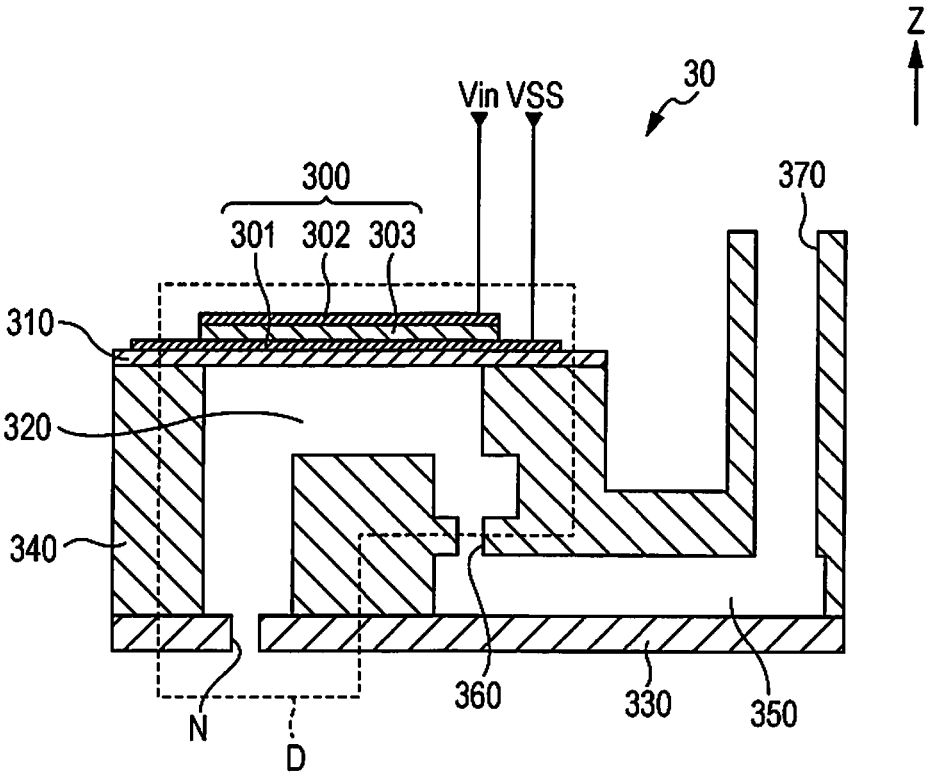
FIG. 5 is a cross-sectional view schematically illustrating a recording head.

FIG. 5 is an example of a partial cross-sectional view schematically illustrating the recording head 30. Further, for convenience of illustration, in the recording head 30, one ejection unit D among 8M ejection units D included in the recording head 30; a reservoir 350 communicating with the one ejection unit D through an ink supply port 360; and an ink inlet 370 for supplying an ink to the reservoir 350 from the ink cartridge 31 are illustrated in the figure.

As illustrated in FIG. 5, the ejection unit D includes a piezoelectric element 300; a cavity 320 whose inside is filled with an ink; the nozzle N communicating with the cavity 320; and a vibration plate 310. In the ejection unit D, the ink in the cavity 320 is ejected from the nozzle N by the piezoelectric element 300 being driven by the driving signal Vin.

The cavity 320 of the ejection unit D is a space divided by a cavity plate 340 formed to have a predetermined shape with a concave portion formed therein, a nozzle plate 330 on which the nozzle N is formed, and a vibration plate 310. The cavity 320 communicates with the reservoir 350 through the ink supply port 360. The reservoir 350 communicates with one ink cartridge 31 through the ink inlet 370.

In the present embodiment, a unimorph (monomorph) type as illustrated in FIG. 5 is employed as the piezoelectric element 300. The piezoelectric element 300 includes a lower electrode 301, an upper electrode 302, and a piezoelectric body 303 provided between the lower electrode 301 and the upper electrode 302. In addition, when a voltage is applied to a space between the lower electrode 301 and the upper electrode 302 by the lower electrode 301 being set to have a predetermined reference potential VSS and the driving signal Vin being supplied to the upper electrode 302, the piezoelectric element 300 is deflected in the vertical direction in response to the applied voltage and, as a result, the piezoelectric element 300 vibrates.

The vibration plate 310 is disposed in the opening portion of the upper surface of the cavity plate 340 and the lower electrode 301 is bonded to the vibration plate 310. Accordingly, when the piezoelectric element 300 vibrates due to the driving signal Vin, the vibration plate 310 vibrates. Further, the volume of the cavity 320 (pressure in the cavity 320) is changed due to the vibration of the vibration plate 310 and the ink filled in the cavity 320 is ejected by the nozzle N.

In the case where the ink in the cavity 320 is reduced due to ejection of the ink, the ink is supplied from the reservoir 350. In addition, the ink is supplied to the reservoir 350 from the ink cartridge 31 through the ink inlet 370.

Figure 6:
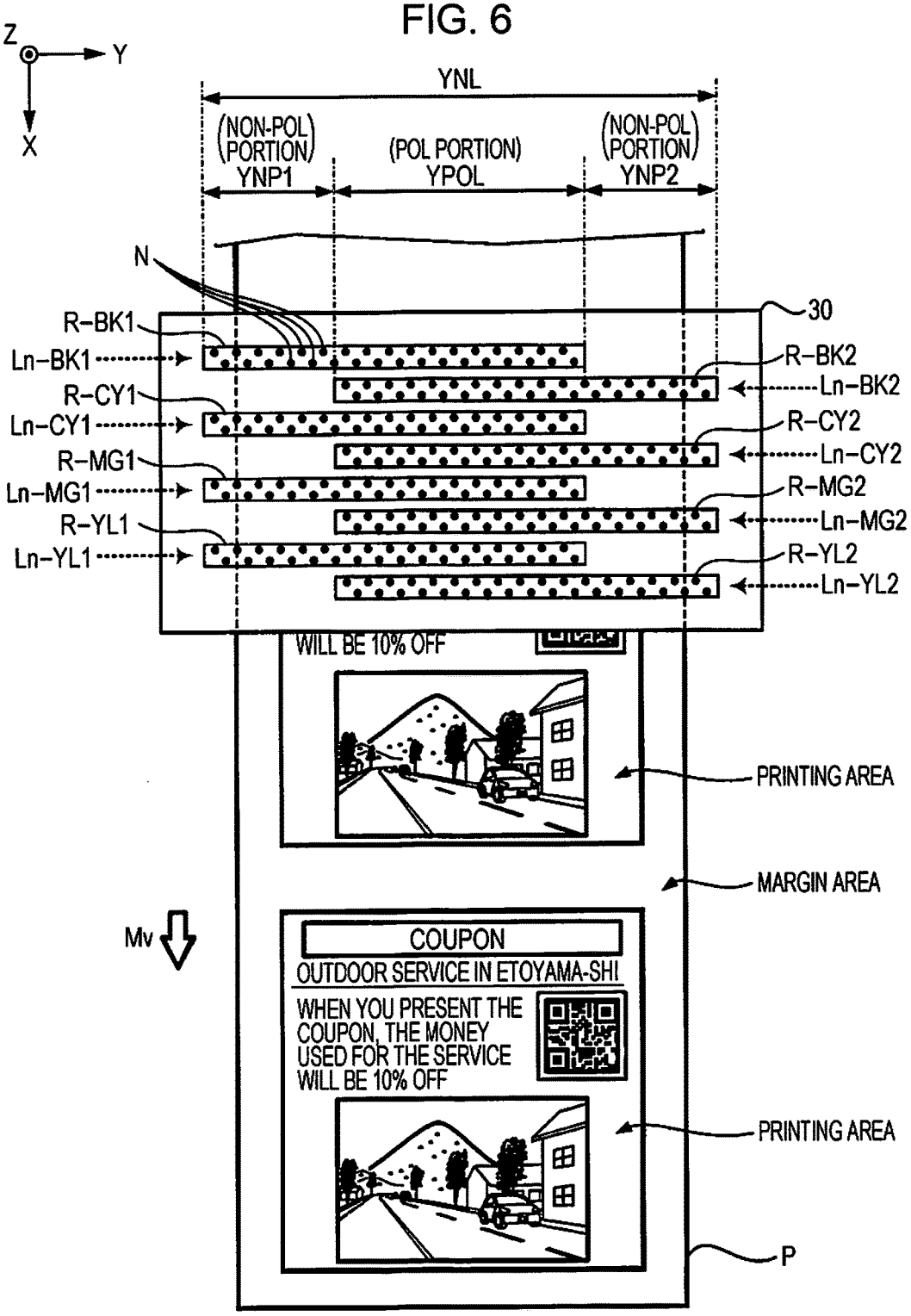
FIG. 6 is a plan view illustrating an arrangement example of nozzles in the recording head.

FIG. 6 is an explanatory diagram for describing an example of arrangement of 8M nozzles N provided in the recording head 30 when the ink jet printer 1 is seen in a +Z direction or a −Z direction (hereinafter, seeing the ink jet printer 1 from the +Z direction or the −Z direction is referred to as "plan view").

As illustrated in FIG. 6, eight nozzle arrays Ln (Ln-BK1 to Ln-YL2) including a nozzle array Ln-BK1 formed of M nozzles N arranged in a nozzle forming area R-BK1; a nozzle array Ln-BK2 formed of M nozzles N arranged in a nozzle forming area R-BK2; a nozzle array Ln-CY1 formed of M nozzles N arranged in a nozzle forming area R-CY1; a nozzle array Ln-CY2 formed of M nozzles N arranged in a nozzle forming area R-CY2; a nozzle array Ln-MG1 formed of M nozzles N arranged in a nozzle forming area R-MG1; a nozzle array Ln-MG2 formed of M nozzles N arranged in a nozzle forming area R-MG2; a nozzle array Ln-YL1 formed of M nozzles N arranged in a nozzle forming area R-YL1; and a nozzle array Ln-YL2 formed of M nozzles N arranged in a nozzle forming area R-YL2 are provided in the recording head 30.

Hereinafter, the nozzle forming areas (R-BK1 to R-YL2) are also simply referred to as an "areas (R-BK1 to R-YL2)." Further, each nozzle array Ln is an example of a "nozzle group."

Each of the eight areas R-BK1 to R-YL2 are virtual areas having a rectangular shape divided by a long side extending in a Y axis direction (an example of a "second direction") and a short side extending in an X axis direction when seen in a plan view.

More specifically, as illustrated in FIG. 6, the areas R-BK1, R-CY1, R-MG1, and R-YL1 are provided so as to extend to regions YNP1 and YPOL in the Y axis direction and the areas R-BK2, R-CY2, R-MG2, and R-YL2 are provided so as to extend to regions YPOL and YNP2 in the Y axis direction.

Further, positions of these eight areas (R-BK1 to R-YL2) in the X axis direction are different from one another and the eight areas are arranged in order of the area R-BK1, the area R-BK2, the area R-CY1, the area R-CY2, the area R-MG1, the area R-MG2, the area R-YL1, and the area R-YL2 toward the +X side (downstream side) from the −X side (upstream side).

In addition, among each of the eight areas (R-BK1 to R-YL2), a portion positioned in the region YPOL is referred to as an overlapping area (POL portion) and a portion positioned in the region YNP1 or the region YNP2 is referred to as a non-overlapping area (non-POL portion).

Each of 2M nozzles N belonging to the nozzle arrays Ln-BK1 and Ln-BK2 is a nozzle N provided in the ejection unit D ejecting a black (BK) ink; each of 2M nozzles N belonging to the nozzle arrays Ln-CY1 and Ln-CY2 is a nozzle N provided in the ejection unit D ejecting a cyan (cyan) ink; each of 2M nozzles N belonging to the nozzle arrays Ln-MG1 and Ln-MG2 is a nozzle N provided in the ejection unit D ejecting a magenta (MG) ink; and each of 2M nozzles N belonging to the nozzle arrays Ln-YL1 and Ln-YL2 is a nozzle N provided in the ejection unit D ejecting a yellow (YL) ink.

As illustrated in FIG. 6, M nozzles N constituting each of the nozzle arrays Ln is arranged in a so-called zigzag shape such that the positions of the even-numbered nozzles N are differentiated from the positions of the odd-numbered nozzles N in the X axis direction from the left side (−Y side) in the figure.

In each nozzle array Ln, the interval between nozzles N in the Y axis direction can be suitably set according to the print resolution (dpi: dot per inch).

As illustrated above, the ink jet printer 1 is a line printer. Accordingly, a range in which 8M nozzles N are provided in the Y axis direction (that is, the region YNL formed of the regions YNP1, YPOL, and YNP2) becomes wider than the width of the recording paper P (accurately, in the recording paper P, the recording paper P whose width in the Y axis direction is the maximum in a level in which the ink jet printer 1 can perform printing).

In addition, each nozzle N positioned in the region YPOL from among M nozzles N belonging to each nozzle array Ln is referred to as an "overlapping nozzle" and each nozzle N positioned in a region other than the region YPOL (region YNP1 or YNP2) is referred to as a "non-overlapping nozzle."

As illustrated in FIG. 6, the overlapping nozzles are nozzles N ejecting an ink having the same color in the nozzle array Ln different from the nozzle array Ln to which the overlapping nozzles belong and are nozzles N in which nozzles N whose positions in the Y axis direction are approximately the same are present.

Further, in the present specification, "approximately the same" includes a case of the same when various kinds of errors such as production errors or errors caused by noise or the like are considered in addition to a case of completely the same.

The printing process of the present embodiment is performed with the assumption that a plurality of images in one-to-one correspondence with a plurality of printing areas are formed after the recording paper P is divided into a plurality of printing areas (for example, an A4-size square area in a case of printing an A4-size image on the recording paper P or a label in label paper) and a margin area for dividing each of the plurality of printing areas as illustrated in FIG. 6, without forming one long image across the entire recording paper P.

Further, a printing mode is selected for each printing area according to an image to be formed in the printing area. Same images are generally formed in each of the plurality of printing areas in many cases. For this reason, the printing process with respect to the plurality of printing areas included in the recording paper P is generally performed using the same printing mode.

2. Operation of Ejection Unit and Residual Vibration

Next, an operation of ejecting an ink from the ejection unit D and the residual vibration generated in the ejection unit D will be described with reference to FIGS. 7A to 15.

Figure 7A:
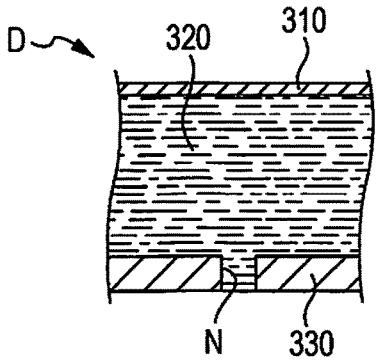
FIGS. 7A to 7C are explanatory diagrams for describing a change in the shape of a cross section of an ejection unit when a driving signal is supplied.
Figure 7B:
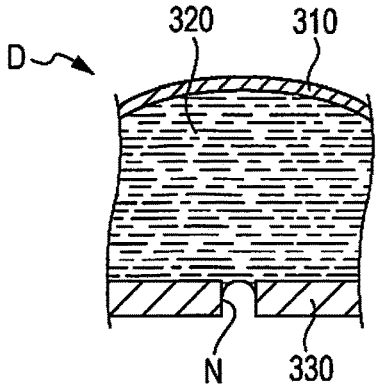
Figure 7C:
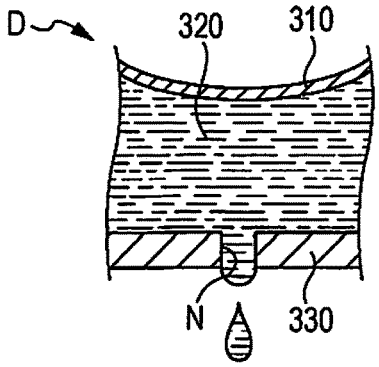

FIGS. 7A to 7C are explanatory diagram for describing the operation of ejecting an ink from the ejection unit D.

When the driving signal Vin is supplied to the piezoelectric element 300 included in the ejection unit D from the head driver 50 in the state illustrated in FIG. 7A, distortion is generated in response to an electric field applied to a space between electrodes in the piezoelectric element 300, and the vibration plate 310 of the ejection unit D is deflected toward the upper direction in FIG. 7A. In this manner, the volume of the cavity 320 of the ejection unit D expands as illustrated in FIG. 7B compared to the initial state illustrated in FIG. 7A. In this state illustrated in FIG. 7B, when the potential indicated by the driving signal Vin is changed, the vibration plate 310 is restored by an elastic restoring force and moves toward the lower direction over the position of the vibration plate 310 in the initial state, and the volume of the cavity 320 illustrated in FIG. 7C is rapidly contracted. At this time, some of the ink filling the cavity 320 is ejected as ink droplets from the nozzles N communicating with the cavity 320 by the compressed pressure generated in the cavity 320.

The vibration plate 310 of the cavity 320 damping-vibrates, that is, residual-vibrates until the subsequent ink ejecting operation starts after a series of ink ejecting operations are finished. It is assumed that the residual vibration of the vibration plate 310 has a natural vibration frequency determined by shapes of the nozzles N and the ink supply port 360, or acoustic resistance r due to ink viscosity, an inertance m due to the ink weight within a flow path, and a compliance Cm of the vibration plate 310.

A calculation model of the residual vibration of the vibration plate 310 based on the assumption will be described.

Figure 8:
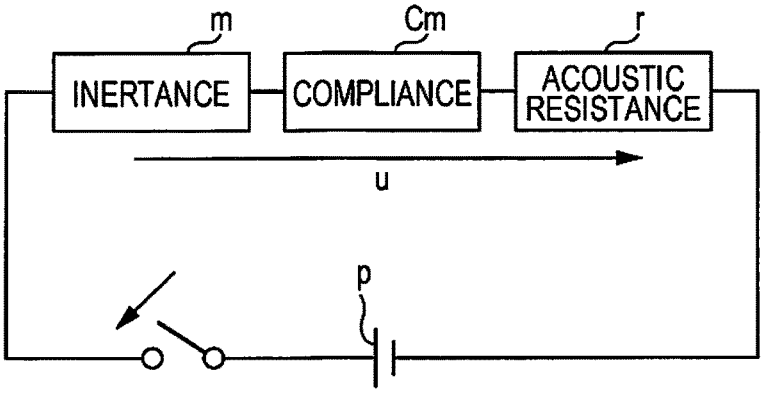
FIG. 8 is a circuit diagram illustrating a model of simple vibration showing residual vibration in the ejection unit.

FIG. 8 is a circuit diagram illustrating the calculation model of simple vibration which assumes the residual vibration of the vibration plate 310. As described above, the calculation model of the residual vibration of the vibration plate 310 is expressed by an acoustic pressure p, the above-described inertance m, the compliance Cm, and the acoustic resistance r. Further, if a step response is calculated for a volume velocity u when the acoustic pressure p is applied to the circuit of FIG. 8, the following equation is obtained.

$$u=\{p/(\omega\cdot m)\}e^{-\sigma t}\cdot\sin(\omega t)$$

$$\omega=\{1/(m\cdot Cm)-\alpha^2\}^{1/2}$$

$$\sigma=r/(2m)$$

The calculation result (calculated value) obtained from the equation is compared with a test result (test value) in the test of the residual vibration of the ejection unit D, which is separately performed. In addition, the test of residual vibration is a test of detecting residual vibration generated in the vibration plate 310 of the ejection unit D after an ink is ejected from the ejection unit D whose ejection state of the ink is normal.

Figure 9:
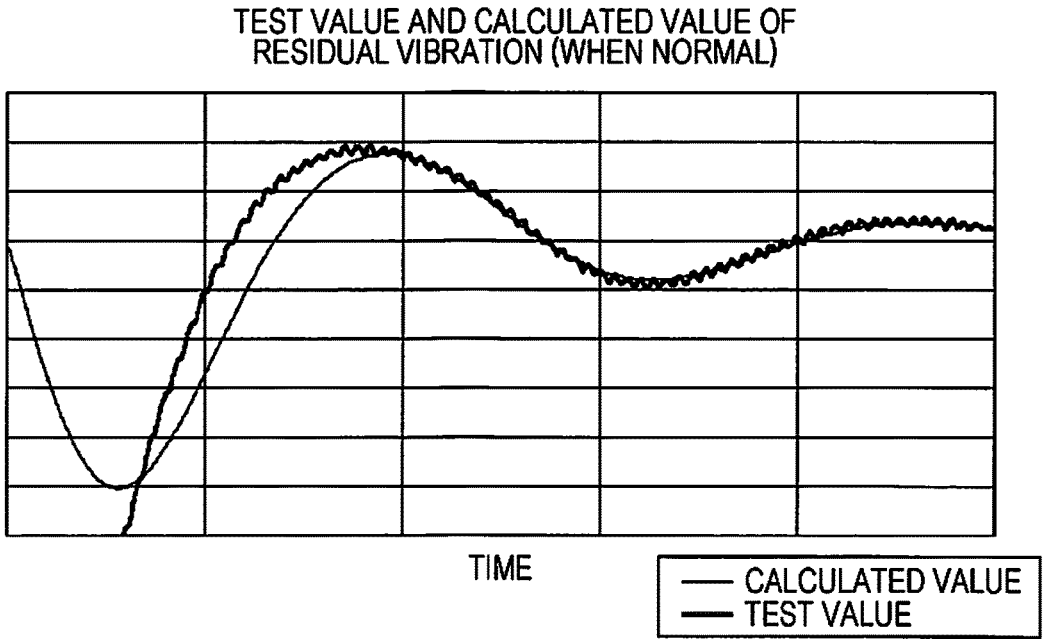
FIG. 9 is a graph illustrating a relationship between a test value and a calculated value of residual vibration in a case where the ejection state of the ejection unit is normal.

FIG. 9 is a graph illustrating a relation between test values and calculated values of the residual vibration. As understood from the graph of FIG. 9, two waveforms of the test values and the calculated values substantially coincide with each other in the case where the ejection state of the ink in the ejection unit D is normal.

There is a case in which the ejection state of the ink in the ejection unit D is abnormal and ink droplets are not normally ejected from the nozzle N of the ejection unit D, that is, ejection abnormality occurs even though the ink ejecting operation is performed by the ejection unit D. As a cause by which the ejection abnormality is generated, (1) mixing of bubbles into the cavity 320, (2) thickening or fixing of the ink in the cavity 320 caused by drying or the like of the ink in the cavity 320, or (3) attaching of paper powder to the vicinity of the outlet of the nozzle N can be exemplified.

As described above, the ejection abnormality typically means a state in which an ink cannot be ejected from the nozzle N, that is, a non-ejection phenomenon of the ink is exhibited. In this case, dot omission of a pixel in an image printed on the recording paper P occurs. Moreover, when the ejection abnormality occurs, even though the ink is ejected from the nozzle N, the amount of the ink is extremely small or a scattering direction (a trajectory) of the ejected ink droplets is shifted. Thus, since impact is not appropriately performed, the dot omission of the pixel appears. In this way, in the following description, the ejection abnormality is also simply referred to as "dot omission" and the nozzle included in the ejection unit D, in which ejection abnormality occurs is also referred to as a "nozzle omission."

In the following description, based on the comparison result illustrated in FIG. 9, at least one value of the acoustic resistance r and the inertance m is adjusted so as to allow the calculated values and the test values of the residual vibration to substantially coincide with each other for each cause of the ejection abnormality occurring in the ejection unit D.

Figure 10:
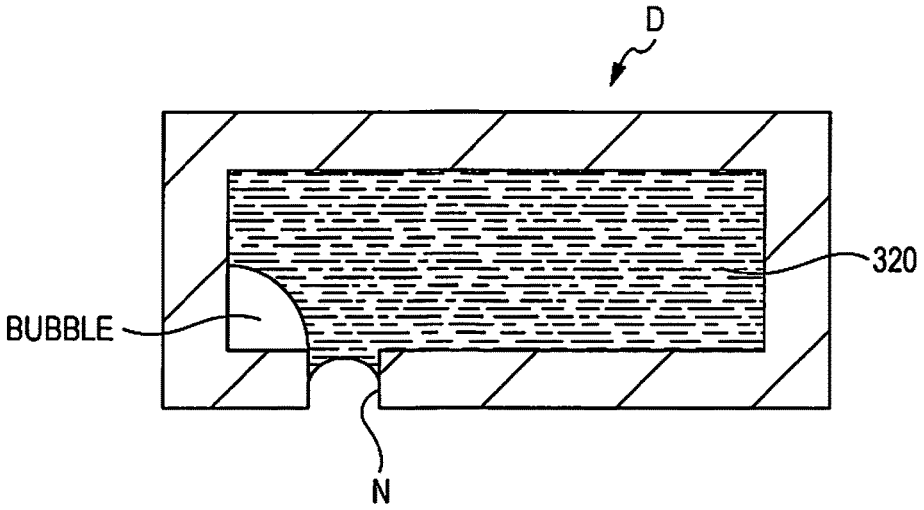
FIG. 10 is an explanatory diagram illustrating the state of the ejection unit in a case where bubbles are mixed into the inside of the ejection unit.

First, (1) the mixing of bubbles into the cavity 320 which is one cause of the ejection abnormality is inspected. FIG. 10 is a conceptual view for describing the case in which bubbles are mixed into the cavity 320. As illustrated in FIG. 10, in the case where bubbles are mixed into the cavity 320, it is considered that the total weight of the ink filled in the cavity 320 is reduced and the inertance m is decreased. Moreover, as illustrated in FIG. 10, in the case where a bubble is adhered to the vicinity of the nozzle N, it is considered that diameter of the nozzle N becomes larger by the diameter of the bubble and the acoustic resistance r is decreased.

Figure 11:
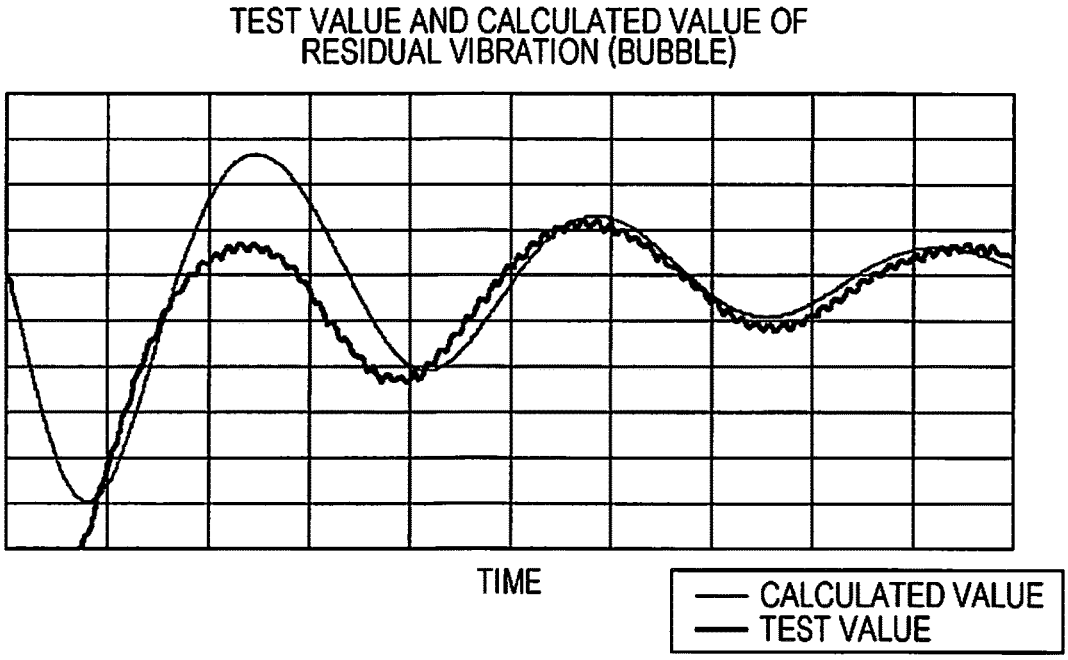
FIG. 11 is a graph illustrating the test value and the calculated value of the residual vibration in the state in which bubbles are mixed into the inside of the ejection unit.

Accordingly, the acoustic resistance r and the inertance m are set to be small to match the test values of the residual vibration when bubbles are mixed in, compared to the case where the ejection state of the ink is normal as illustrated in FIG. 9, so that a result (a graph) illustrated in FIG. 11 is obtained. As can be seen from FIGS. 9 and 11, in the case where bubbles are mixed into the cavity 320 and thus the ejection abnormality occurs, the frequency of the residual vibration becomes higher compared to the case where the ejection state is normal. Further, it can be recognized that a damping rate of an amplitude of the residual vibration is also decreased due to a decrease in the acoustic resistance r, so that the amplitude of the residual vibration is slowly decreased.

Figure 12:
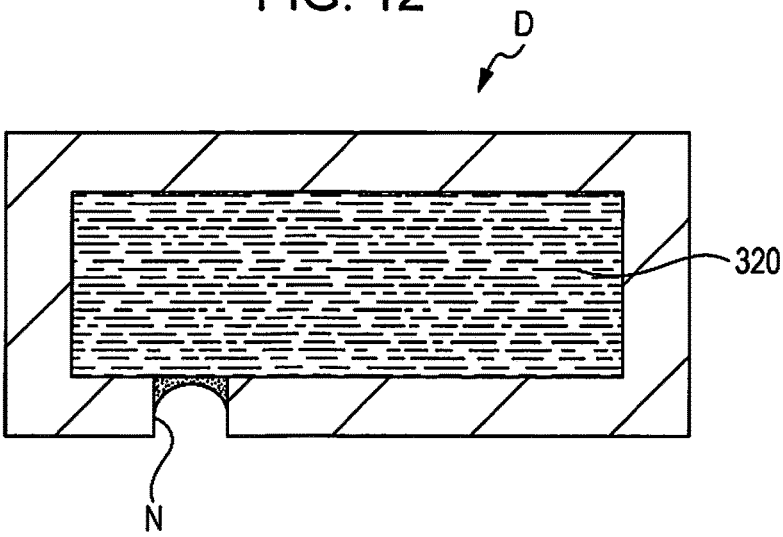
FIG. 12 is an explanatory diagram illustrating the state of the ejection unit in a case where the ink is fixed in the vicinity of a nozzle.

Next, (2) thickening or fixing of the ink in the cavity 320 which is another cause of the ejection abnormality is inspected. FIG. 12 is a conceptual view for describing the case in which an ink is fixed to the vicinity of the nozzle N of the cavity 320 due to drying. As illustrated in FIG. 12, when the ink in the vicinity of the nozzle N is dried and fixed, the ink in the cavity 320 is enclosed in the cavity 320. In such a case, it is considered that the acoustic resistance r is increased.

Figure 13:
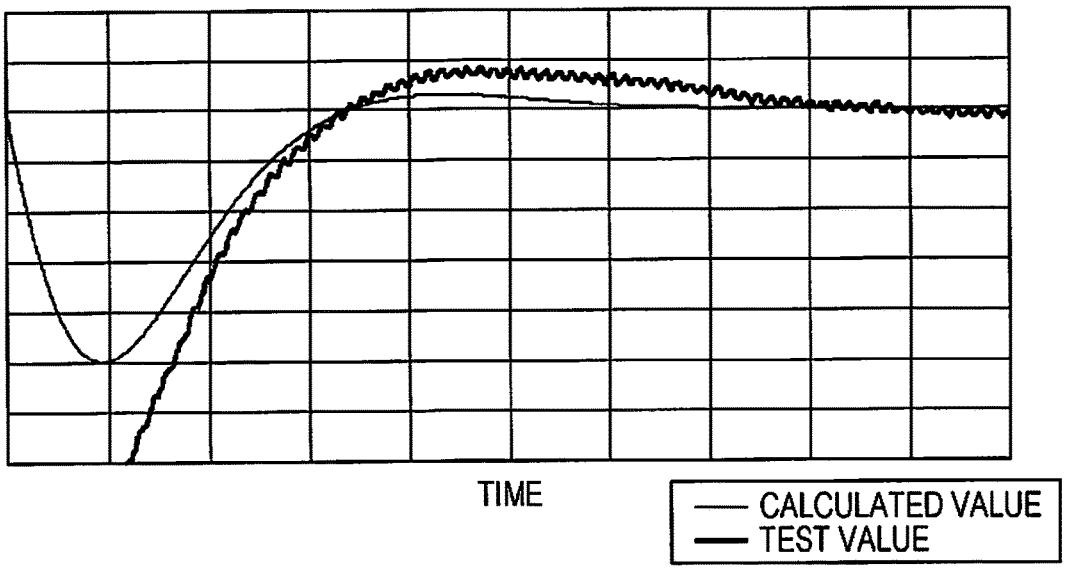
FIG. 13 is a graph illustrating the test value and the calculated value of the residual vibration in a state in which the ink cannot be ejected due to the fixation of the ink in the vicinity of the nozzle.

Accordingly, the acoustic resistance r is set to be large to match the test values of the residual vibration when the ink in the vicinity of the nozzle N is fixed or thickened compared to the case where the ejection state of the ink is normal as illustrated in FIG. 9, so that a result (a graph) as in FIG. 13 is obtained. Further, the test values illustrated in FIG. 13 are obtained by measuring the residual vibration of the vibration plate 310 in a state in which the ejection unit D stands still without mounting a cap (not illustrated) for several days and the ink in the vicinity of the nozzle N is fixed. As can be seen from FIGS. 9 and 13, when the ink is fixed to the vicinity of the nozzle N in the cavity 320, the frequency of the residual vibration is extremely decreased when compared to the case where the ejection state is normal, and a distinctive waveform in which the residual vibration is over-damped is obtained. This is because it is difficult for the vibration plate 310 to rapidly vibrate (due to the over-damping) since there is no retreat route of the ink in the cavity 320 at the time of the vibration plate 310 moving in the −Z direction (downwards) after the ink is allowed to flow into the cavity 320 from the reservoir by pulling the vibration plate 310 upwards in the +Z direction (upwards) in order to eject the ink.

Figure 14:
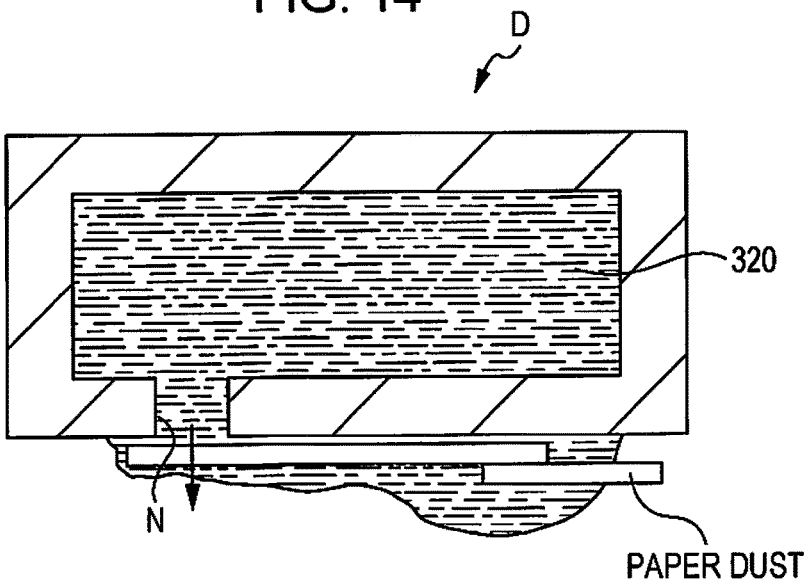
FIG. 14 is an explanatory diagram illustrating the state of the ejection unit in a case where paper dust adheres to the vicinity of an outlet of the nozzle.

Next, (3) adhering of paper dust to the vicinity of the outlet of the nozzle N which is one cause of the ejection abnormality is inspected. FIG. 14 is a conceptual view for describing the case where paper dust is adhered to the vicinity of the outlet of the nozzle N.

As illustrated in FIG. 14, when the paper dust is adhered to the vicinity of the outlet of the nozzle N, the ink is exuded from the inside of the cavity 320 through the paper dust and the ink cannot be ejected from the nozzle N. In the case where paper dust is adhered to the vicinity of the outlet of the nozzle N and the ink is exuded from the nozzle N, since the exuded ink from the cavity 320 is more increased compared to the case where the ejection state is normal when viewed from the vibration plate 310, the inertance m is increased. Moreover, it is considered that the acoustic resistance r is increased by fibers of the paper dust adhered to the vicinity of the outlet of the nozzle N.

Figure 15:
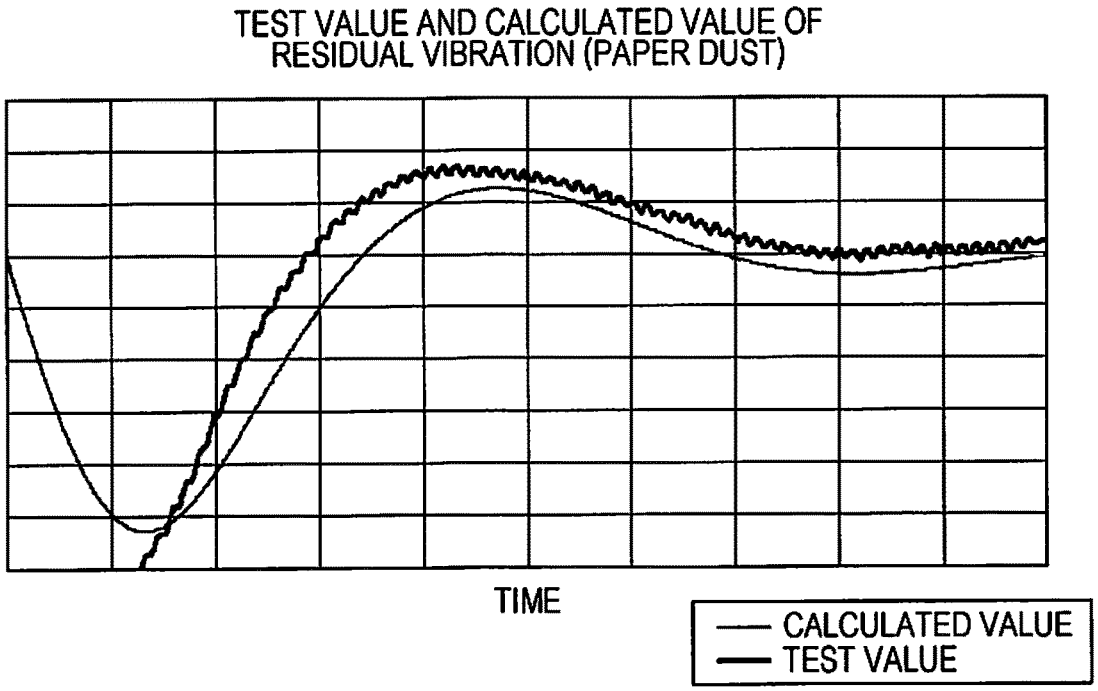
FIG. 15 is a graph illustrating the test value and the calculated value of the residual vibration in a state in which the ink cannot be ejected due to the adhesion of paper dust to the vicinity of the outlet of the nozzle.

Accordingly, the inertance m and the acoustic resistance r are set to be large to match the test values of the residual vibration when the paper dust is adhered to the vicinity of the outlet of the nozzle N compared to the case where the ejection state of an ink is normal as illustrated in FIG. 9, so that a result (a graph) of FIG. 15 is obtained. As can be seen from the graphs of FIGS. 9 and 15, when the paper dust is adhered to the vicinity of the outlet of the nozzle N, the frequency of the residual vibration becomes lower compared to the case in which the ejection state is normal.

In addition, it is understood that the frequency of the residual vibration is high in the case where (3) paper dust is adhered to the vicinity of the outlet of the nozzle N from the graphs of FIGS. 13 and 15 compared to the case where (2) the ink in the cavity 320 is thickened.

Here, in both cases of (2) thickening of an ink and (3) adhering paper dust to the vicinity of the outlet of the nozzle N, the frequency of the residual vibration is low compared to the case where the ejection state of the ink is normal. The two causes of the ejection abnormality can be distinguished from each other by comparing the waveform of the residual vibration, specifically, the frequency or the cycle of the residual vibration with a predetermined threshold value.

As is obvious from the above description, it is possible to determine the ejection state of the respective ejection units D based on the waveform, particularly, the frequency or the cycle of the residual vibration generated when the respective ejection units D are driven. More specifically, based on the frequency or the cycle of the residual vibration, it is possible to determine whether the ejection state in each of the ejection units D is normal and to determine to which numbers of (1) to (3) the cause of the ejection abnormality corresponds when the ejection state in each of the respective ejection units D is abnormal.

The ink jet printer 1 according to the present embodiment performs the ejection state determining process of determining the ejection state by analyzing the residual vibration.

3. Configurations and Operations of Head Driver

Next, the configurations and the operations of the head driver 50 (the driving signal generating unit 51, the ejection abnormality detecting unit 52, and the switching unit 53) will be described with reference to FIGS. 16 to 23.

Figure 16:
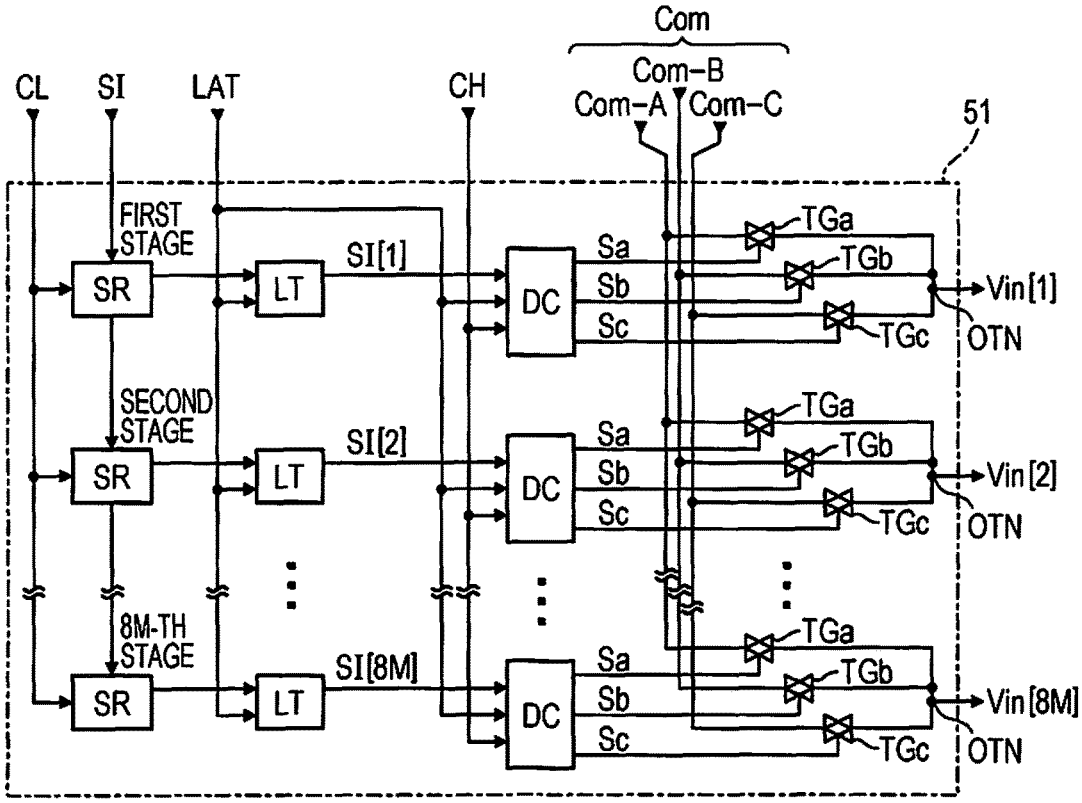
FIG. 16 is a block diagram illustrating a configuration of a driving signal generating unit.

FIG. 16 is a block diagram illustrating the configuration of the driving signal generating unit 51 of the head driver 50.

As illustrated in FIG. 16, the driving signal generating unit 51 has 8M sets including shift registers SR, latch circuits LT, decoders DC, and transmission gates TGa, TGb and TGc so as to be in one-to-one correspondence with the 8M ejection units D. In the following description, the respective elements constituting the 8M sets are referred to as a first stage, a second stage, . . . , and a 8M-th stage in order from the top in the drawing.

Further, although details will be described below, the ejection abnormality detecting unit 52 includes 8M ejection abnormality detection circuits CT (CT[1], CT[2], . . . , and CT[8M]) so as to be in one-to-one correspondence with the 8M ejection units D.

Clock signals CL, printing signals SI, latch signals LAT, change signals CH, and driving waveform signals Com (Com-A, Com-B and Com-C) are supplied to the driving signal generating unit 51 from the control unit 6.

Here, the printing signal SI is a digital signal that regulates the amount of ink ejected from each ejection unit D (each nozzle N) at the time of forming one dot of an image. More specifically, the printing signals SI according to the present embodiment are signals that regulate the amount of ink ejected from each ejection unit D by 3 bits of a high-order bit b1, a middle-order bit b2 and a low-order bit b3, and are serially supplied to the driving signal generating unit 51 in synchronization with the clock signals CL from the control unit 6. By controlling the amount of ink ejected from each ejection unit D by the printing signals SI, it is possible to express four gradation steps of non-recording, a small dot, a medium dot and a large dot in the respective dots of the recording paper P, and it is possible to generate the residual vibration to generate the driving signal Vin for inspection in order to inspect the ejection state of the ink.

The respective shift registers SR temporarily hold the printing signals SI of 3 bits corresponding to the respective ejection units D. Specifically, the 8M shift registers SR of the first stage, the second stage, . . . , and the 8M-th stage in one-to-one correspondence with the 8M ejection units D are cascade-connected to each other, and the printing signals SI serially supplied are sequentially transferred to the subsequent stage in response to the clock signals CL. Furthermore, the supply of the clock signals CL is stopped when the printing signals SI are transferred to all of the 8M shift registers SR, and each of the 8M shift registers SR maintains a state where each of the 8M shift registers holds data of 3 bits corresponding to each shift register among the printing signals SI.

The 8M latch circuits LT simultaneously latch the printing signals SI of 3 bits corresponding to the respective stages held by the respective 8M shift registers SR at the timing when the latch signals LAT rise. In FIG. 16, SI[1], SI[2], . . . , SI[8M] indicate the printing signals SI of 3 bits latched by the latch circuits LT corresponding to the shift registers SR of first, second, . . . and 8M stages.

On the other hand, the operation period which is a period for which the ink jet printer 1 operates at least one process among the printing process and the ejection state determining process is formed of a plurality of unit operation periods Tu. The respective unit operation periods Tu are formed of a control period Ts1 and a control period Ts2 which follows the control period Ts1. In the present embodiment, the control periods Ts1 and Ts2 have the equivalent time length to each other.

In addition, in the present embodiment, a plurality of unit operation periods Tu constituting the operation period are classified into two unit operation periods Tu, which are a unit operation period Tu for which the printing process is performed and a unit operation period Tu for which the ejection state determination process is performed.

As described above, the ink jet printer 1 according to the present embodiment divides the long recording paper P into a plurality of printing areas and a margin area for dividing each of the plurality of printing areas and then forms one image with respective printing areas.

Specifically, the control unit 6 classifies the period for which at least a part of the printing area of the recording paper P is positioned on the lower side (−Z side) of the recording head 30 into the unit operation period TU for which the printing process is performed, among the plurality of unit operation periods Tu constituting the operation period and controls operations of the respective units of the ink jet printer 1 such that the printing process is performed during the unit operation period Tu.

Meanwhile, the control unit 6 classifies the period for which only the margin area the recording paper P is positioned on the lower side (−Z side) of the recording head 30 into the unit operation period Tu for which the ejection state determining process is performed, among the plurality of unit operation periods Tu constituting the operation period and controls operations of the respective units of the ink jet printer 1 such that the ejection state determining process is performed during the unit operation period Tu.

The control unit 6 supplies the printing signals SI to the driving signal generating unit 51 for each unit operation period Tu and supplies the latch signals LAT such that the latch circuits LT latch the printing signals SI[1], SI[2], m, SI[8M] for each unit operation period Tu. That is, the control unit 6 controls the driving signal generating unit 51 to supply the driving signals Vin to the 8M ejection units D for each unit operation period Tu.

More specifically, the control unit 6 controls the driving signal generating unit 51 such that the driving signals Vin for printing are supplied to the respective 8M ejection units D during the unit operation period Tu for which the printing process is performed. Accordingly, the 8M ejection units D eject the ink with an amount according to print data PD on the recording paper P and an image corresponding to the print data PD is formed on the recording paper P.

The control unit 6 controls the driving signal generating unit 51 such that the driving signals Vin for inspection are supplied to the respective 8M ejection units D during the unit operation period Tu for which the ejection state determining process is performed. In this manner, it is determined whether the ejection abnormality occurs in each of the ejection units D.

The decoder DC decodes the printing signal SI of 3 bits latched by the latch circuit LT, and outputs selection signals Sa, Sb and Sc during each of the control periods Ts1 and Ts2.

FIG. 17 is an explanatory diagram illustrating contents of decoding performed by the decoder DC. As illustrated in the figure, when the printing signals SI [m] corresponding to the m stages (m is a natural number which satisfies 1≤m≤8M) indicate, for example, (b1, b2, b3)=(1, 0, 0), the decoders DC of m stages set the selection signal Sa to a high level H and set the selection signals Sb and Sc to a low level L during the control period Ts1. In addition, the decoders set the selection signals Sb to a high level H and set the selection signal Sa and Sc to a low level L during the control period Ts2.

Moreover, when the low-order bit b3 is "1," that is, (b1, b2, b3)=(0, 0, 1), the decoders DC of m stages set the selection signal Sc to a high level H and set the selection signals Sa and Sb to a low level L during the control periods Ts1 and Ts2.

The description returns to FIG. 16.

As illustrated in FIG. 16, the driving signal generating unit 51 includes 8M sets of transmission gates TGa, TGb, and TGc. The 8M sets of transmission gates TGa, TGb, and TGc are provided in one-to-one correspondence with the 8M ejection units D.

The transmission gate TGa is turned on when the selection signal Sa is in a high level H, and is turned off when the selection signal Sa is in a low level L. The transmission gate TGb is turned on when the selection signal Sb is in a high level H, and is turned off when the selection signal Sb is in a low level L. The transmission gate TGc is turned on when the selection signal Sc is in a high level H, and is turned off when the selection signal Sc is in a low level L.

For example, in the m-th stage, when the content indicated by the printing signal Si[m] is (b1, b2, b3)=(1, 0, 0), the transmission gate TGa is turned on and the transmission gates TGb and TGc are turned off during the control period Ts1, and the transmission gate TGb is turned on and the transmission gates TGb and TGc are turned off during the control period Ts2.

The driving waveform signal Com-A is supplied to one terminal of the transmission gate TGa, the driving waveform signal Com-B is supplied to one terminal of the transmission gate TGb, and the driving waveform signal Com-C is supplied to one terminal of the transmission gate TGc. Moreover, the other terminals of the transmission gates TGa, TGb and TGc are commonly connected to an output terminal OTN to the switching unit 53.

The transmission gates TGa, TGb and TGc are exclusively turned on, and the driving waveform signal Com-A, Com-B or Com-C selected for the control periods Ts1 and Ts2 are output to the m-th stage output terminal OTN, as the driving signals Vin[m], and supplied to the ejection unit D of the m-th stage through the switching unit 53.

Figure 18:
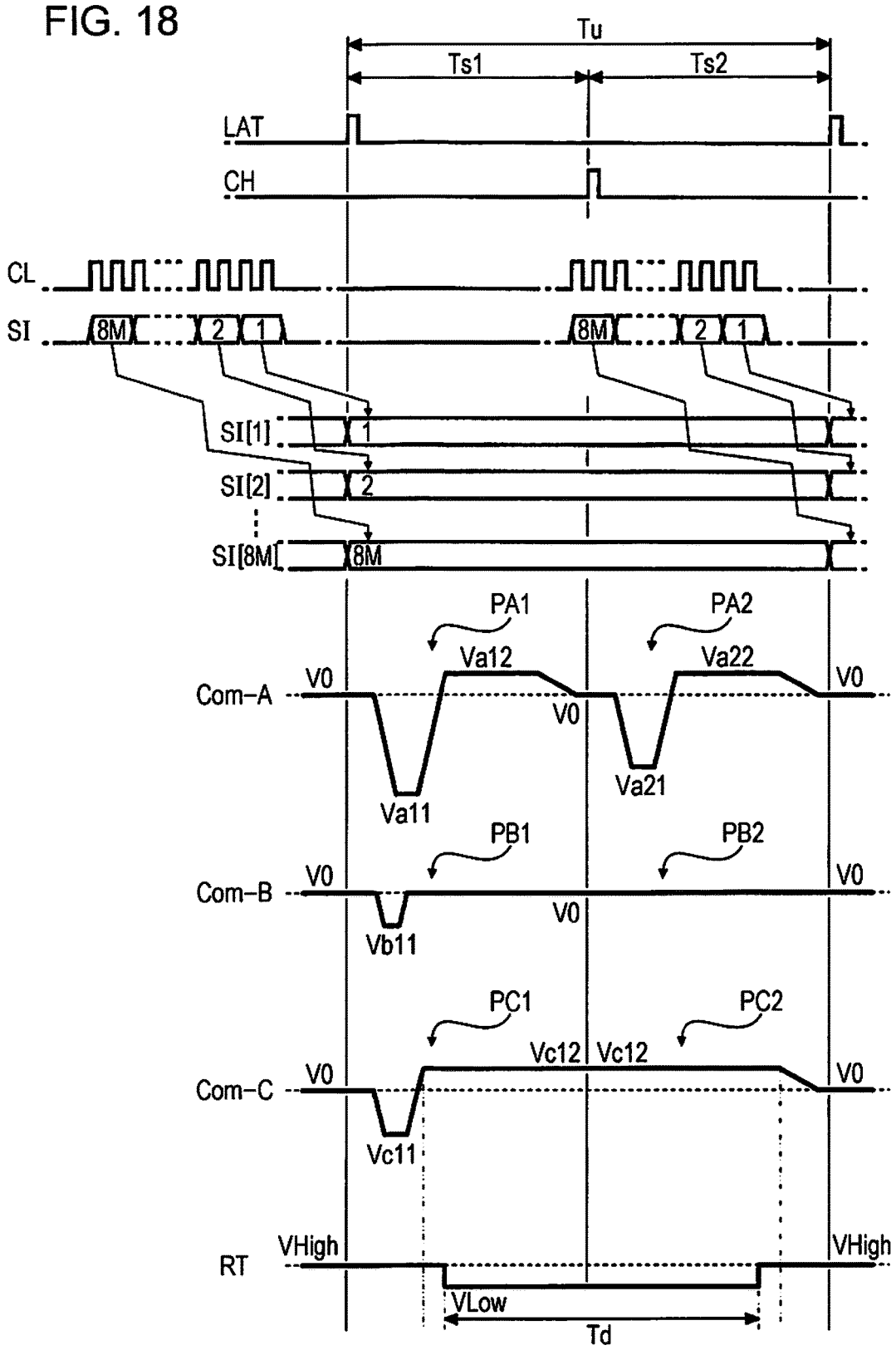
FIG. 18 is a timing chart illustrating an operation of the driving signal generating unit.

FIG. 18 is a timing chart for describing the operation of the driving signal generating unit 51 during the unit operation period Tu. As illustrated in FIG. 18, the unit operation period Tu is a period regulated by the latch signal LAT output from the control unit 6. Moreover, the control periods Ts1 and Ts2 included in the unit operation period Tu are periods regulated by the latch signal LAT and the change signal CH output from the control unit 6.

The driving waveform signal Com-A supplied from the control unit 6 during the unit operation period Tu is a signal for generating the driving signal Vin for printing, and has a waveform that continuously connects a unit waveform PA1 arranged in the control period Ts1 of the unit operation period Tu and a unit waveform PA2 arranged in the control period Ts2 as illustrated in FIG. 18. Potentials at a timing when the unit waveform PA1 and the unit waveform PA2 start and end are both reference potentials V0. Moreover, a potential difference between a minimum potential Va11 and a maximum potential Va12 of the unit waveform PA1 is larger than a potential difference between a minimum potential Va21 and a maximum potential Va22 of the unit waveform PA2. For this reason, the amount of ink ejected from the nozzles N included in the ejection unit D when the piezoelectric elements 300 included in the respective ejection units D are driven by the unit waveform PA1 is larger than the amount of ink ejected when the piezoelectric elements are driven by the unit waveform PA2.

The driving waveform signal Com-B supplied from the control unit 6 during the unit operation period Tu is a signal for generating the driving signal Vin for printing, and has a waveform that continuously connects a unit waveform PB1 arranged in the control period Ts1 and a unit waveform PB2 arranged in the control period Ts2. Potentials at a timing when the unit waveform PB1 starts and ends are both reference potentials V0, and the unit waveform PB2 is maintained at the reference potential V0 over the control period Ts2. Moreover, a potential difference between the minimum potential Vb11 and the maximum potential (reference potential V0 in the example of the figure) of the unit waveform PB1 is smaller than a potential difference between the minimum potential Va21 and the maximum potential Va22 of the unit waveform PA2. In addition, even when the piezoelectric elements 300 included in the respective ejection unit D are driven by the unit waveform PB1, the ink is not ejected from the nozzles N included in the ejection units D. Similarly, even when the unit waveform PB2 is supplied to the piezoelectric elements 300, the ink is not ejected from the nozzles N.

The driving waveform signal Com-C supplied from the control unit 6 during the unit operation period Tu is a signal for generating the driving signal Vin for inspection, and has a waveform that continuously connects a unit waveform PC1 arranged in the control period Ts1 and a unit waveform PC2 arranged in the control period Ts2. The unit waveform PC1 is changed from the reference potential V0 to the minimum potential Vc11, and then changed from the minimum potential Vc11 to the maximum potential Vc12. Thereafter, the potential of the unit waveform PC1 is maintained at the maximum potential Vc12 until the control period Ts1 ends. Moreover, the potential of the unit waveform PC2 is maintained at the maximum potential Vc12, and then changed from the maximum potential Vc12 to the reference potential V0 before the control period Ts2 ends.

In the present embodiment, the potential difference between the minimum potential Vc11 and the maximum potential Vc12 in the unit waveform PC1 is smaller than the potential difference between the minimum potential Va21 and the maximum potential Va22 in the unit waveform PA2, and set to a potential such that the ink is not ejected from the ejection unit D in a case where the ejection unit D is driven by the driving signal Vin for inspection having the unit waveform PC1.

That is, in the present embodiment, the ejection state determining process assumes so-called "non-ejection inspection" in which the ejection state of the ink in the ejection unit D is determined based on the residual vibration generated in the ejection unit D when the ejection unit D is driven such that the ink is not ejected.

As illustrated in FIG. 18, the 8M latch circuits Lt output the printing signals SI[1], SI[2], . . . , and SI[8M] at the timing when the latch signals LAT rise, that is, at the timing when the unit operation period Tu starts.

Further, the m-th stage decoder DC outputs selection signals Sa, Sb, and Sc based on the decoding contents illustrated in FIG. 17 in respective control periods Ts1 and Ts2 according to the printing signal SI[m] as described above.

Moreover, as described above, the transmission gates TGa, TGb and TGc of the m-th stage select any one of the driving waveform signals Com-A, Com-B and Com-C based on the selection signals Sa, Sb, and Sc, and output the selected driving waveform signal Com as the driving signal Vin[m].

Further, a switching period designation signal RT illustrated in FIG. 18 is a signal that regulates a switching period Td. The switching period designation signal RT and the switching period Td will be described below.

A waveform of the driving signal Vin output from the driving signal generating unit 51 during the unit operation period Tu will be described with reference to FIG. 19 in addition to FIGS. 16 to 18.

Since the printing signal SI[m] supplied during the unit operation period Tu indicates (b1, b2, b3)=(1, 1, 0), since the selection signals Sa, Sb and Sc are in a high level H, a low level L, and a low level L during the control period Ts1, the driving waveform signal Com-A is selected by the transmission gate TGa, and the unit waveform PA1 is output as the driving signal Vin[m]. Similarly, during the control period Ts2, the driving waveform signal Com-A is selected, and the unit waveform PA2 is output as the driving signal Vin[m]. Accordingly, in this case, the driving signal Vin[m] supplied to the ejection unit D of the m-th stage during the unit operation period Tu is the driving signal Vin for printing, and as illustrated in FIG. 19, a waveform thereof is a waveform DpAA including the unit waveform PA1 and the unit waveform PA2. As a result, during the unit operation period Tu, the ejection unit D of the m-th stage performs ejection of the medium amount of ink based on the unit waveform PA1 and ejection of the small amount of ink based on the unit waveform PA2, and the inks ejected twice are united on recording paper P, so that a large dot is formed on the recording paper P.

When the content of the printing signal SI[m] supplied during the unit operation period Tu indicates (b1, b2, b3)=(1, 0, 0), since the driving waveform signal Com-A is selected during the control period Ts1 and the driving waveform signal Com-B is selected during the control period Ts2, the driving signal Vin[m] supplied to the ejection unit D of the m-th stage during the unit operation period Tu is the driving signal Vin for printing, and a waveform thereof is a waveform DpAB including the unit waveform PA1 and the unit waveform PB2. As a result, the ejection unit D of the m-th stage performs ejection of the medium amount of ink based on the unit waveform PA1 during the unit operation period Tu, so that a medium dot is formed on the recording paper P.

When the contents of the printing signal SI[m] supplied during the unit operation period Tu indicate (b1, b2, b3)=(0, 1, 0), since the driving waveform signal Com-B is selected in the control period Ts1 and the driving waveform signal Com-A is selected in the control period Ts2, the driving signal Vin[m] supplied to the ejection unit D of the m-th stage in the unit operation period Tu and the waveform thereof is a waveform DpBA including the unit waveform PB1 and the unit waveform PA2. As a result, the ejection unit D of the m-th stage ejects the ink in a small amount based on the unit waveform PA2 in the unit operation period Tu and small dots are formed on the recording paper P.

When the contents of the printing signal SI[m] supplied during the unit operation period Tu indicate (b1, b2, b3)=(0, 0, 0), since the driving waveform signal Com-B is selected in the control period Ts1 and the control period Ts2, the driving signal Vin[m] supplied to the ejection unit D of the m-th stage in the unit operation period Tu and the waveform thereof is a waveform DpBB including the unit waveform PB1 and the unit waveform PB2. As a result, the ink is not ejected from the ejection unit D of the m-th stage in the unit operation period Tu and dots are not formed on the recording paper P (becomes non-recording).

When the contents of the printing signal SI(m) supplied during the unit operation period Tu indicate (b1, b2, b3)=(0, 0, 1), since the driving waveform signal Com-C is selected in the control period Ts1 and the control period Ts2, the driving signal Vin[m] supplied to the ejection unit D of the m-th stage in the unit operation period Tu is a driving signal Vin for inspection and the waveform thereof is a waveform DpT including the unit waveform PC1 and the unit waveform PC2.

Figure 19:
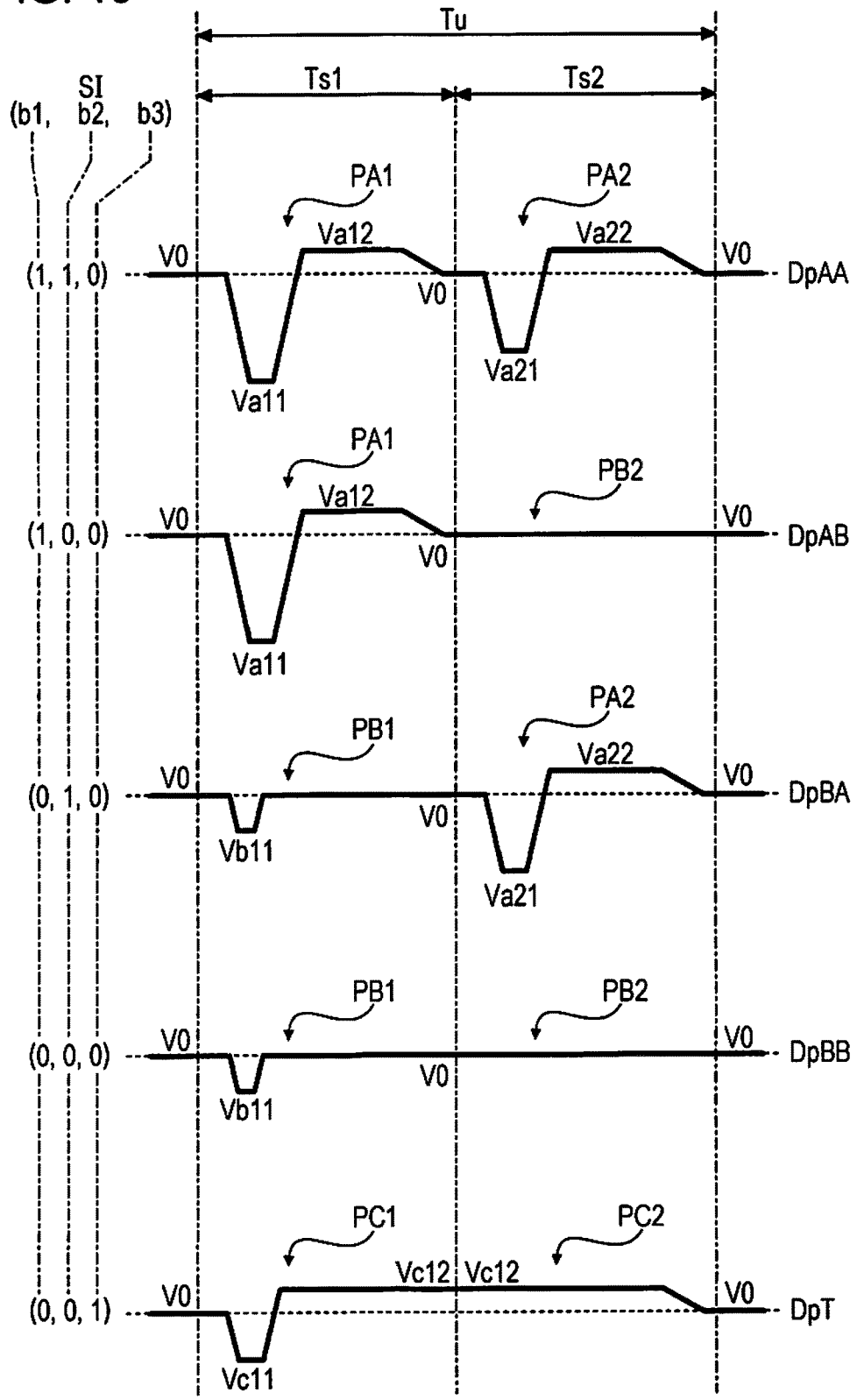
FIG. 19 is a timing chart illustrating a waveform of a driving signal.
Figure 20:
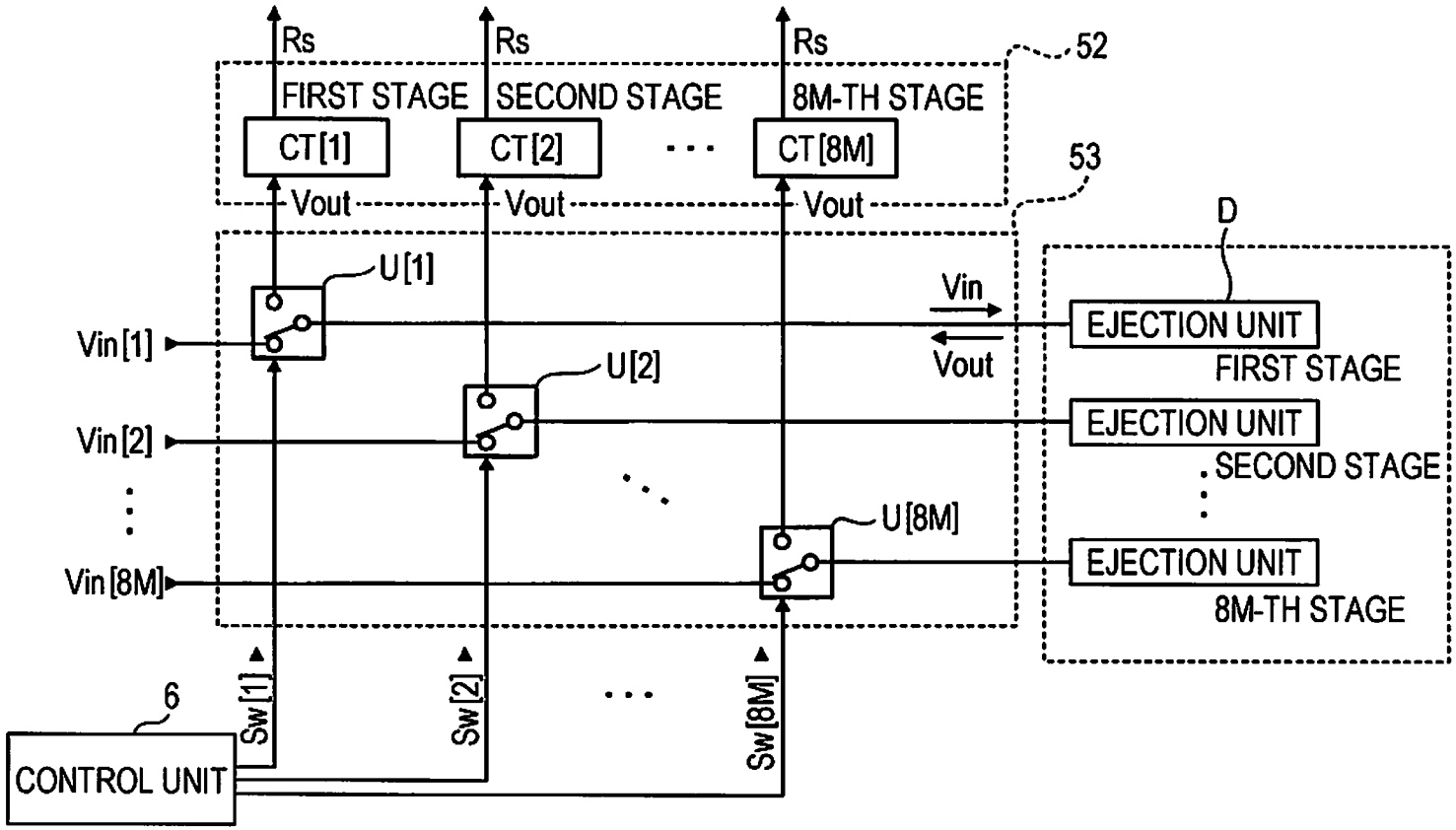
FIG. 20 is a block diagram illustrating a configuration of a switching unit.

FIG. 20 is a block diagram illustrating a configuration of the switching unit 53 of the head driver 50. In FIG. 19, electric connection relations between the switching unit 53, the ejection abnormality detecting unit 52, the ejection unit D, and the driving signal generating unit 51 are illustrated.

As illustrated in FIG. 20, the switching unit 53 includes 8M switching circuits U (U[1], U[2], . . . , and U[8M]) having first to 8M-th stages in one-to-one correspondence with the 8M ejection units D. Moreover, the ejection abnormality detecting unit 52 includes 8M ejection abnormality detection circuits CT (CT[1], CT[2], . . . , and CT[8M]) of the first to 8M-th stages in one-to-one correspondence to the 8M ejection units D.

The switching circuit U[m] of the m-th stage electrically connects the piezoelectric elements 300 of the ejection unit D of the m-th stage to any one of an output terminal OTN of the m-th stage included in the driving signal generating unit 51 and the ejection abnormality detection circuit CT[m] of the m-th stage included in the ejection abnormality detecting unit 52.

In the following description, in the respective switching circuits U, a state where the ejection unit D and the output terminal OTN of the driving signal generating unit 51 are electrically connected is referred to as a first connection state. Moreover, a state where the ejection unit D and the ejection abnormality detection circuit CT of the ejection abnormality detecting unit 52 are electrically connected is referred to as a second connection state.

The control unit 6 outputs the switching control signals Sw for controlling the connection states of the respective switching circuits U to the respective switching circuits U.

Specifically, when the ejection unit D of the m-th stage is used to perform the printing process during the unit operation period Tu, the control unit 6 supplies the switching control signal Sw[m] to the switching circuit U[m] so as to allow the switching circuit U[m] corresponding to the ejection unit D of the m-th stage to maintain the first connection state over the entire period of the unit operation period Tu. For this reason, when the ejection unit D of the m-th stage is used to perform the printing process during the unit operation period Tu, the control unit 6 supplies the driving signal Vin to the ejection unit D from the driving signal generating unit 51 over the entire period of the unit operation period Tu.

Meanwhile, when the ejection unit D of the m-th stage is a target of the ejection state determining process during the unit operation period Tu, the control unit 6 supplies the switching control signal Sw[m] to the switching circuit U[m] so as to allow the switching circuit U[m] corresponding to the ejection unit D of the m-th stage to enter the first connection state during a period other than the switching period Td of the unit operation period Tu and to enter the second connection state during the switching period Td of the unit operation period Tu. For this reason, the driving signal Vin is supplied to the ejection unit D of the m-th stage from the driving signal generating unit 51 during the period other than the switching period Td of the unit operation period Tu, and the residual vibration signal Vout is supplied to the ejection abnormality detection circuit CT[m] from the ejection unit D of the m-th stage during the switching period Td in a case where the ejection unit D of the m-th stage becomes a target of the ejection state determining process during the unit operation period Tu.

Further, as illustrated in FIG. 18, the switching period Td is a period for which the switching period designation signal RT generated by the control unit 6 is set to a potential VLow. Specifically, the switching period Td is a period determined such that a period of the unit operation period Tu becomes a partial or entire period for which the driving waveform signal Com-C (that is, the waveform DpT) maintains the potential Vc12.

The ejection abnormality detection circuit CT detects a change of electromotive force of the piezoelectric elements 300 of the ejection unit D during the switching period Td, as the residual vibration signal Vout.

Figure 21:
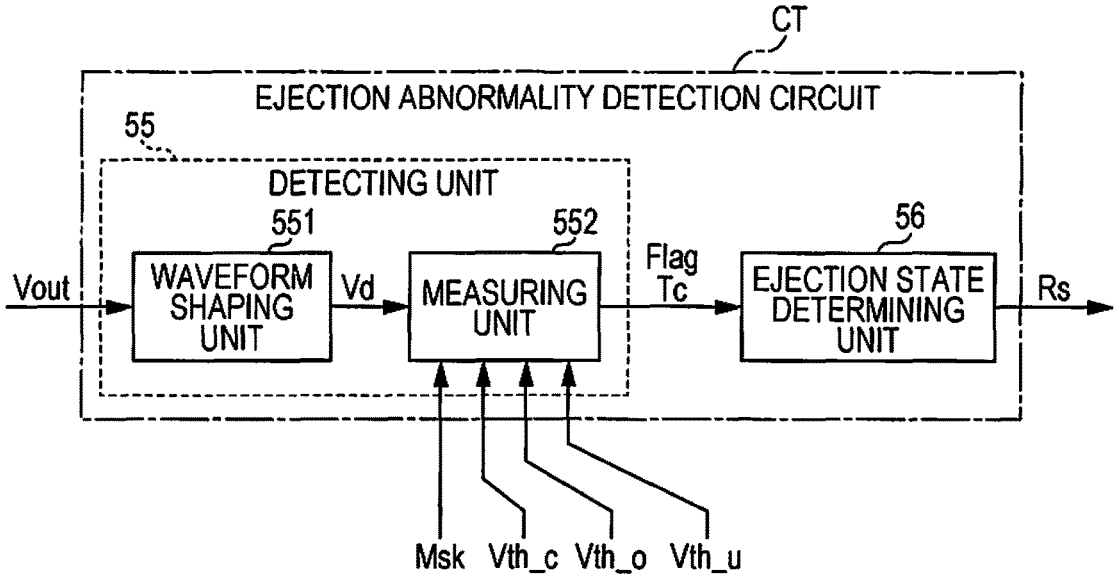
FIG. 21 is a block diagram illustrating a configuration of an ejection abnormality detection circuit.

FIG. 21 is a block diagram illustrating a configuration of the ejection abnormality detection circuit CT included in the ejection abnormality detecting unit 52.

As illustrated in FIG. 21, the ejection abnormality detection circuit CT includes a detecting unit 55 that outputs a detection signal Tc representing a time length corresponding to one cycle of the residual vibration of the ejection unit D based on the residual vibration signal Vout, and an ejection state determining unit 56 that determines the ejection state in the ejection unit D (that is, determines the presence of the ejection abnormality, and determine the causes of the ejection abnormality when the ejection abnormality is present) to output a determination result signal Rs representing the determination result.

The detecting unit 55 includes a waveform shaping unit 551 that generates a shaping waveform signal Vd obtained by removing a noise component or the like from the residual vibration signal Vout output from the ejection unit D, and a measuring unit 552 that generates the detection signal Tc based on the shaping waveform signal Vd.

The waveform shaping unit 551 includes a high-pass filter for outputting a signal in which a low-band frequency component lower than a frequency bandwidth of the residual vibration signal Vout is damped, and a low-pass filter for outputting a signal in which a high-band frequency component is higher than the frequency band of the residual vibration signal Vout, and a configuration capable of outputting the shaping waveform signal Vd from which the noise component is removed by limiting a frequency range of the residual vibration signal Vout. Moreover, the waveform shaping unit 551 may include a negative feedback type amplifier for adjusting the amplitude of the residual vibration signal Vout and a voltage follower for converting an impedance of the residual vibration signal Vout to output the shaping waveform signal Vd of a low impedance.

The shaping waveform signal Vd obtained by shaping the residual vibration signal Vout in the waveform shaping unit 551, a mask signal Msk generated by the control unit 6, a threshold potential Vth_c determined as a potential of an amplitude center level of the shaping waveform signal Vd, a threshold potential Vth_o determined as a high potential higher than the threshold potential Vth_c, and a threshold potential Vth_u determined as a low potential lower than the threshold potential Vth_c are supplied to the measuring unit 552. The measuring unit 552 outputs the detection signal Tc and an effective flag Flag indicating whether the detection signal Tc is an effective value based on these signals.

Figure 22:
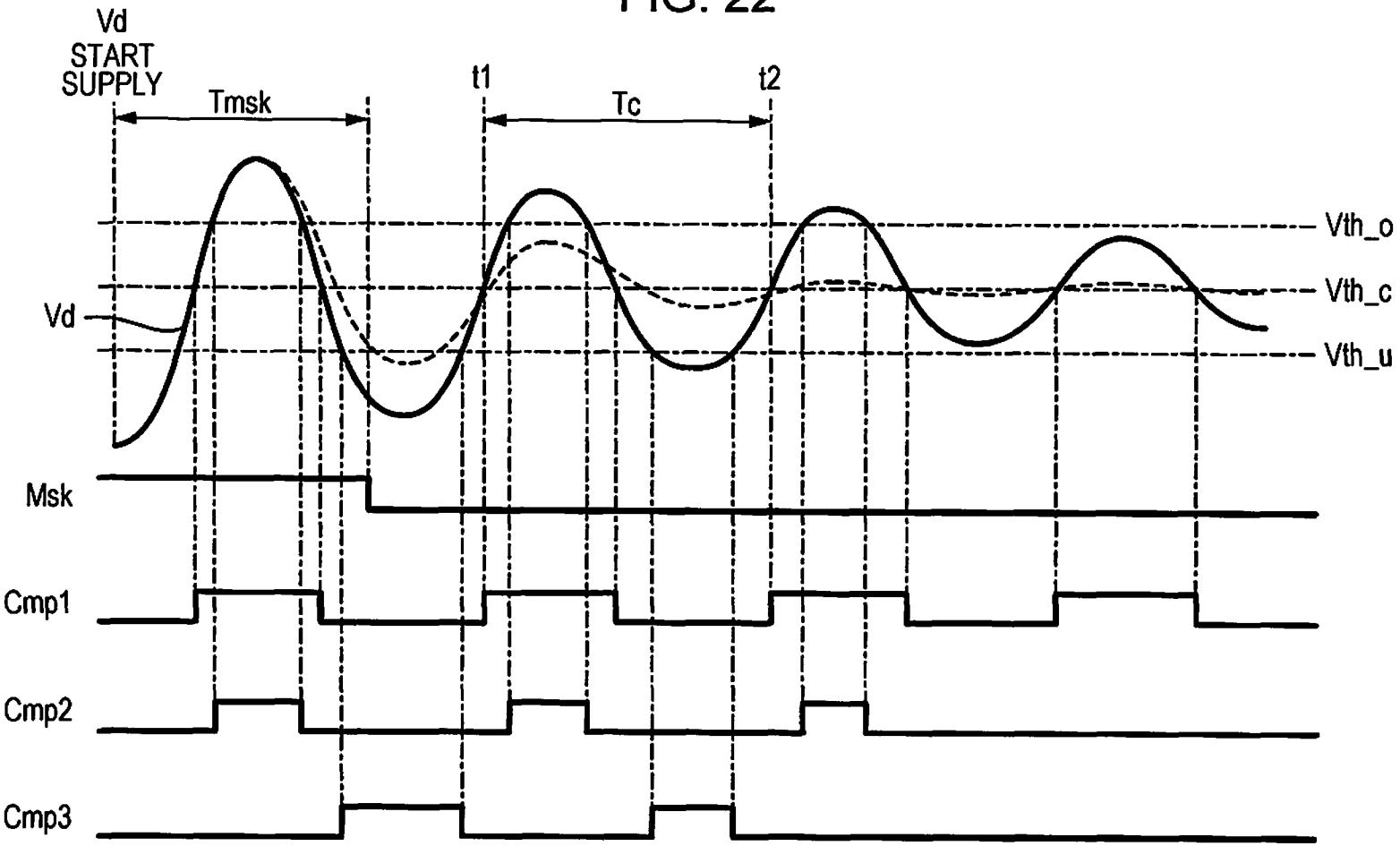
FIG. 22 is a timing chart illustrating an operation of the ejection abnormality detection circuit.

FIG. 22 is a timing chart illustrating an operation of the measuring unit 552.

As illustrated in the figure, the measuring unit 552 compares a potential indicated by the shaping waveform signal Vd with the threshold potential Vth_c, and generates a comparison signal Cmp1 which is in a high level when the potential indicated by the shaping waveform signal Vd is equal to or more than the threshold potential Vth_c and is in a low level when the potential indicated by the shaping waveform signal Vd is less than the threshold potential Vth-c.

Moreover, the measuring unit 552 compares the potential indicated by the shaping waveform signal Vd with the threshold potential Vth_o, and generates a comparison signal Cmp2 which is in a high level when the potential indicated by the shaping waveform signal Vd is equal to or more than the threshold potential Vth_o and is in a low level when the potential indicated by the shaping waveform signal Vd is less than the threshold potential Vth_o.

Moreover, the measuring unit 552 compares the potential indicated by the shaping waveform signal Vd with the threshold potential Vth_u, and generates a comparison signal Cmp3 which is in a high level when the potential indicated by the shaping waveform signal Vd is less than the threshold potential Vth_u and is in a low level when the potential indicated by the shaping waveform signal Vd is equal to or more than the threshold potential Vth_u.

The mask signal Msk is a signal which is in a high level only during a predetermined period Tmsk after the supply of the shaping waveform signal Vd from the waveform shaping unit 551 is started. In the present embodiment, it is possible to obtain a high-accuracy detection signal Tc from which the superimposed noise components are removed immediately after the residual vibration starts by generating the detection signal Tc with only the shaping waveform signal Vd after the period Tmsk elapses as a target among the shaping waveform signals Vd.

The measuring unit 552 includes a counter (not illustrated). After the mask signal Msk falls to a low level, the counter starts to count the clock signal (not illustrated) at a time t1 which is a timing when the potential indicated by the shaping waveform signal Vd becomes equivalent to the threshold potential Vth_c for the first time. That is, after the mask signal Msk falls to the low level, the counter starts to count at a time t1 which is an earlier timing between a timing when the comparison signal Cmp1 rises to a high level for the first time and a timing when the comparison signal Cmp1 falls to a low level for the first time.

In addition, after the counter starts counting, the counter stops counting the clock signal at a time t2 which is a timing when the potential indicated by the shaping waveform signal Vd becomes the threshold potential Vth_c for the second time, and outputs the obtained count value as the detection signal Tc. That is, after the mask signal Msk falls to the low level, the counter stops counting at a time t2 which is an earlier timing between a timing when the comparison signal Cmp1 rises to a high level for the second time and a timing when the comparison signal Cmp1 falls to a low level for the second time. In this manner, the measuring unit 552 generates the detection signal Tc by measuring a time length from the time t1 to the time t2 as a time length corresponding to one cycle of the shaping waveform signal Vd.

In addition, when the amplitude of the shaping waveform signal Vd is small as indicated by a dashed line in FIG. 22, the possibility that the detection signal Tc cannot be accurately measured becomes high. Moreover, when the amplitude of the shaping waveform signal Vd is small, even when it is determined that the ejection state of the ejection unit D is normal based on only the result of the detection signal Tc, it is likely that the ejection abnormality may occur. For example, when the amplitude of the shaping waveform signal Vd is small, it is considered that the ink cannot be ejected because the ink is not injected into the cavity 320.

Here, in the present embodiment, it is determined whether the amplitude of the shaping waveform signal Vd has a magnitude sufficient to measure the detection signal Tc to output the determination result as the effective flag Flag.

Specifically, the measuring unit 552 outputs the effective flag Flag by setting a value of the effective flag Flag to a value "1" indicating that the detection signal Tc is effective when the potential indicated by the shaping waveform signal Vd is more than the threshold potential Vth_o and is less than the threshold potential Vth_u and by setting the value of the effective flag to "0" in other cases during the period for which the counting is performed by the counter, that is, the period from the time t1 to the time t2. More specifically, the measuring unit 552 sets the value of the effective flag Flag to "1" when the comparison signal Cmp2 rises to the high level from the low level and then falls to the low level again and the compassion signal Cmp3 rises to the high level from the low level and then falls to the low level again during the period from the time t1 to the time t2, and sets the value of the effective flag Flag to "0."

In the present embodiment, since the measuring unit 552 determines whether the shaping waveform signal Vd has the amplitude of magnitude sufficient to measure the detection signal Tc in addition to generating the detection signal Tc indicating the time length corresponding to the one cycle of the shaping waveform signal Vd, it is possible to more accurately detect the ejection abnormality.

The ejection state determining unit 56 determines the ejection state of the ink in the ejection unit D based on the detection signal Tc and the effective flag Flag, and outputs the determination result as the determination result signal Rs.

FIG. 23 is an explanatory diagram for describing the contents of determination of the ejection state determining unit 56. As illustrated in the figure, the ejection state determining unit 56 compares the time length indicated by the detection signal Tc with three threshold values (alternatively, any threshold value among these three threshold values) of a threshold value Tth1, a threshold value Tth2 representing a time length longer than the threshold value Tth1, and a threshold value Tth3 representing a time length longer than the threshold value Tth2.

Here, the threshold value Tth1 is a value for indicating a boundary between a time length corresponding to one cycle of the residual vibration when bubbles are generated in the cavity 320 so that the frequency of the residual vibration increases and a time length corresponding to one cycle of the residual vibration when the ejection state is normal.

Moreover, the threshold value Tth2 is a value for indicating a boundary between a time length corresponding to one cycle of the residual vibration when paper dust is adhered to the vicinity of the outlet of the nozzle N so that the frequency of the residual vibration decreases and a time length corresponding to one cycle of the residual vibration when the ejection state is normal.

Moreover, the threshold value Tth3 is a value for indicating a boundary between a time length corresponding to one cycle of the residual vibration when the frequency of the residual vibration becomes further smaller than that when paper dust is adhered due to fixation or thickening of the ink in the vicinity of the nozzle N and a time length corresponding to one cycle of the residual vibration when paper dust is adhered to the vicinity of the outlet of the nozzle N.

As illustrated in FIG. 23, when the value of the effective flag Flag is "1" and satisfies "$TTH1 \leq Tc \leq TTH2$," the ejection state determining unit 56 determines that the ejection state of the ink in the ejection unit D is normal, and sets the determination result signal Rs to a value "1" indicating that the ejection state is normal.

Moreover, when the value of the effective flag Flag is "1" and satisfies "$Tc < TTH1$," the ejection state determining unit 56 determines that the ejection abnormality occurs due to bubbles generated in the cavity 320, and sets the determination result signal Rs to a value "2" indicating that the ejection abnormality occurs due to the bubbles.

Moreover, when the value of the effective flag Flag is "1" and satisfies "$TTH2 < Tc \leq TTH3$," the ejection state determining unit 56 determines that the ejection abnormality occurs due to paper dust adhered to the vicinity of the outlet of the nozzle N, and sets the determination result signal Rs to a value "3" indicating that the ejection abnormality occurs due to the paper dust.

Moreover, when the value of the effective flag Flag is "1" and satisfies "TTH3<Tc," the ejection state determining unit 56 determines that the ejection abnormality occurs due to thickening of the ink in the vicinity of the nozzles N, and sets the determination result signal Rs to a value "4" indicating that the ejection abnormality occurs due to the thickening of the ink.

Moreover, when the value of the effective flag Flag is "0," the ejection state determining unit 56 sets the determination result signal Rs to a value "5" indicating that the ejection abnormality occurs due to some causes such as non-injection of the ink to the determination result signal Rs.

As described above, the ejection state determining unit 56 determines the ejection state in the ejection unit D, and outputs the determination result as the determination result signal Rs. For this reason, the control unit 6 can grasp the ejection unit D in which ejection abnormality occurs, from among 8M ejection units D based on the determination result signal Rs.

The control unit 6 stores the determination result signal Rs output by the ejection state determining unit 56 in the storage unit 62 in correspondence with information (for example, the number of stages) for recognizing the ejection unit D corresponding to the determination result signal Rs.

In addition, although the details will be described below, the control unit 6 controls the operation of the ink jet printer 1 such that the printing process is stopped and the maintenance process is performed or controls the operation of the ink jet printer 1 such that the printing process is continued and the complementing process is performed in the case where ejection abnormality occurs. In this manner, in the ink jet printer 1 according to the present embodiment, it is possible to minimize a decrease in the print quality caused by ejection abnormality.

4. Complementing Process

Next, the complementing process will be described in detail.

As described above, the control unit 6 controls execution of the complementing process that complements one ejection unit D with another ejection unit D in the case where ejection abnormality occurs in the one ejection unit D (in the case where the ejection state of an ink becomes abnormal).

According to the present embodiment, the ink jet printer 1 is capable of performing the complementing process using a plurality of complementation modes. In addition, the control unit 6 selects the complementation mode from among the plurality of complementation modes and controls execution of the complementing process with respect to one ejection unit D using the selected complementation mode in the case where ejection abnormality occurs in the one ejection unit D.

More specifically, the ink jet printer 1 is capable of performing the complementing process using a same-array nozzle complementation mode (an example of the "first complementation mode"), a different-color nozzle complementation mode (an example of the "second complementation mode"), and a same-color and different-array nozzle complementation mode (an example of the "third complementation mode"). Further, the control unit 6 selects one complementation mode suitable for complementation of one ejection unit D from among the same-array nozzle complementation mode, the different-color nozzle complementation mode, and the same-color and different-array nozzle complementation mode according to the kind of the printing mode and the position of the nozzle N included in one ejection unit D and controls execution of the complementing process with respect to one ejection unit D in the case where ejection abnormality occurs in the one ejection unit D.

Hereinafter, three complementation modes of the ink jet printer 1 will be described with reference to FIGS. 24 to 27.

Figure 24:
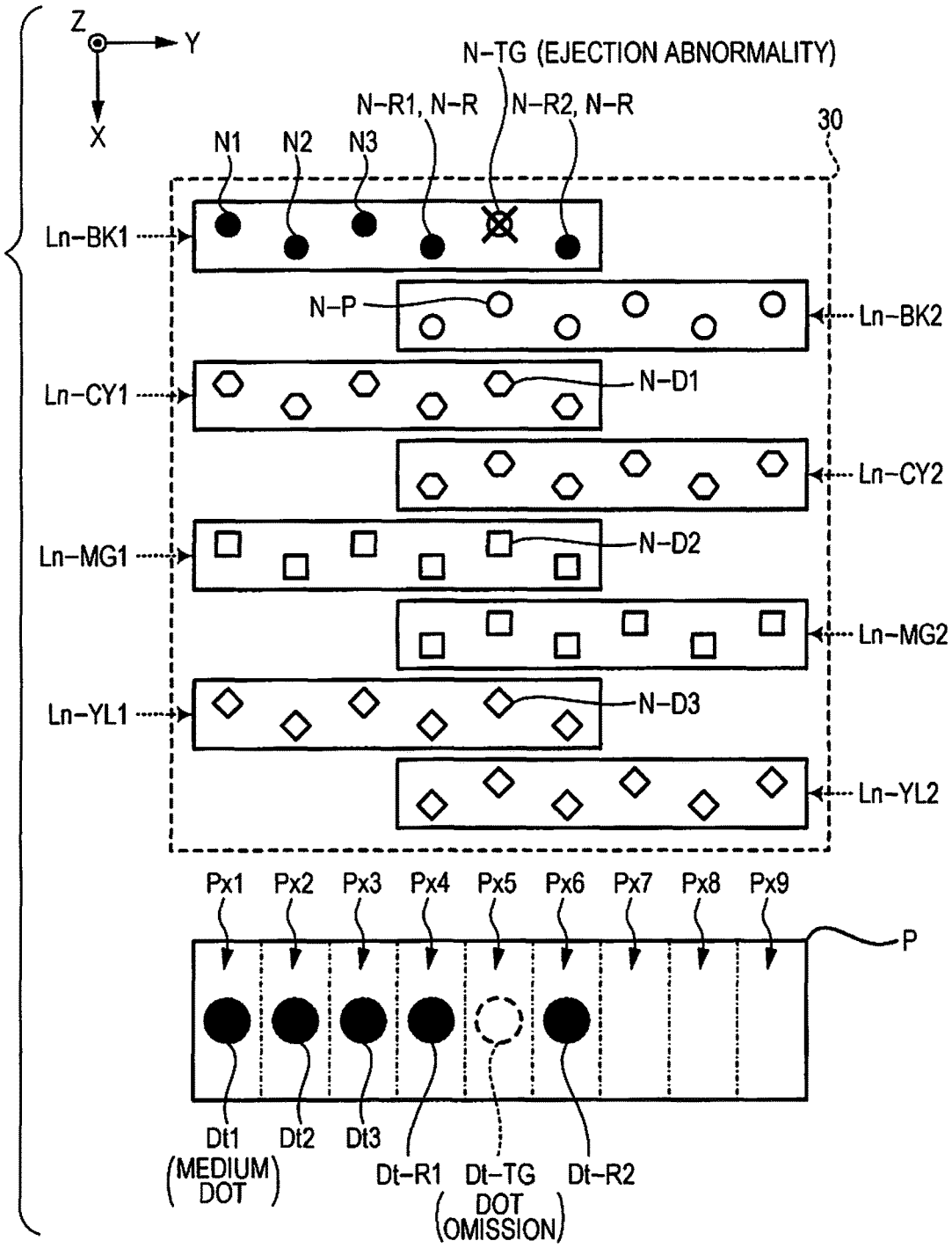
FIG. 24 is an explanatory diagram for describing ejection abnormality in the ejection unit that includes a nozzle.
Figure 25:
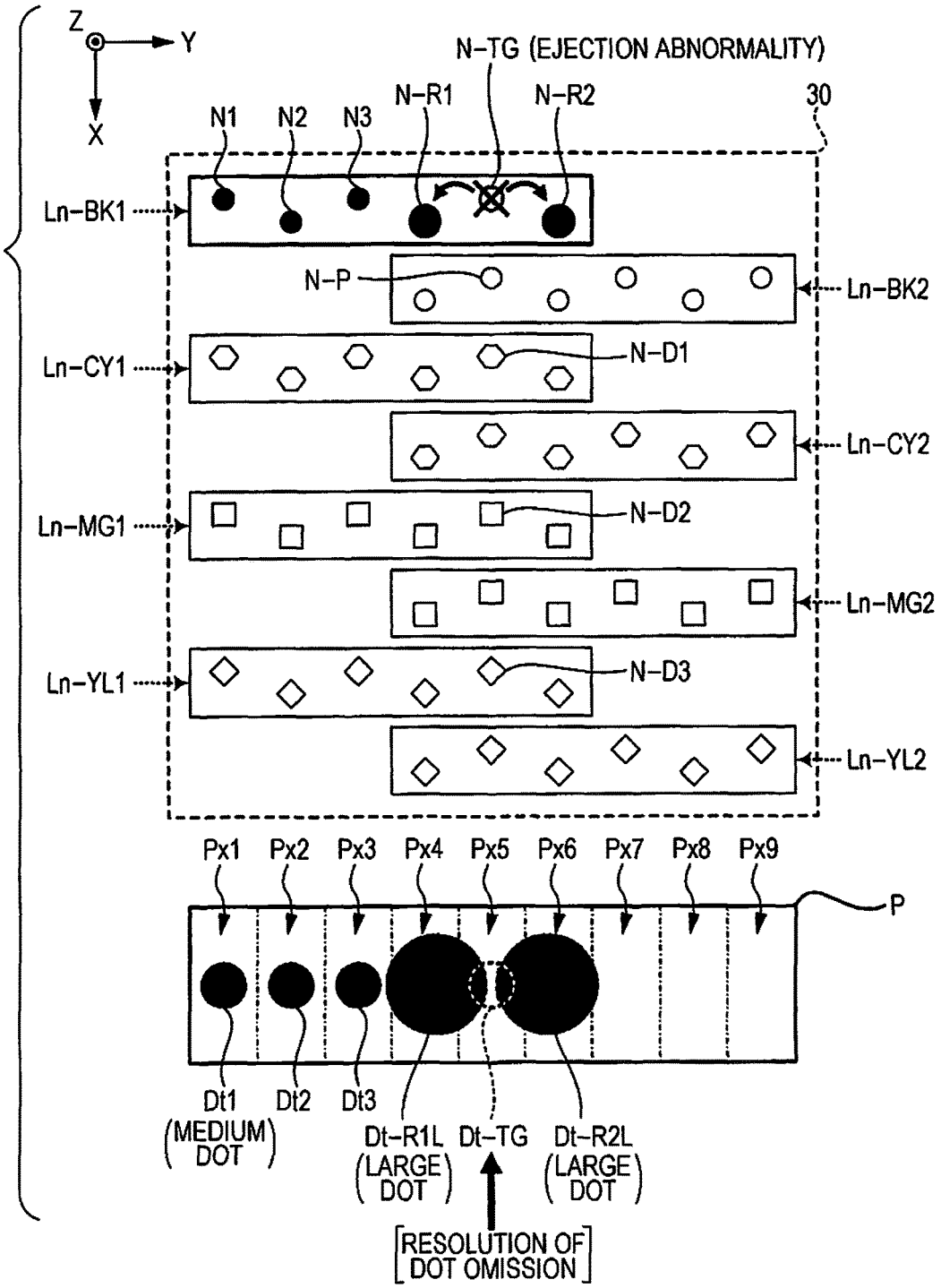
FIG. 25 is an explanatory diagram for describing a complementing process using a same-array nozzle complementation mode.
Figure 26:
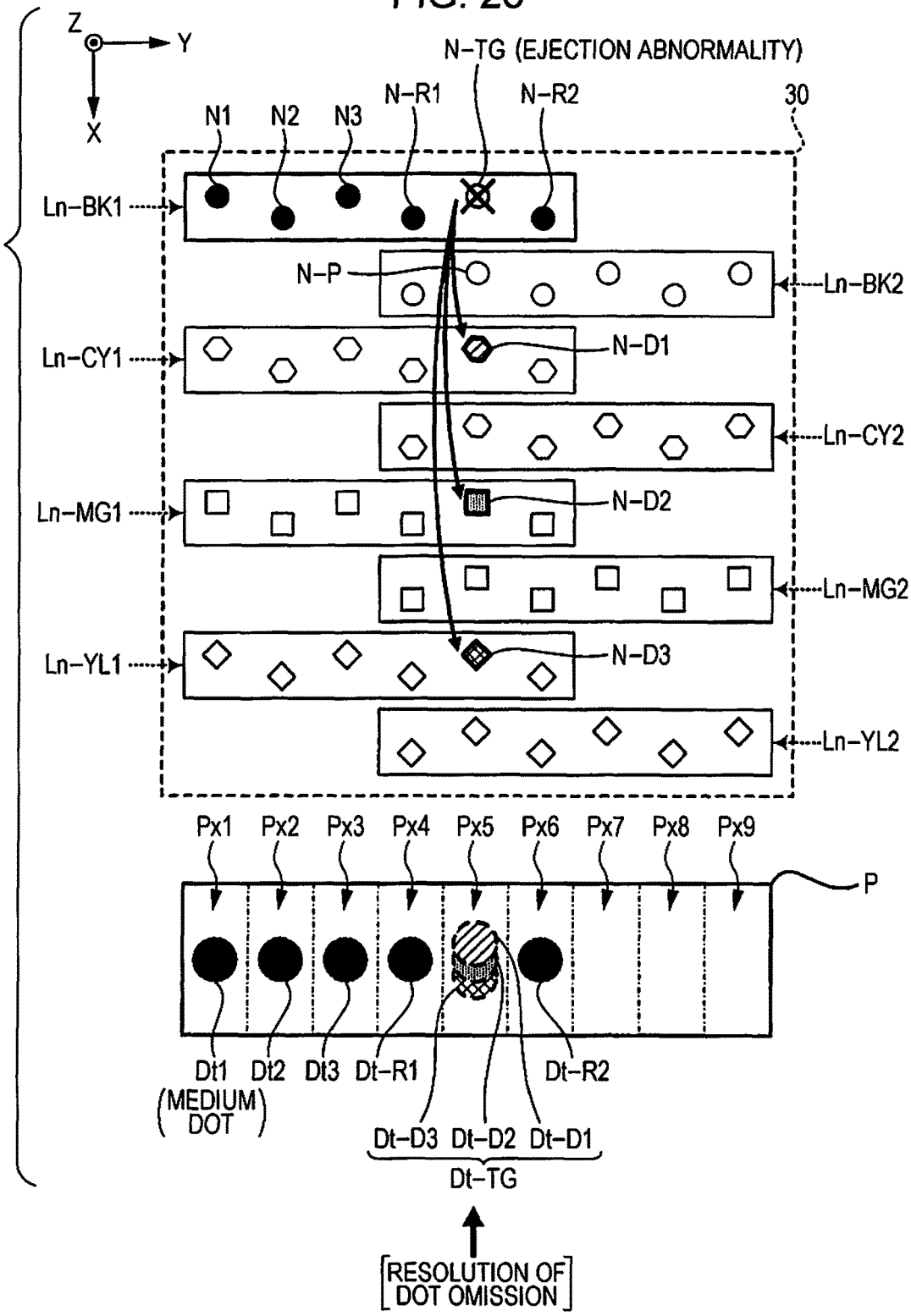
FIG. 26 is an explanatory diagram for describing the complementing process using a different-color nozzle complementation mode.
Figure 27:
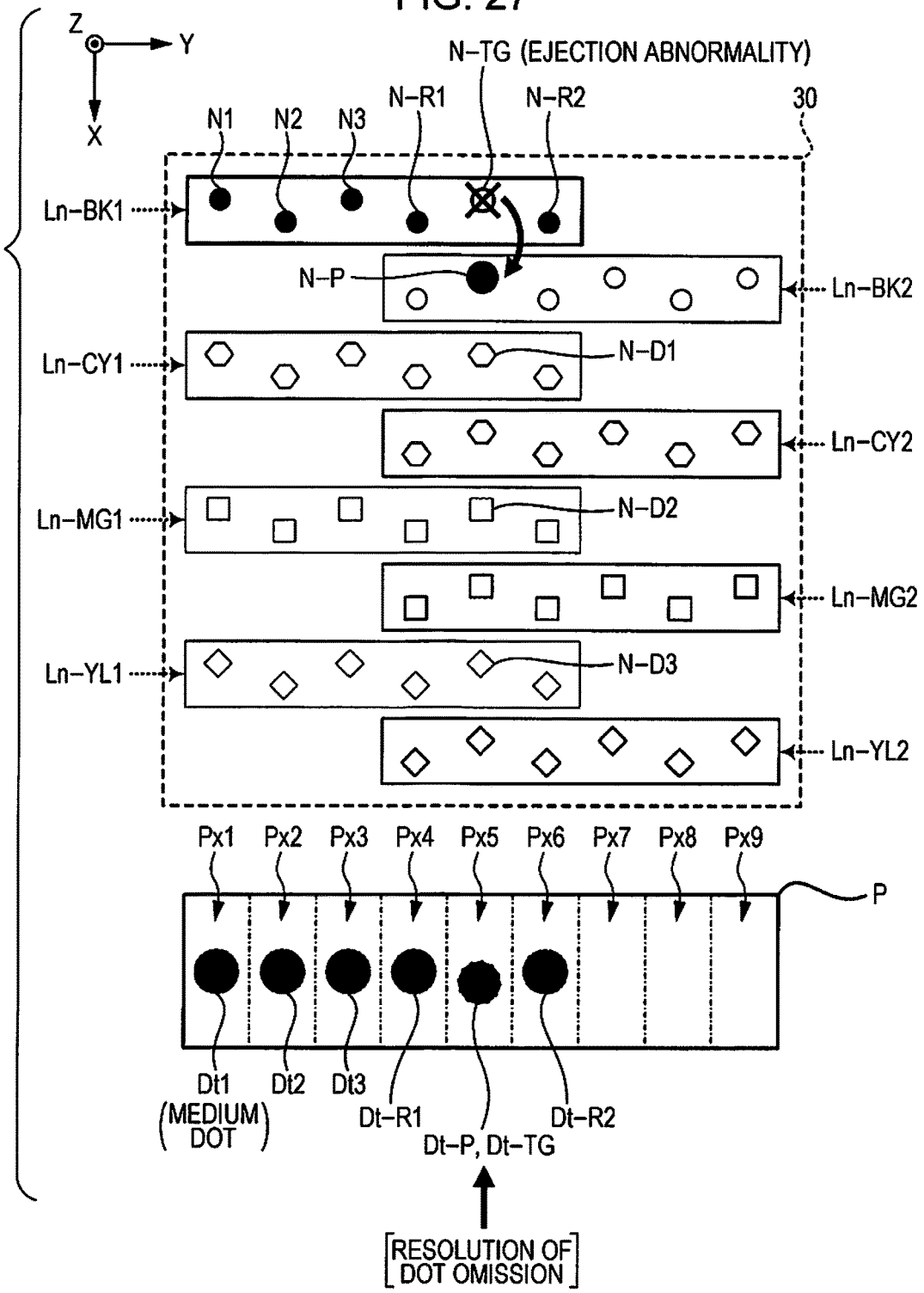
FIG. 27 is an explanatory diagram for describing the complementing process using a same-color and different-array nozzle complementation mode.

FIG. 24 is an explanatory diagram illustrating a case where ejection abnormality occurs. As illustrated in FIG. 24, the nozzle N included in the ejection unit D in which ejection abnormality occurs is referred to as an ejection abnormality nozzle N-TG (or simply a "nozzle N-TG"). In addition, FIGS. 25 to 27 are explanatory diagrams for describing complementing processes using respective complementation modes which can be performed by the ink jet printer 1 in the case where ejection abnormality of FIG. 24 occurs.

In addition, in FIGS. 24 to 27, the description will be made with the assumption that each of the eight nozzle arrays Ln (Ln-BK1 to Ln-YL2) includes six nozzles N (that is, M is 6) and overlapping nozzles positioned in the overlapping areas are three in each nozzle array Ln.

Further, in FIGS. 24 to 27, a case where the nozzle N-TG belongs to the nozzle array Ln-BK1 is assumed as an example. More specifically, in the example of FIG. 24, in a case where medium dots (Dt1, Dt2, Dt3, Dt-R1, Dt-TG, and Dt-R2) are formed in each of pixel Px1 to Px6 on the recording paper P by ejecting a medium amount of ink from each of six nozzles N (N1, N2, N3, N-R1, N-TG, and N-R2) belonging to the nozzle array Ln-BK1, a case where the dot Dt-TG is not recorded in the pixel Px5 due to the occurrence of ejection abnormality in the ejection unit D having the nozzle N-TG and thus dot omission occurs is assumed.

4.1. Same-Array Nozzle Complementation Mode

FIG. 25 illustrates a case where the complementing process is performed with respect to the nozzle N-TG using the same-array nozzle complementation mode when the ejection abnormality of FIG. 24 occurs.

As illustrated in FIG. 25, in the complementing process using the same-array nozzle complementation mode, in a case where ejection abnormality occurs in the ejection unit D having the nozzle N-TG and the dot Dt-TG cannot be formed in the pixel Px5 by ejecting an ink from the nozzle N-TG, the nozzle N-TG is complemented by increasing the amount of the ink ejected from at least one nozzle N other than the nozzle N-TG among nozzles N belonging to the same nozzle array Ln as the nozzle N-TG instead of ejecting the ink from the nozzle N-TG.

Hereinafter, in the same-array nozzle complementation mode, one or more nozzles N complemented with the nozzle N-TG are referred to as same-array complementation nozzles N-R (or simply "nozzles N-R").

In the same-array nozzle complementation mode, the control unit 6 controls execution of the complementing process by setting the value of the printing signal SI[m] corresponding to the ejection unit D having the nozzle N-TG to the value "(b1, b2, b3)=(0, 0, 0)" corresponding to "non-recording," and changing the value of the printing signal SI[m] corresponding to the ejection unit D having the nozzle N-R to a value such that the amount of the ink ejected from the nozzle N-R is increased compared to the case where the complementation is not performed.

In the example of FIG. 25, a case where two nozzles N adjacent to the nozzle N-TG in the Y axis direction are employed as the nozzles N-R is exemplified. More specifically, in the example of FIG. 25, the nozzles N-R1 and N-R2 are employed as the nozzles N-R.

As illustrated in FIG. 24, it is expected that the medium amount of ink is ejected from the nozzles N-R1 and N-R2 and the dots Dt-R1 and Dt-R2 which are medium dots are formed when the complementing process is not performed. That is, it is expected that the value of the printing signal SI[m] corresponding to the ejection unit D having the nozzle N-R1 and the value of the printing signal SI[m] corresponding to the ejection unit D having the nozzle N-R2 become the value "(b1, b2, b3)=(1, 0, 0)" corresponding to "medium dots" when the complementing process is not performed.

Meanwhile, as illustrated in FIG. 25, in a case where the nozzles N-R1 and NR2 are employed as the nozzles N-R and the complementing process is performed using the same-array nozzle complementation mode, a large amount of ink is ejected from the nozzles N-R1 and N-R2 more than the case illustrated in FIG. 24. For example, in the case where the complementing process is performed using the same-array nozzle complementation mode, both of the value of the printing signal SI[m] corresponding to the ejection unit D having the nozzle N-R1 and the value of the printing signal SI[m] corresponding to the ejection unit D having the nozzle N-R2 are changed into a value of (b1, b2, b3)=(1, 1, 0) corresponding to "large dots." As a result, large-sized dots Dt-R1L and Dt-R2L are formed by an ink ejected from the nozzles N-R1 and N-R2.

In a case where dots Dt-R1L and Dt-R2L which are large dots as illustrated in FIG. 25 are formed, the possibility that the user of the printing system 100 recognizes that the dot Dt-TG is formed even when the dot Dt-TG is not actually formed becomes higher compared to a case where dots Dt-R1 and Dt-R2 which are medium dots as illustrated in FIG. 24 are formed. In this case, when the dot Dt-TG is not formed, this can prevent the user from recognizing the unformed dot as "dot omission." That is, even when ejection abnormality occurs, it is possible to minimize the extent of a decrease in the image quality of an image to be formed on the recording paper P in the printing process by performing the complimenting process using the same-array nozzle complementation mode compared to the case where the complementing process is not performed.

Hereinafter, in the same-array nozzle complementation mode, the complementation mode that complements the nozzle N-TG with two nozzles N (nozzles N-R1 and N-R2) adjacent to the nozzle N-TG in the Y axis direction as illustrated in FIG. 25 is particularly referred to as an "adjacent nozzle complementation mode." That is, the same-array nozzle complementation node is a complementation mode including the adjacent nozzle complementation mode.

Further, in the adjacent nozzle complementation mode, two nozzles N adjacent to the nozzle N-TG in the Y axis direction are employed as the nozzle N-R, but only one nozzle N may be employed as the nozzle N-R or a nozzle N which is not adjacent to the nozzle N-TG in the Y axis direction may be employed in the same-array nozzle complementation mode.

In conclusion, in the same-array nozzle complementation mode, the same-array complementation nozzle N-R is a nozzle N belonging to the same nozzle array Ln as the nozzle N-TG as described above and may be one or more nozzles N other than the nozzle N-TG.

In this case, the nozzle N-R is a nozzle N for forming a dot instead of the dot Dt-TG to be formed by an ink ejected from the nozzle N-TG when the ejection abnormality occurs in the ejection unit D having the nozzle N-TG. For this reason, it is preferable that the nozzle N-R is a nozzle N present in the vicinity of the nozzle N-TG to the extent that the user of the printing system 100 can recognize that the dot Dt-TG which is expected to be formed by ejecting an ink from the nozzle N-TG is formed when the amount of the ink to be ejected from the nozzle N-R is increased.

For example, it is preferable that the nozzle N-R is an adjacent nozzle which is adjacent to the nozzle N-TG in the Y axis direction or a nozzle N adjacent to the adjacent nozzle in the Y axis direction.

Further, in the same-array nozzle complementation mode described above, the unit operation period Tu for which an ink is expected to be ejected from the nozzle N-TG and the unit operation period Tu for which an ink is ejected from the nozzle N-R instead of the nozzle N-TG are the same unit operation periods Tu. 4.2. Different-color nozzle complementation mode FIG. 26 illustrates a case where the complementing process is performed with respect to the nozzle N-TG using the different-color nozzle complementation mode when ejection abnormality exemplified in FIG. 24 occurs.

As illustrated in FIG. 26, in the complementing process using the different-color nozzle complementation mode, in a case where ejection abnormality occurs in the ejection unit D having the nozzle N-TG and the dot Dt-TG cannot be formed in the pixel Px5 by ejecting an ink from the nozzle N-TG, the nozzle N-TG is complemented by increasing the amount of the ink ejected from at least one nozzle N ejecting an ink having a different color from that of the nozzle N-TG instead of ejecting an ink from the nozzle N-TG.

Hereinafter, in the different-color nozzle complementation mode, one or more nozzles N complemented with the nozzle N-TG are referred to as different-color complementation nozzles N-D (or simply "nozzles N-D").

In the different-color nozzle complementation mode, the control unit 6 controls execution of the complementing process by setting the value of the printing signal SI[m] corresponding to the ejection unit D having the nozzle N-TG to the value (b1, b2, b3)=(0, 0, 0) corresponding to "non-recording," and changing the value of the printing signal SI[m] corresponding to the ejection unit D having the nozzle N-D to a value such that the amount of the ink ejected from the nozzle N-D is increased compared to the case where the complementation is not performed.

In the example of FIG. 26, a case where three nozzles N positioned approximately the same as that of the nozzle N-TG in the Y axis direction are employed as nozzles N-D is exemplified. More specifically, in the example in FIG. 26, a nozzle N-D1 belonging to the nozzle array Ln-CY1, a nozzle N-D2 belonging to the nozzle array Ln-MG1, and a nozzle N-D3 belonging to the nozzle array Ln-YL1 are employed as nozzles N-D.

In the example of FIG. 24, a case where an ink is not ejected from the nozzles N-D1, N-D2, and N-D3 when the complementing process is not performed is assumed. That is, the value of the printing signal SI[m] corresponding to the ejection unit D having the nozzle N-D is a value of (b1, b2, b3)=(0, 0, 0) corresponding to "non-recording" when the complementing process is not performed.

Meanwhile, as illustrated in FIG. 26, in a case where the complementing process is performed using the different-color nozzle complementation mode by employing the nozzles N-D1, N-D2, and N-D3 as the nozzle N-D, for example, a medium amount of ink is ejected from the nozzles N-D1, N-D2, and N-D3. That is, in a case where the complementing process is performed using the different-color nozzle complementation mode, the value of the printing signal SI[m] corresponding to the ejection unit D having the nozzle N-D is changed into a value of (b1, b2, b3)=(1, 0, 0) corresponding to a "medium dot". As a result, dots Dt-D1, Dt-D2, and Dt-D3 which are medium dots are formed in the pixel Px5 by an ink ejected from the nozzles N-D1, N-D2, and N-D3.

In a case where a cyan (CY) dot Dt-D1, a magenta (MG) dot Dt-D2, and a yellow (YL) dot Dt-D3 are formed in the pixel Px5, the possibility that the user of the printing system 100 recognizes that a black (BK) dot Dt-TG is formed even when the black (BK) dot Dt-TG is not actually formed becomes higher. For this reason, when the dot Dt-TG is not formed, this can prevents the user from recognizing the unformed dot as "dot omission." As a result, even when ejection abnormality occurs, it is possible to minimize the extent of a decrease in the image quality of an image to be formed on the recording paper P in the printing process by performing the complimenting process using the different-color nozzle complementation mode compared to the case where the complementing process is not performed.

Hereinafter, in the different-color nozzle complementation mode, as illustrated in FIG. 26, a mode in which the nozzle N-TG is a nozzle N ejecting a black (BK) ink and three nozzles N of a nozzle N ejecting a cyan (CY) ink, a nozzle N ejecting a magenta (MG) ink, and a nozzle N ejecting a yellow (YL) ink are employed as the different-color complementation nozzle N-D is referred to as a "composite complementation mode." That is, the different-color nozzle complementation mode is a complementation mode having a composite complementation mode.

In addition, in the composite complementation mode, three nozzles N in one-to-one correspondence with cyan (CY), magenta (MG), and yellow (YL) are employed as the nozzle N-D, but it is not limited to the case of employing three nozzles N as the nozzle N-D in the different-color nozzle complementation mode and one or more nozzles N may be employed.

Further, in the composite complementation mode, the nozzle N-TG is a nozzle N corresponding to black (BK), but the nozzle N-TG is not limited to the nozzle N corresponding to black (BK) and may be a nozzle N corresponding to cyan (CY), a nozzle N corresponding to magenta (MG), or a nozzle N corresponding to yellow (YL) in the different-color nozzle complementation mode.

In conclusion, in the different-color nozzle complementation mode, the different-color complementation nozzle N-D is a nozzle N belonging to the nozzle array Ln different from the nozzle N-TG and may be one or more nozzles N ejecting an ink having a color different from the color of the nozzle N-TG.

In this case, the nozzle N-D is a nozzle N for forming a dot in place of the dot Dt-TG to be formed by an ink ejected from the nozzle N-TG when the ejection abnormality occurs in the ejection unit D having the nozzle N-TG. Accordingly, it is preferable that the nozzle N-D is a nozzle in which the position in the Y axis direction is present in a position close to the nozzle N-TG to the extent that the user of the printing system 100 can recognize that the dot Dt-TG which is expected to be formed by ejecting an ink from the nozzle N-TG is formed when the amount of an ink to be ejected from the nozzle N-D is increased.

For example, it is preferable that the nozzle N-D is a nozzle N in which the distance between the nozzle N-D and the nozzle N-TG in the Y axis direction becomes equal to or shorter than the distance from a nozzle N adjacent to an adjacent nozzle in the Y axis direction which is adjacent to the nozzle N-TG in the Y axis direction to the nozzle N-TG in the Y axis direction. That is, it is preferable that the nozzle N-D is a nozzle N within two nozzles from the nozzle N-TG in the Y axis direction. Further, it is more preferable that the nozzle N-D is a nozzle N whose position is approximately the same as that of the nozzle N-TG in the Y axis direction.

Meanwhile, in the different-color nozzle complementation mode, in a case where the nozzle N-TG is complemented with a nozzle N ejecting an ink having a different color from that of the nozzle N-TG, the color of the dot Dt to be actually formed on the recording paper P becomes a color different from that of the dot Dt to be designated by the print data PD. In this case, there is a concern that the user of the printing system 100 recognizes the difference of the color of the dot Dt to be formed and this leads to a decrease in the image quality.

However, in the complementing process using the composite complementation mode, three dots Dt of cyan (CY), magenta (MG), and yellow (YL) are formed by an ink ejected from three nozzles N-D instead of forming a black (BK) dot Dt-TG by an ink ejected from the nozzle N-TG. Generally, in the printing process, a black (BK) dot Dt can be expressed by forming three dots Dt of cyan (CY), magenta (MG), and yellow (YL) in order to express colors of an image (pixel) using subtractive color mixture. Therefore, the user of the printing system 100 recognizes that a black (BK) dot Dt-TG is formed even when the black (BK) dot Dt-TG is not actually formed and thus a decrease in the image quality can be prevented.

In addition, in the bar code printing mode, a bar code which is an image for being read by a bar code reader is printed. The bar code reader acquires information related to numeric values or characters shown by the pattern of a bar code by irradiating the bar code with light having a predetermined wavelength and detecting (more strictly, detecting light having a high reflectance in the bar code) light reflected on the bar code (light which has not been absorbed).

The light having a predetermined wavelength applied from the bar code reader is typically red light having a wavelength of 650 nm and, alternatively, He.Ne laser (red light having a wavelength of approximately 633 nm); light emitted from a red LED (red light having a wavelength of approximately 660 nm); or visible light semiconductor laser (red light having a wavelength of approximately 670 nm) can be employed. That is, in the present embodiment, the light having a predetermined wavelength may be red light having a wavelength of at least 650 nm, preferably light having an optional wavelength in the range of 630 nm to 670 nm; and more preferably light having an optional wavelength in the range of 600 nm to 750 nm.

In the bar code printing mode, the ink forming a bar code may be an ink having any color as long as the ink can absorb light having a predetermined wavelength applied from the bar code reader or may be an ink other than a black (BK) ink. In other words, in the bar code printing mode, the ink for forming a bar code may be an ink having any color as long as the ink having a color in which a portion in which dots are formed by the ink and a portion in which dots are not formed by the ink (for example, a white portion of the recording paper P) can be distinguished by the bar code reader.

Figure 28:
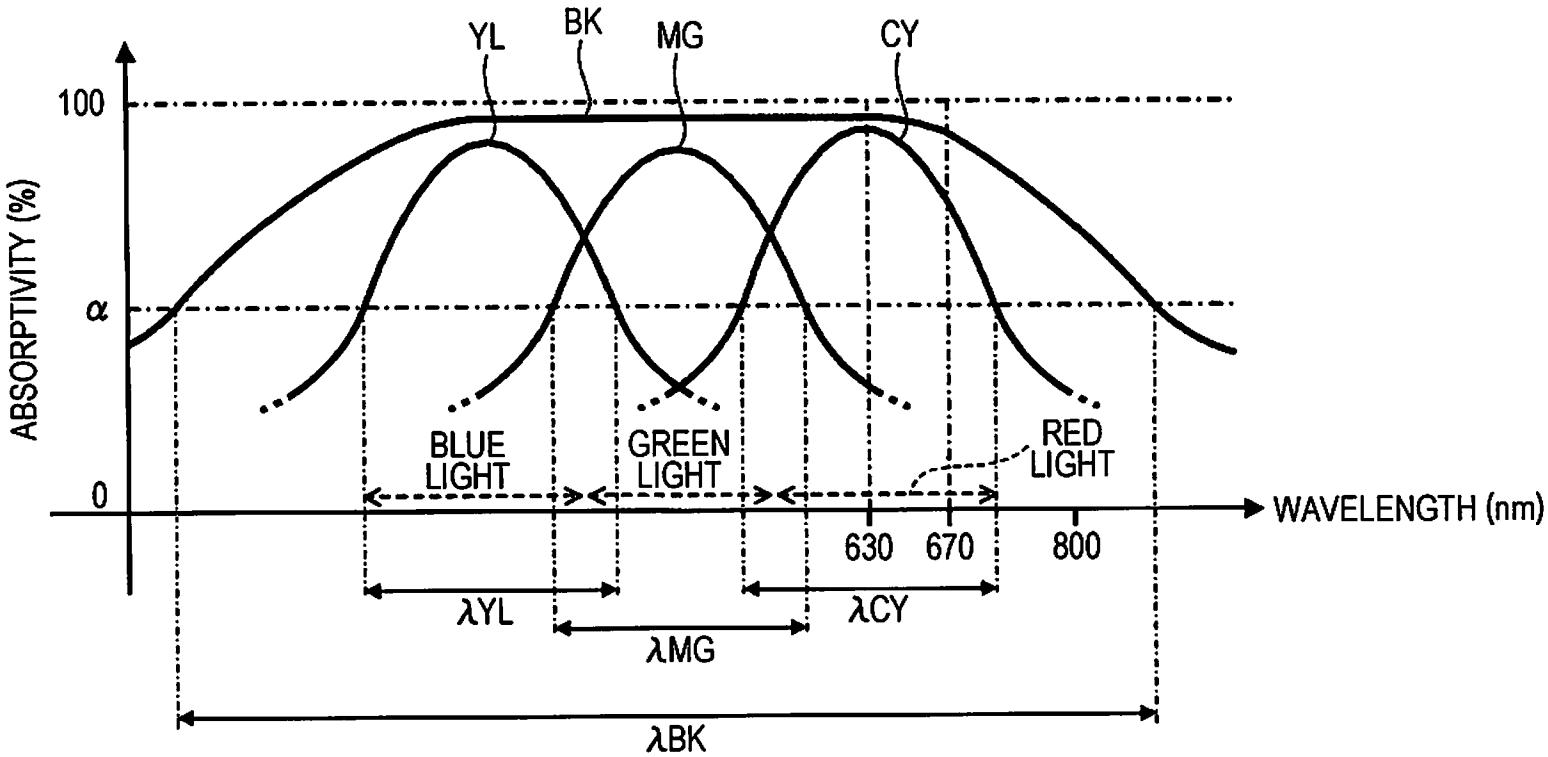
FIG. 28 is an explanatory diagram for describing absorption characteristics of an ink with respect to light.

FIG. 28 is a conceptual view illustrating the outline of absorption characteristics of light of respective inks of cyan (CY), magenta (MG), yellow (YL), and black (BK).

As illustrated in FIG. 28, a wavelength region of visible light absorbed by a cyan (CY) ink is referred to as a wavelength region λCY; a wavelength region of visible light absorbed by a magenta (MG) ink is referred to as a wavelength region λMG; a wavelength region of visible light absorbed by a yellow (YL) ink is referred to as a wavelength region λYL; and a wavelength region of visible light absorbed by a black (BK) ink is referred to as a wavelength region λBK.

Moreover, in the present specification, "absorbing light" is not necessarily limited to a case of absorbing light at a rate of 100% and includes a case of absorbing light at a rate equal to or more than a predetermined rate α. In addition, "reflecting light" is not necessarily limited to a case of reflecting light at a rate of 100% and includes a case of absorbing light in the light at a rate less than the predetermined rate α and the reflecting remaining light. Here, the predetermined rate α may be suitably determined according to the characteristics of the ink to be used in the ink jet printer 1, the characteristics of the recording paper P, or the image quality of an image to be printed and, for example, may be an arbitrary value in the range of 30% to 100%. In the present embodiment, the predetermined rate α is set to 50% as an example.

As illustrated in the figure, a cyan (CY) ink ideally absorbs red light (light having a wavelength of approximately 600 nm to 750 nm) and reflects green light (light having a wavelength of approximately 500 nm to 600 nm) and blue light (light having a wavelength of approximately 380 nm to 500 nm). A magenta (MG) ink ideally absorbs green light and reflects blue light and red light. A yellow (YL) ink ideally absorbs blue light and reflects green light and red light. Further, a black (BK) ink generally absorbs visible light (light having a wavelength of approximately 380 nm to 750 nm). That is, the wavelength region λCY is ideally approximately the same as the wavelength region of 600 nm to 750 nm; the wavelength region λMG is approximately the same as the wavelength region of 500 nm to 600 nm; the wavelength region λYL is approximately the same as the wavelength region of 380 nm to 500 nm; and the wavelength region λBK includes the entire wavelength region of 380 nm to 750 nm.

In this case, as illustrated in FIG. 28, the wavelength region λCY may be a region including a part or the entire wavelength region of red light. Specifically, the wavelength region λCY may include a wavelength of at least 650 nm and preferably include a wavelength region of 630 nm to 670 nm. Similarly, the wavelength region λMG may be a region including a part or the entire wavelength region of green light and the wavelength region λYL may be a region including a part or the entire wavelength region of blue light.

As is obvious in FIG. 28, the cyan (CY) ink absorbs red light (light having a predetermined wavelength) applied by the bar code reader. The black (BK) ink absorbs red light (light having a predetermined wavelength) applied by the bar code reader. For this reason, in the bar code printing mode, when a bar code is formed by the black (BK) or cyan (CY) ink, the bar code can perform a function of the bar code, that is, displaying information related to numeric values or characters which can be read by the bar code reader.

In this case, printing modes other than the bar code printing mode, that is, the normal printing mode, the photo printing mode, and the figure printing mode are printing modes of forming an image in order for the user of the printing system 100 to recognize the image. For this reason, in the case where the printing process is performed using printing modes other than the bar code printing mode, it is preferable to limit the different-color nozzle complementation mode to the composite complementation mode when the complementing process is performed using the different-color nozzle complementation mode.

Meanwhile, the bar code printing mode is a printing mode for printing a bar code such that the bar code reader reads information such as numeric values or characters. For this reason, in the case where the printing process is performed using the bar code printing mode, it is not necessary to limit the different-color nozzle complementation mode to the composite complementation mode when the complementing process is performed using the different-color nozzle complementation mode. That is, even when the color of the dot Dt-TG which is expected to be formed when the complementing process is not performed and the color of the dot Dt-D to be formed through the complementing process using the different-color nozzle complementation mode are different from each other, this is permitted in some cases.

More specifically, in the case where the printing process is performed using the bar code printing mode, it is possible to perform the complementing process using three kinds of different-color nozzle complementation modes of a composite complementation mode that complements the nozzle N-TG ejecting a black (BK) ink with three nozzles N-D ejecting cyan (CY), magenta (MG), and yellow (YL) inks; a different-color nozzle complementation mode that complements the nozzle N-TG ejecting a black (BK) ink with the nozzle N-D ejecting a cyan (CY) ink; and a different-color nozzle complementation mode that complements the nozzle N-TG ejecting a cyan (CY) ink with the nozzle N-D ejecting a black (BK) ink.

Further, in the different-color nozzle complementation mode described above, a unit operation period Tu for which an ink is expected to be ejected from the nozzle N-TG and a unit operation period Tu for which an ink is ejected from the nozzle N-D in place of the nozzle N-TG may be unit operation periods Tu which are the same as or different from each other.

Specifically, in a case where the position of the nozzle N-TG in the X axis direction and the position of the nozzle N-D in the X axis direction are close to each other to the extent that the two positions are seen as the same position, the unit operation period Tu for which an ink is expected to be ejected from the nozzle N-TG and the unit operation period Tu for which an ink is ejected from the nozzle N-D in place of the nozzle N-TG may be set as the same unit operation period Tu.

In addition, in a case where the position of the nozzle N-TG in the X axis direction is separated from the position of the nozzle N-D in the X axis direction by more than a distance of one pixel, an ink may be ejected from the nozzle N-D in the unit operation period Tu after the unit operation period Tu for which an ink is expected to be ejected from the nozzle N-TG. In this case, the transporting speed My may be suitably adjusted such that the dot Dt-TG which is expected to be formed by an ink ejected from the nozzle N-TG and the dot Dt-D to be formed by an ink ejected from the nozzle N-D are formed on the same pixel. 4.3. Same-color different-array nozzle complementation mode FIG. 27 illustrates a case where the complementing process is performed with respect to the nozzle N-TG using the same-color and different-array nozzle complementation mode when ejection abnormality exemplified in FIG. 24 occurs.

As illustrated in FIG. 27, in the complementing process using the same-color and different-array nozzle complementation mode, in a case where ejection abnormality occurs in the ejection unit D having the nozzle N-TG and the dot Dt-TG cannot be formed in the pixel Px5 by ejecting an ink from the nozzle N-TG, the nozzle N-TG is complemented by increasing the amount of the ink ejected from at least one nozzle N ejecting an ink having a different color from that of the nozzle N-TG which is a nozzle N belonging to the nozzle array Ln different from that of the nozzle N-TG instead of ejecting an ink from the nozzle N-TG.

Hereinafter, in the same-color and different-array nozzle complementation mode, one or more nozzles N complemented with the nozzle N-TG are referred to as same-color different-array complementation nozzles N-P (or simply "nozzles N-P").

In the same-color and different-array nozzle complementation mode, the control unit 6 controls execution of the complementing process by setting the value of the printing signal SI[m] corresponding to the ejection unit D having the nozzle N-TG to the value (b1, b2, b3)=(0, 0, 0) corresponding to "non-recording," and changing the value of the printing signal SI[m] corresponding to the ejection unit D having the nozzle N-P to a value such that the amount of the ink ejected from the nozzle N-P is increased compared to the case where the complementation is not performed.

In the example of FIG. 27, a case where one nozzle N positioned approximately the same as that of the nozzle N-TG in the Y axis direction is employed as the nozzle N-P is exemplified.

In the example of FIG. 24, a case where an ink is not ejected from the nozzle N-P when the complementing process is not performed is assumed. That is, it is expected that the value of the printing signal SI[m] corresponding to the ejection unit D having the nozzle N-P becomes a value of (b1, b2, b3)=(0, 0, 0) corresponding to "non-recording" when the complementing process is not performed.

Meanwhile, as illustrated in FIG. 27, in a case where the complementing process is performed using the same-color and different-array nozzle complementation mode by employing the nozzle N-P, for example, a medium amount of ink is ejected from the nozzle N-P. That is, in a case where the complementing process is performed using the same-color and different-array nozzle complementation mode, the value of the printing signal SI[m] corresponding to the ejection unit D having the nozzle N-P is, for example, changed into a value of (b1, b2, b3)=(1, 0, 0) corresponding to a "medium dot". As a result, a dot Dt-P which is a medium dot is formed in the pixel Px5 by an ink ejected from the nozzle N-P.

In a case where a dot Dt-P which is a medium dot is formed in the pixel Px5, the possibility that the user of the printing system 100 recognizes that the dot Dt-TG is formed even when the dot Dt-TG is not actually formed becomes higher. For this reason, when the dot Dt-TG is not formed, this can prevent the user from recognizing the unformed dot as "dot omission." That is, even when ejection abnormality occurs, it is possible to minimize the extent of a decrease in the image quality of an image to be formed on the recording paper P in the printing process by performing the complimenting process using the same-color and different-array nozzle complementation mode compared to the case where the complementing process is not performed.

Hereinafter, in the same-color and different-array nozzle complementation mode, the complementation mode that employs a nozzle N whose position is approximately the same as the nozzle N-TG in the Y axis direction as the nozzle N-P is particularly referred to as a "nozzle complementation mode" as illustrated in FIG. 27. That is, the same-color and different-array nozzle complementation mode is a complementation mode including the nozzle complementation mode.

Moreover, in the nozzle complementation mode, the nozzle N-P is limited to the nozzle N whose position is approximately the same as the nozzle N-TG in the Y axis direction. Further, in the nozzle complementation mode, the nozzle N-TG is limited to an overlapping nozzle positioned in the region YPOL.

Moreover, in the same-color and different-array nozzle complementation mode, the nozzle N-P is not limited to the nozzle N whose position is approximately the same as the nozzle N-TG in the Y axis direction.

In conclusion, in the same-color and different-array nozzle complementation mode, the same-color different-array complementation nozzle N-P is a nozzle N belonging to the nozzle array Ln which is different from that of the nozzle N-TG and may be one or more nozzles N ejecting an ink having the same color as that of the nozzle N-TG.

In this case, the nozzle N-P is a nozzle N for forming a dot instead of the dot Dt-TG to be formed by an ink ejected from the nozzle N-TG when the ejection abnormality occurs in the ejection unit D having the nozzle N-TG.

Accordingly, it is preferable that the nozzle N-P is a nozzle N in which the position in the Y axis direction is present in a position close to the nozzle N-TG to the extent that the user of the printing system 100 can recognize that the dot Dt-TG which is expected to be formed by ejecting an ink from the nozzle N-TG is formed when the amount of an ink to be ejected from the nozzle N-P is increased. For example, it is preferable that the nozzle N-P is a nozzle N in which the distance between the nozzle N-P and the nozzle N-TG in the Y axis direction becomes equal to or shorter than the distance from a nozzle N adjacent to an adjacent nozzle in the Y axis direction which is adjacent to the nozzle N-TG in the Y axis direction to the nozzle N-TG in the Y axis direction. That is, it is preferable that the nozzle N-P is a nozzle N present in a position within two nozzles from the nozzle N-TG in the Y axis direction.

Further, in the same-color and different-array nozzle complementation mode described above, a unit operation period Tu for which an ink is expected to be ejected from the nozzle N-TG and a unit operation period Tu for which an ink is ejected from the nozzle N-P in place of the nozzle N-TG may be unit operation periods Tu which are the same as or different from each other.

Specifically, in a case where the position of the nozzle N-TG in the X axis direction and the position of the nozzle N-P in the X axis direction are close to each other to the extent that the two positions are seen as the same position, the unit operation period Tu for which an ink is expected to be ejected from the nozzle N-TG and the unit operation period for which an ink is ejected from the nozzle N-P in place of the nozzle N-TG may be set as the same unit operation period Tu.

In addition, in a case where the position of the nozzle N-TG in the X axis direction is separated from the position of the nozzle N-P in the X axis direction by more than a distance of one pixel, an ink may be ejected from the nozzle N-P in the unit operation period Tu after the unit operation period Tu for which an ink is expected to be ejected from the nozzle N-TG. In this case, the transporting speed My may be suitably adjusted such that the dot Dt-TG which is expected to be formed by an ink ejected from the nozzle N-TG and the dot Dt-P to be formed by an ink ejected from the nozzle N-P are formed on the same pixel.

4.4. Summary of Complementation Modes

As illustrated above, the ink jet printer 1 according to the present embodiment performs the complementing process using any one of the complementation modes of the same-array nozzle complementation mode including the adjacent nozzle complementation mode; the different-color nozzle complementation mode including the composite complementation mode; and the same-color and different-array nozzle complementation mode including the nozzle complementation mode. In this manner, it is possible to prevent the user from recognizing the dot omission and to prevent the degradation of the image quality of an image to be printed.

Further, in the description of FIGS. 24 to 27, a nozzle N ejecting a black (BK) ink is exemplified as the nozzle N-TG, but the nozzle N-TG may be a nozzle N of ejecting an ink having a color other than black (BK). In this case, in the different-color nozzle complementation mode, the nozzle N-TG is limited to a nozzle N ejecting a black (BK) ink or a cyan (CY) ink. Further, in the composite complementation mode of the different-color nozzle complementation mode, the nozzle N-TG is limited to a nozzle N ejecting a black (BK) ink.

In addition, the ejection abnormality nozzle N-TG is an example of the "one nozzle," the same-array complementation nozzle N-R is an example of the "first nozzle," the different-color complementation nozzle N-D is an example of the "second nozzle," and the same-color different-array complementation nozzle N-P is an example of the "third nozzle."

Further, the nozzle array Ln (the nozzle array Ln-BK1 in the examples of FIGS. 24 to 27) to which the nozzle N-TG and the same-array complementation nozzle N-R belong corresponds to the "first nozzle group," the nozzle array Ln (the nozzle arrays Ln-CY1, Ln-MG1, and Ln-YL1 in the examples of FIGS. 24 to 27) to which the different-color complementation nozzle N-D belongs corresponds to the "second nozzle group," and the nozzle array Ln (the nozzle array Ln-BK2 in the examples of FIGS. 24 to 27) to which the same-color different-array complementation nozzle N-P belongs corresponds to the "third nozzle group,"

Further, the area (the area R-BK1 in the examples of FIGS. 24 to 27) on the recording head 30 for which the first nozzle group is provided corresponds to the "first area," the area (the areas R-CY1, R-MG1, and R-YL1 in the examples of FIGS. 24 to 27) on the recording head 30 for which the second nozzle group is provided corresponds to the "second area," and the area (the area R-BK2 in the examples of FIGS. 24 to 27) on the recording head 30 for which the third nozzle group is provided corresponds to the "third area."

Further, the color of the ink ejected from the nozzle N belonging to the first nozzle group and the third nozzle group corresponds to the "first color" and the color of the ink ejected from the nozzle N belonging to the second nozzle group corresponds to the "second color." In this case, in the bar code printing mode, one of black (BK) and cyan (CY) is the "first color" and the other is the "second color."

5. Method of Determining Complementation Mode

As described above, the ink jet printer 1 according to the present embodiment is capable of performing the complementing process using any one of the three complementation modes which are the same-array nozzle complementation mode, the different-color nozzle complementation mode, and the same-color and different-array nozzle complementation mode. In addition, among the three complementation modes, a complementation mode which is to be used for the complementing process is selected according to the printing mode of the printing process performed by the ink jet printer 1 and the position of a nozzle N included in the ejection unit D in which ejection abnormality occurs.

Hereinafter, the process determining the complementation mode is referred to as a complementation mode determining process. The control unit 6 selects a complementation mode suitable for complementation of the ejection unit D in which ejection abnormality occurs by performing the complementation mode determining process.

FIGS. 29 to 33 are flowcharts showing examples of the flow of the complementation mode determining process performed by the control unit 6. Hereinafter, the complementation mode determining process will be described with reference to FIGS. 29 to 33.

In addition, the complementation mode determining process is performed with respect to respective ejection units D with ejection abnormality among the 8M ejection units D included in the ink jet printer 1.

The control unit 6 starts the complementation mode determining process in the case where the ejection unit D in which ejection abnormality occurs is detected in the ejection abnormality determining process. More specifically, the control unit 6 performs the complementation mode determining process with respect to the respective nozzles N-TG after the nozzles N included in the respective ejection units D having ejection abnormality are set to the nozzles N-TG in a case where the ejection state determining process performed with respect to the 8M ejection units D is completed and ejection units D having ejection abnormality are present in the 8M ejection units D.

Moreover, the complementation mode determining process may be performed during the unit operation period Tu for which the ejection state determining process is performed or may be performed during the unit operation period Tu for which the printing process is performed. In this case, it is preferable that the complementation mode determining process is performed during the unit operation period Tu for which the ejection state determining process is performed before the unit operation period Tu for which the printing process is performed is started, from a viewpoint of preventing the degradation of the image quality of an image to be printed in the printing process in advance. That is, it is preferable that the complementation mode determining process is performed at the timing at which the recording head 30 is on the upper side (+Z side) of the margin area.

Figure 29:
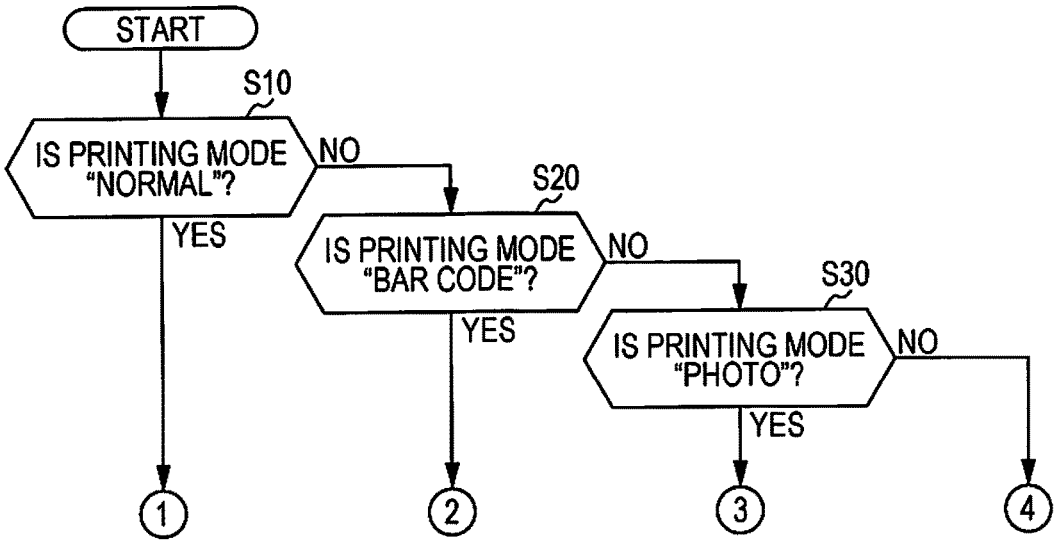
FIG. 29 is a flowchart for describing a complementation mode determining process.

As illustrated in FIG. 29, first, the control unit 6 specifies the kind of printing mode of the printing process performed by the ink jet printer 1 when the complementation mode determining process is started. Specifically, the control unit 6 specifies the kind of printing mode by referring to the printing mode data MD.

Further, the kind of the printing mode to be specified in the complementation mode determining process is the kind of printing mode of the printing process performed at the timing at which the complementation mode determining process is performed or the kind of printing mode of the printing process performed immediately after the timing at which the complementation mode determining process is performed.

In the example of FIG. 29, the control unit 6 refers to the printing mode data MD stored in the storage unit 62 and determines whether the printing mode indicated by the printing mode data MD is the normal printing mode (Step S10). The control unit 6 advances the process to Step S100 which will be described below with reference to FIG. 30 in a case where the determination result in Step S10 is positive, that is, the printing mode is the normal printing mode.

The control unit 6 determines whether the printing mode indicated by the printing mode data MD is the bar code printing mode in a case where the determination result in Step S10 is negative (Step S20). In a case where the determination result in Step S20 is positive, that is, the printing mode is the bar code printing mode, the process proceeds to Step S200 which will be described below with reference to FIG. 31.

The control unit 6 determines whether the printing mode indicated by the printing mode data MD is the photo printing mode in a case where the determination result in Step S20 is negative (Step S30). In a case where the determination result in Step S30 is positive, that is, the printing mode is the photo printing mode, the process proceeds to Step S300 which will be described below with reference to FIG. 32.

In addition, the control unit 6 advances the process to Step S400 which will be described below with reference to FIG. 33 in a case where the determination result is negative in Step S30, that is, the printing mode is the figure printing mode.

Moreover, the flowchart illustrated in FIG. 29 is merely an example and the execution order of Steps S10 to S30 may be suitably changed. Further, the control unit 6 may specify the printing mode of the printing process in advance based on information shown by the printing mode data MD.

5.1. Complementation Mode Determining Process in Normal Printing Mode

Figure 30:
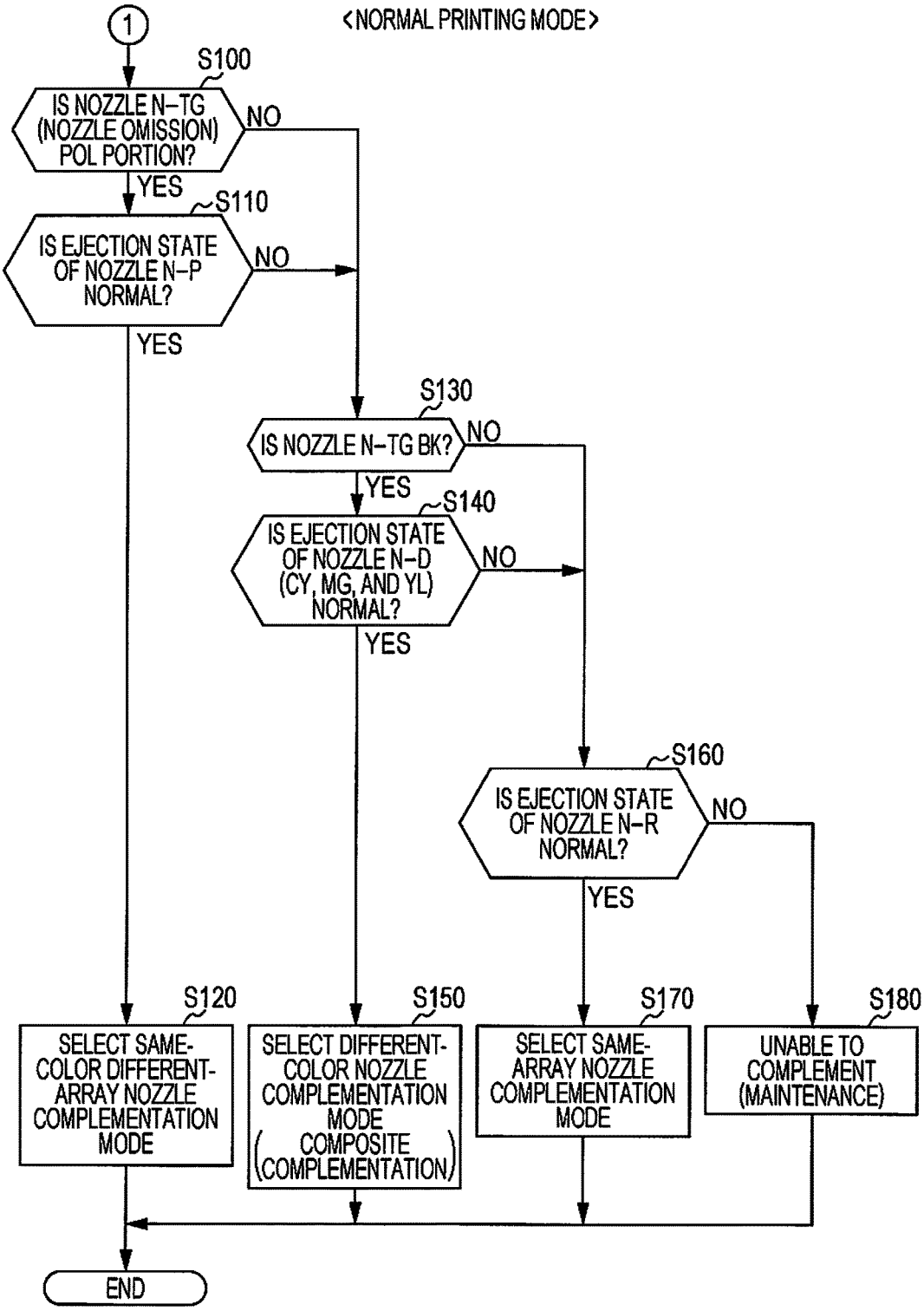
FIG. 30 is a flowchart for describing the complementation mode determining process in a normal printing mode.

FIG. 30 is a flowchart illustrating an example of the flow of the complementation mode determining process in a case where the printing process is performed using the normal printing mode.

First, the control unit 6 determines whether the ejection abnormality nozzle N-TG is an overlapping nozzle positioned in the area YPOL (POL portion) in a case where the determination result in Step S10 is positive, that is, the printing mode is the normal printing mode (Step S100).

The control unit 6 determines whether the ejection state of the ejection unit D having the same-color different-array complementation nozzle N-P is normal, in other words, whether complementation of the nozzle N-TG with the nozzle N-P is possible by referring to the determination result signal Rs stored in the storage unit 62 in a case where the determination result in Step S100 is positive, that is, the nozzle N-TG is an overlapping nozzle (Step S110).

The control unit 6 selects the same-color and different-array nozzle complementation mode (Step S120) as the complementation mode and controls execution of the complementing process using the same-color and different-array nozzle complementation mode same-color and different-array nozzle complementation mode in a case where the determination result in Step S110 is positive, that is, complementation of the nozzle N-TG with the nozzle N-P is possible.

In addition, the same-color different array nozzle complementation mode selected in Step S120 is not limited to the nozzle complementation mode. That is, the nozzle N-P which becomes a target of determination in Step S110 may be a nozzle belonging to the nozzle array Ln different from the nozzle N-TG and may be one or more nozzles N ejecting an ink having the same color as that of the nozzle N-TG.

As illustrated in FIG. 30, the control unit 6 determines whether the nozzle N-TG is a nozzle N ejecting a black (BK) ink in a case where the determination result in Step S100 or Step S110 is negative, that is, the complementing process with respect to the nozzle N-TG cannot be performed using the same-color and different-array nozzle complementation mode (Step S130).

The control unit 6 determines whether the ejection state of the ejection unit D having the different-color complementation nozzle N-D is normal, in other words, whether complementation of the nozzle N-TG with the nozzle N-D is possible by referring to the determination result signal Rs stored in the storage unit 62 in a case where the determination result in Step S130 is positive, that is, the nozzle N-TG is a nozzle N ejecting a black (BK) ink (Step S140).

The control unit 6 selects the different-color nozzle complementation mode (Step S150) as a complementation mode and controls execution of the complementing process using the different-color nozzle complementation mode in a case where the determination result in Step S140 is positive, that is, complementation of the nozzle N-TG with the nozzle N-D is possible.

Moreover, the normal printing mode is a printing mode for forming an image recognized by the user of the printing system 100 as described above. Accordingly, in the present embodiment, the different-color nozzle complementation mode selected in Step S150 is limited to the composite complementation mode. That is, the nozzles N-D serving as a target of determination in Step S140 are three nozzles N-D in one-to-one correspondence with cyan (CY), magenta (MG), and yellow (YL).

As illustrated in FIG. 30, the control unit 6 determines whether the ejection state of the ejection unit D having the same-array complementation nozzle N-R is normal, in other words, whether complementation of the nozzle N-TG with the nozzle N-R is possible by referring to the determination result signal Rs stored in the storage unit 62 in a case where the determination result in Step S130 or S140 is negative, that is, the complementing process cannot be performed with respect to the nozzle N-TG using the composite complementation mode (Step S160).

The control unit 6 controls execution of the complementing process using the same-array nozzle complementation mode by selecting the same-array nozzle complementation mode (Step S170) as the complementation mode in a case where the determination result in Step S160 is positive, that is, the complementation of the nozzle N-TG with the nozzle N-R is possible.

In addition, the same-array nozzle complementation mode selected in Step S170 is not limited to the adjacent nozzle complementation mode. That is, the nozzle N-R serving as a target of determination in Step S160 may be a nozzle N belonging to the nozzle array Ln which is the same as that of the nozzle N-TG and may be one or more nozzles N other than the nozzle N-TG.

In a case where the determination result in Step S160 is negative, the complementing process cannot be performed using any of the complementation modes of the ink jet printer 1. For this reason, as illustrated in FIG. 30, the control unit 6 controls operations of respective units of the ink jet printer 1 such that the maintenance process is performed with respect to the nozzle N-TG in the case where the determination result in Step S160 is negative (Step S180).

In addition, the maintenance process with respect to the nozzle N-TG may be performed immediately after the determination result in Step S160 becomes negative, may be performed after execution of the complementation mode determining process with respect to all ejection units D having ejection abnormality is completed, or may be performed after a series of printing processes with respect to the recording paper P is completed. In this case, in a case where the printing process is performed without performing complementation with respect to the ejection units D having ejection abnormality, the image quality of an image to be printed in the printing process is degraded. For this reason, it is preferable that the maintenance process is performed until the printing process is initially started after the complementation mode determining process is performed.

As described above, when ejection abnormality occurs in the ejection unit D in the case where the printing process is performed using the normal printing mode, the control unit 6 selects the complementation mode in order of priority of the "same-color and different-array nozzle complementation mode," the "different-color nozzle complementation mode (composite complementation mode)," and the "same-array nozzle complementation mode" and controls execution of the complementing process with respect to the nozzle N-TG using the selected complementation mode.

Further, the order of priority of the complementation mode in the case where the printing process is performed using the normal printing mode, illustrated in FIG. 30, is only an example and may be suitably changed. For example, the order of priority may be in order of the "composite complementation mode," the "same-color and different-array nozzle complementation mode," and the "same-array nozzle complementation mode."

The normal printing mode is a default printing mode and, for example, a case where characters (sentences) which can be recognized even when the image quality is degraded are printed is assumed. In some cases, the user of the printing system 100 does not prefer a printing process constantly prioritizing the image quality but prefers a printing process prioritizing the printing speed even though the image quality is sacrificed.

For this reason, in the case where the printing process is performed using the normal printing mode, the complementing process may not be performed. Further, in the screen for designating printing conditions illustrated in FIG. 2, the presence of execution of the complementing process or the order of priority of the complementation mode in the case where complementing process is performed may be designated by the user of the printing system 100. For example, in the screen for designating printing conditions illustrated in FIG. 2, the complementing process may be performed when the selection indicating that the printing process prioritizing the image quality is performed and the complementing process may not be performed when the selection indicating that the printing process prioritizing the printing speed is performed.

5.2. Complementation Mode Determining Process in Bar Code Printing Mode

Figure 31:
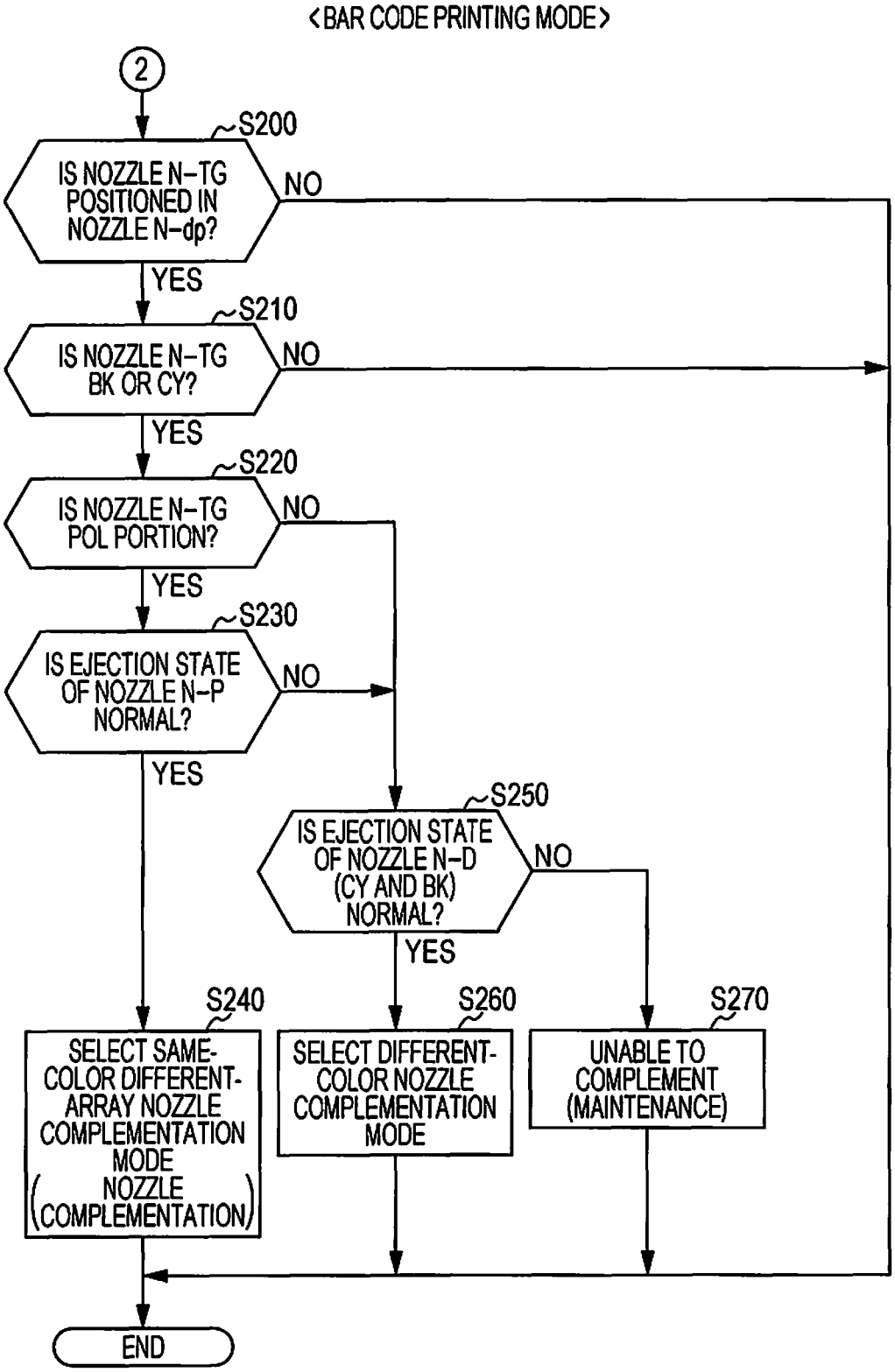
FIG. 31 is a flowchart for describing the complementation mode determining process in a bar code printing mode.

FIG. 31 is a flowchart illustrating an example of the flow of the complementation mode determining process in a case where the printing process is performed using the bar code printing mode.

The control unit 6 determines whether the ejection abnormality nozzle N-TG corresponds to a data pattern printing nozzle N-dp which is a nozzle N provided for printing a portion showing information related to numeric values or characters in a bar code in a case where the determination result in Step S20 is positive, that is, the printing mode is the bar code printing mode (Step S200).

Here, the data pattern printing nozzle N-dp will be described with reference to FIGS. 34A and 34B.

Figure 34A:
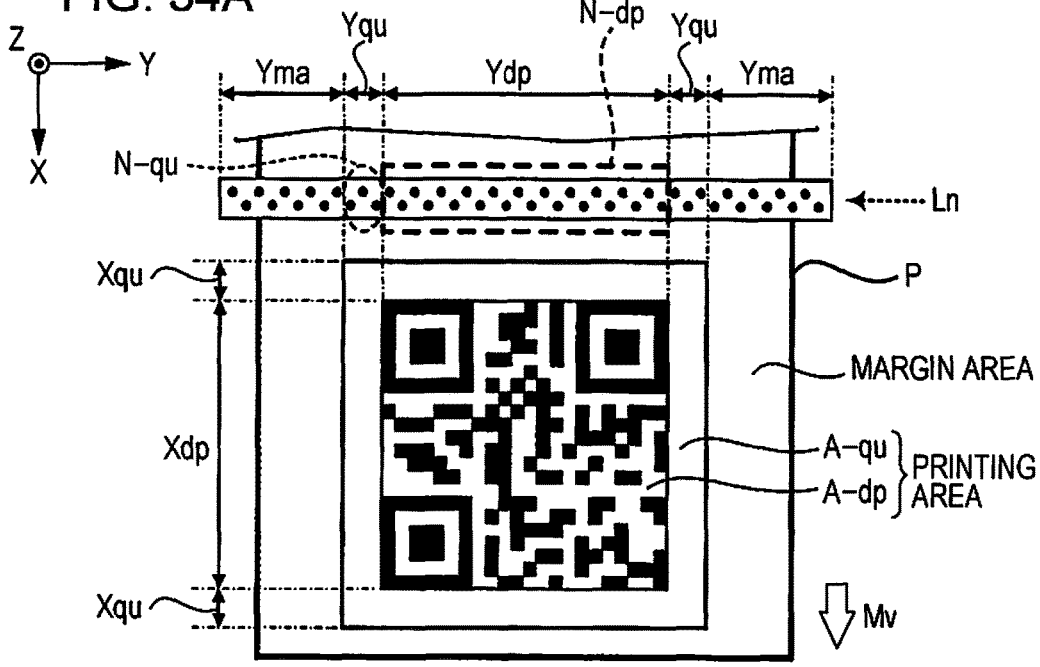
FIGS. 34A and 34B are explanatory diagrams for describing a bar code.
Figure 34B:
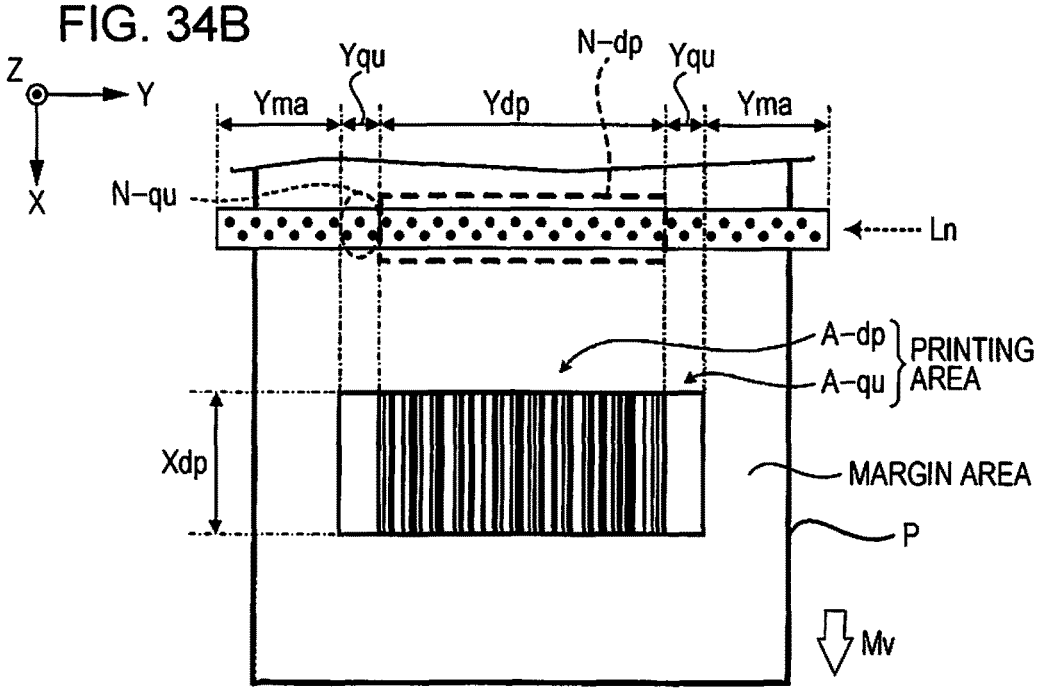

FIGS. 34A and 34B are explanatory diagrams for describing the data pattern printing nozzle N-dp. In addition, in FIGS. 34A and 34B, for convenience of illustration, only one array among eight nozzle arrays Ln (Ln-BK1 to Ln-YL2) included in the recording head 30 is representatively illustrated.

As illustrated in FIGS. 34A and 34B, the bar code to be printed in the bar code printing mode includes a data pattern area A-dp for showing information related to numeric values or characters and a non-data area-qu which is provided in the periphery of the data pattern area A-dp and has not pattern (a so-called quiet zone, an example of a "terminal of a bar code").

Specifically, as illustrated in FIG. 34A, in a two-dimensional bar code, an area whose position in the X axis direction is a region Xdp and position in the Y axis direction is a region Ydp among areas (printing areas) in which the bar code is printed is the data pattern area A-dp and an area whose position in the X axis direction is a region Xqu on the outside of the region Xdp and position in the Y axis direction is a region Yqu on the outside of the region Ydp among areas (printing areas) in which the bar code is printed is the non-data area A-qu.

Further, in the one-dimensional bar code, among areas (printing areas) in which a bar code is printed, an area in which the position in the X axis direction is the region Xdp and the position in the Y axis direction is the region Ydp is a data pattern area A-dp and an area in which the position in the X axis direction is the region Xdp and the position in the Y axis direction is the region Yqu is a non-data area A-qu as illustrated in FIG. 34B.

As illustrated in FIGS. 34A and 34B, the data pattern printing nozzle N-dp is a nozzle N positioned in the region Ydp. That is, an image of the data pattern area A-dp of a bar-code (data pattern) is printed by an ink to be ejected from the data pattern printing nozzle N-dp. In addition, a nozzle N positioned in the region Yqu is referred to as a non-data area printing nozzle N-qu. An image of the non-data area A-qu of a bar-code is printed by an ink to be ejected from the non-data area printing nozzle N-qu. Further, in the example of FIGS. 34A and 34B, the data pattern printing nozzles N-dp and nozzles N other than the non-data area printing nozzle N-qu among M nozzles N belonging to each of the nozzle array Ln are only nozzles N passing on the margin area (+Z direction) and not provided for the printing process.

In the bar code printing mode for printing a bar code, it is important that information related to numeric values and characters shown by the bar code is accurately printed. That is, in the data pattern area A-dp, it is important to accurately perform printing without dot omission. Accordingly, in a case where ejection abnormality occurs in the data pattern printing nozzle N-dp, it is necessary to perform complementation with respect to the data pattern printing nozzle N-dp.

Meanwhile, since an image to be printed in the non-data area A-qu is an image not showing the information related to numeric values or characters (for example, a white image), the image does not generally influence the information related to numeric values or characters of a bar code even when ejection abnormality occurs in the non-data area printing nozzle N-qu.

Accordingly, in the present embodiment, the complementing process is not performed with respect to nozzles N other than the data pattern printing nozzle N-dp in the bar code printing mode. That is, the control unit 6 finishes the complementation mode determining process related to the nozzle N-TG and does not perform complementation with respect to the nozzle N-TG in a case where the determination result in Step S200 of FIG. 31 is negative.

As illustrated in FIG. 31, the control unit 6 determines whether the nozzle N-TG corresponds to one of a nozzle N ejecting a black (BK) ink or a nozzle N ejecting a cyan (CY) ink in the case where the determination result in Step S200 is positive, that is, the nozzle N-TG corresponds to the data pattern printing nozzle N-dp (Step S210).

Further, the control unit 6 finishes the complementation mode determining process related to the nozzle N-TG and does not perform complementation with respect to the nozzle N-TG in a case where the determination result in Step S210 is negative. The reason for this is that the ink forming the data pattern area A-dp of a bar code is a black (BK) or cyan (CY) ink absorbing red light applied from the bar code reader as described above. In other words, in the bar code printing mode, the nozzle N-TG is limited to a nozzle N ejecting a black (BK) ink or a nozzle N ejecting a cyan (CY) ink.

As illustrated in FIG. 31, the control unit 6 determines whether the ejection abnormality nozzle N-TG is an overlapping nozzle positioned in the region YPOL (POL portion) in a case where the determination result in Step S210 is positive, that is, the nozzle N-TG is a nozzle N ejecting a black (BK) ink or a nozzle N ejecting a cyan (CY) ink (Step S220).

Further, the control unit 6 determines whether the ejection state of the ejection unit D having the same-color different-array complementation nozzle N-P is normal, in other words, the complementation of the nozzle N-TG with the nozzle N-P is possible by referring to the determination result signal Rs stored in the storage unit 62 in a case where the determination result in Step S220 is positive, that is, the nozzle N-TG is an overlapping nozzle (Step S230).

As illustrated in FIG. 31, the control unit 6 selects the same-color and different-array nozzle complementation mode (Step S240) as the complementation mode and controls execution of the complementing process using the same-color and different-array nozzle complementation mode in a case where the determination result in Step S230 is positive, that is, the complementation of the nozzle N-TG with the nozzle N-P is possible.

In addition, in the present embodiment, the same-color and different-array nozzle complementation mode which is selected in Step S240 is limited to the nozzle complementation mode.

As described above, a bar code shows information related to numeric values or characters using the thickness of each line segment or intervals between line segments of the bar code in a case of a one-dimensional bar code and using the shape of a pattern of the bar code in a case of a two-dimensional bar code. For this reason, in a case where the position of the nozzle N-P complementing the nozzle N-TG is different from the position of the nozzle N-TG in the Y axis direction by one pitch in the Y axis direction, the position of the dot Dt-TG for showing an image designated by the print data PD is different from the position of the dot Dt-P formed in place of the dot Dt-TG by performing the complementing process by one pitch (one pixel) in the Y axis direction. That is, the thickness of the line segment, the interval of the line segments, and the shape of the pattern of the printed bar code are different from a bar code of an image designated by the print data PD by one pitch (one pixel). In this case, there is a possibility that the bar code printed in the printing process shows information different from the information related to numeric values or characters to be originally shown by the bar code.

Meanwhile, in a case where the same-color and different-array nozzle complementation mode is limited to the nozzle complementation mode, since the nozzle N-TG can be complemented with the nozzle N-P whose position in the Y axis direction is approximately the same as that of the nozzle N-TG, a bar code of an image shown by the print data PD can be accurately printed and information related to numeric values or characters to be originally shown by the bar code can be accurately shown.

As illustrated in FIG. 31, the control unit 6 determines whether the ejection state of the ejection unit D having the different-color complementation nozzle N-D is normal, in other words, the complementation of the nozzle N-TG with the nozzle N-D is possible by referring to the determination result signal Rs stored in the storage unit 62 in a case where the determination result is negative in Step S220 or S230, that is, the complementing process cannot be performed with respect to the nozzle N-TG using the nozzle complementation mode (Step S250).

As described above, in the bar code printing mode, the ink which can be used for printing the data pattern area A-dp is limited to an ink which can absorb light (red light) having a predetermined wavelength applied by the bar code reader. For this reason, in the bar code printing mode, it is necessary for the nozzles N-D complementing the nozzle N-TG to include a nozzle N ejecting a black (BK) ink or a nozzle N ejecting a cyan (CY) ink when the complementing process is performed using the different-color nozzle complementation mode. That is, when the nozzle N-TG is a nozzle N corresponding to black (BK), it is necessary for the nozzle N-D serving as a target of determination in Step S250 to include at least a nozzle N corresponding to cyan (CY). On the contrary, when the nozzle N-TG is a nozzle N corresponding to cyan (CY), it is necessary for the nozzle N-D serving as a target of determination in Step S250 to include at least a nozzle N corresponding to black (BK).

As illustrated in FIG. 31, the control unit 6 selects the different-color nozzle complementation mode (Step S260) as the complementation mode and controls execution of the complementing process using the different-color nozzle complementation mode in a case where the determination result in Step S250 is positive, that is, the complementation of the nozzle N-TG with the nozzles N-D including at least a nozzle N corresponding to black (BK) or cyan (CY) is possible.

Meanwhile, in the printing process using the bar code printing mode, as described above, the accuracy of the position or the shape of an image to be formed on the recording medium is important. For example, in a case where one nozzle N is complemented with another nozzle N, it is preferable that the position of a dot to be formed on the recording paper P and the size of the dot to be formed by an ink ejected from another nozzle N are not different from those of a dot which is expected to be formed by an ink to be ejected from one nozzle N when ejection abnormality has not occurred.

However, in the same-array nozzle complementation mode such as the adjacent nozzle complementation mode, in a case where the nozzle N-TG is complemented with the nozzle N-R, the size of the dot Dt-R to be formed by an ink ejected from the nozzle N-R is generally larger than the size of the dot Dt-TG which is expected to be formed by an ink ejected from the nozzle N-TG or the dot Dt-R is formed in a position separated from the position of the dot Dt-TG by at least one pitch (one pixel).

For example, as illustrated in FIG. 25, a case of forming a large dot Dt-R in the pixels Px4 and Px6 instead of forming a medium dot Dt-TG in the pixel Px5 is assumed. In this case, for example, when information of a bar code is intended to be expressed by a thick line segment corresponding to one dot parallel to the X axis direction, the thickness of the line segment to be actually printed corresponds to three dots. In addition, when information of the bar code is intended to be expressed by a thick line segment corresponding to one medium dot parallel to the Y axis direction, the thickness of the line segment to be actually printed corresponds to a large dot.

As described above, when the complementing process is performed using the same-array nozzle complementation mode, the information related to numeric values or characters of the bar code is changed to information different from the information to be originally shown.

For this reason, in the present embodiment, when the complementing process is required in the case of performing the printing process using the bar code printing mode, the complementing process using the same-array nozzle complementation mode is not performed and only the complementing processing using the different-color nozzle complementation mode or the same-color and different-array nozzle complementation mode is performed.

In FIG. 31, in a case where the determination result in Step S250 is negative, the complementing process using the different-color nozzle complementation mode or the same-color different-array nozzle complementation mode cannot be performed. For this reason, the control unit 6 controls operations of respective units of the ink jet printer 1 such that the maintenance process with respect to the nozzle N-TG is performed without performing the complementing process using the same-array nozzle complementation mode in a case where the determination result in Step S250 is negative (Step S270).

As described above, in the case of performing the printing process using the bar code printing mode, the control unit 6 selects a complementation mode in order of priority of the "same-color and different-array nozzle complementation mode (nozzle complementation mode)" and the "different-color nozzle complementation mode" and controls execution of the complementing process with respect to the nozzle N-TG using the selected complementation mode when ejection abnormality occurs in the ejection unit D.

In this manner, in the case of performing the printing process using the bar code printing mode, an error of a dot forming position between a dot to be formed by an ink ejected from one nozzle N included in one ejection unit D having ejection abnormality and a dot to be formed by an ink ejected from another nozzle N that complements the one nozzle N is small and a complementation mode with a small error in dot size, that is, the nozzle complementation mode or the different-color nozzle complementation mode is selected. For this reason, in the case of performing the printing process using the bar code printing mode, it is possible to minimize the extent of a difference between positions or shapes of an image shown by the print data PD and an image to be actually formed during the printing process even when the complementing process is performed.

That is, according to the present embodiment, in the case of performing the printing process using the bar code printing mode, the printing process can be performed such that information shown by a bar code to be formed when the complementing process for coping with ejection abnormality and information shown by a bar code to be formed when ejection abnormality has not occurred become the same as each other.

In addition, the order of priority of the complementation modes in the case where the printing process is performed using the bar code printing mode illustrated in FIG. 31 is merely an example and the order of priority may be in order of the "different-color nozzle complementation mode" and the "nozzle complementation mode."

5.3. Complementation Mode Determining Process Using Photo Printing Mode

Figure 32:
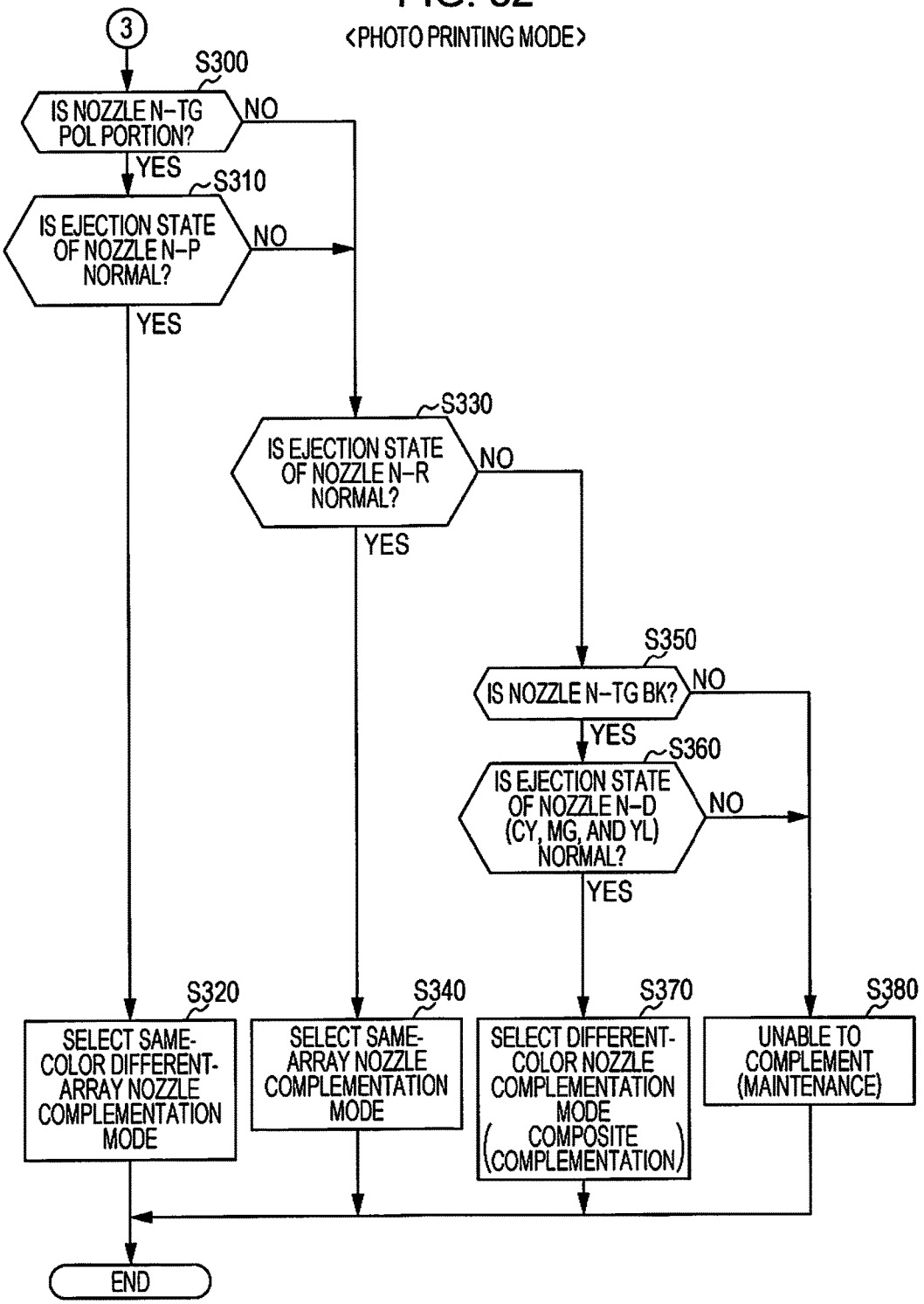
FIG. 32 is a flowchart for describing the complementation mode determining process in a photo printing mode.

FIG. 32 is a flowchart illustrating an example of the flow of the complementation mode determining process in the case where the printing process is performed using the photo printing mode.

The control unit 6 determines whether the ejection abnormality nozzle N-TG is an overlapping nozzle positioned in the POL portion in a case where the determination result in Step S30 is positive, that is, the printing mode is the photo printing mode (Step S300).

The control unit 6 determines whether the ejection state of the ejection unit D having the same-color different-array complementation nozzle N-P is normal, in other words, whether complementation of the nozzle N-TG with the nozzle N-P is possible by referring to the determination result signal Rs stored in the storage unit 62 in a case where the determination result in Step S300 is positive, that is, the nozzle N-TG is an overlapping nozzle (Step S310).

The control unit 6 selects the same-color and different-array nozzle complementation mode (Step S320) as a complementation mode and controls execution of the complementing process using the same-color and different-array nozzle complementation mode in a case where the determination result in Step S310 is positive, that is, complementation of the nozzle N-TG with the nozzle N-P is possible.

In addition, the same-color and different-array nozzle complementation mode selected in Step S320 is not limited to the nozzle complementation mode. That is, the nozzle N-P serving as a target for determination in Step S310 is a nozzle N belonging to the nozzle array Ln which is different from that of the nozzle N-TG and may be one or more nozzles N ejecting an ink having the same color as that of the nozzle N-TG.

As illustrated in FIG. 32, the control unit 6 determines whether the ejection state of the ejection unit D having the same-array complementation nozzle N-R is normal, in other words, whether complementation of the nozzle N-TG with the nozzle N-R is possible by referring to the determination result signal Rs stored in the storage unit 62 in a case where the determination result in Step S300 or S310 is negative, that is, the complementing process cannot be performed with respect to the nozzle N-TG using the same-color and different-array nozzle complementation mode (Step S330).

The control unit 6 controls execution of the complementing process using the same-array nozzle complementation mode by selecting the same-array nozzle complementation mode (Step S340) as the complementation mode in a case where the determination result in Step S330 is positive, that is, the complementation of the nozzle N-TG with the nozzle N-R is possible.

In addition, the same-array nozzle complementation mode selected in Step S340 is not limited to the adjacent nozzle complementation mode. That is, the nozzle N-R serving as a target of determination in Step S330 may be a nozzle N belonging to the nozzle array Ln which is the same as that of the nozzle N-TG and may be one or more nozzles N other than the nozzle N-TG.

As illustrated in FIG. 32, the control unit 6 determines whether the nozzle N-TG is a nozzle N ejecting a black (BK) ink in a case where the determination result in Step S330 is negative, that is, the complementing process cannot be performed with respect to the nozzle N-TG using the same-array nozzle complementation mode (Step S350).

The control unit 6 determines whether the ejection state of the ejection unit D having the different-color complementation nozzle N-D is normal, in other words, whether complementation of the nozzle N-TG with the nozzle N-D is possible by referring to the determination result signal Rs stored in the storage unit 62 in a case where the determination result in Step S350 is positive, that is, the nozzle N-TG is a nozzle N ejecting a black (BK) ink (Step S360).

The control unit 6 selects the different-color nozzle complementation mode (Step S370) as a complementation mode and controls execution of the complementing process using the different-color nozzle complementation mode in a case where the determination result in Step S360 is positive, that is, complementation of the nozzle N-TG with the nozzle N-D is possible.

Moreover, it is preferable that the photo printing mode is a printing mode for forming a photo recognized by the user of the printing system 100 as described above and an image having the same color as that of an image shown by the print data PD. Accordingly, in the present embodiment, the different-color nozzle complementation mode selected in Step S370 is limited to the composite complementation mode in which the color of the dot Dt-TG shown by the print data PD is black (BK) and the color of the dot Dt to be formed in place of the dot Dt-TG by performing the complementing process is black (BK). That is, the nozzles N-D serving as a target of determination in Step S360 are three nozzles N-D in one-to-one correspondence with cyan (CY), magenta (MG), and yellow (YL).

In a case where the determination result in Step S350 or S360 is negative, that is, in a case where the complementing process cannot be performed using the composite complementation mode with respect to the nozzle N-TG, the complementing process cannot be performed using any of the complementation modes of the ink jet printer 1. For this reason, as illustrated in FIG. 32, the control unit 6 controls operations of respective units of the ink jet printer 1 such that the maintenance process is performed with respect to the nozzle N-TG in the case where the determination result in Step S350 or S360 is negative (Step S380).

As described above, when ejection abnormality occurs in the ejection unit D in the case where the printing process is performed using the photo printing mode, the control unit 6 selects the complementation mode in order of priority of the "same-color and different-array nozzle complementation mode," the "same-array nozzle complementation mode," and the "different-color nozzle complementation mode (composite complementation mode)," and controls execution of the complementing process with respect to the nozzle N-TG using the selected complementation mode.

As described above, the photo printing mode is a printing mode for performing a printing process that prioritizes the reproducibility of the color of an image to be formed on the recording paper P more than the accuracy of the position or the shape of an image to be formed on the recording paper P.

In the present embodiment, in the case of performing the printing process using the photo printing mode, a complementation mode in which the color of a dot which is expected to be formed by an ink ejected from one nozzle included in one ejection unit D having ejection abnormality becomes the same as the color of a dot to be formed by an ink ejected from another nozzle N complemented with the one nozzle N, that is, the same-color and different-array nozzle complementation mode or the same-array nozzle complementation mode is preferentially selected. For this reason, in the case of performing the printing process using the photo printing mode, it is possible to minimize the extent of a difference between colors of an image shown by the print data PD and an image to be actually formed during the printing process even when the complementing process is performed. That is, in the case of performing the printing process using the photo printing mode, it is possible to minimize the extent of degradation in the image quality of a photo even when the complementing process is performed.

In addition, the order of priority of the complementation modes in the case where the printing process is performed using the photo printing mode illustrated in FIG. 32 is merely an example and the order of priority may be in order of the "same-array nozzle complementation mode," the "same-color and different-array nozzle complementation mode," and the "composite complementation mode."

5.4. Complementation Determining Process Using Figure

Figure 33:
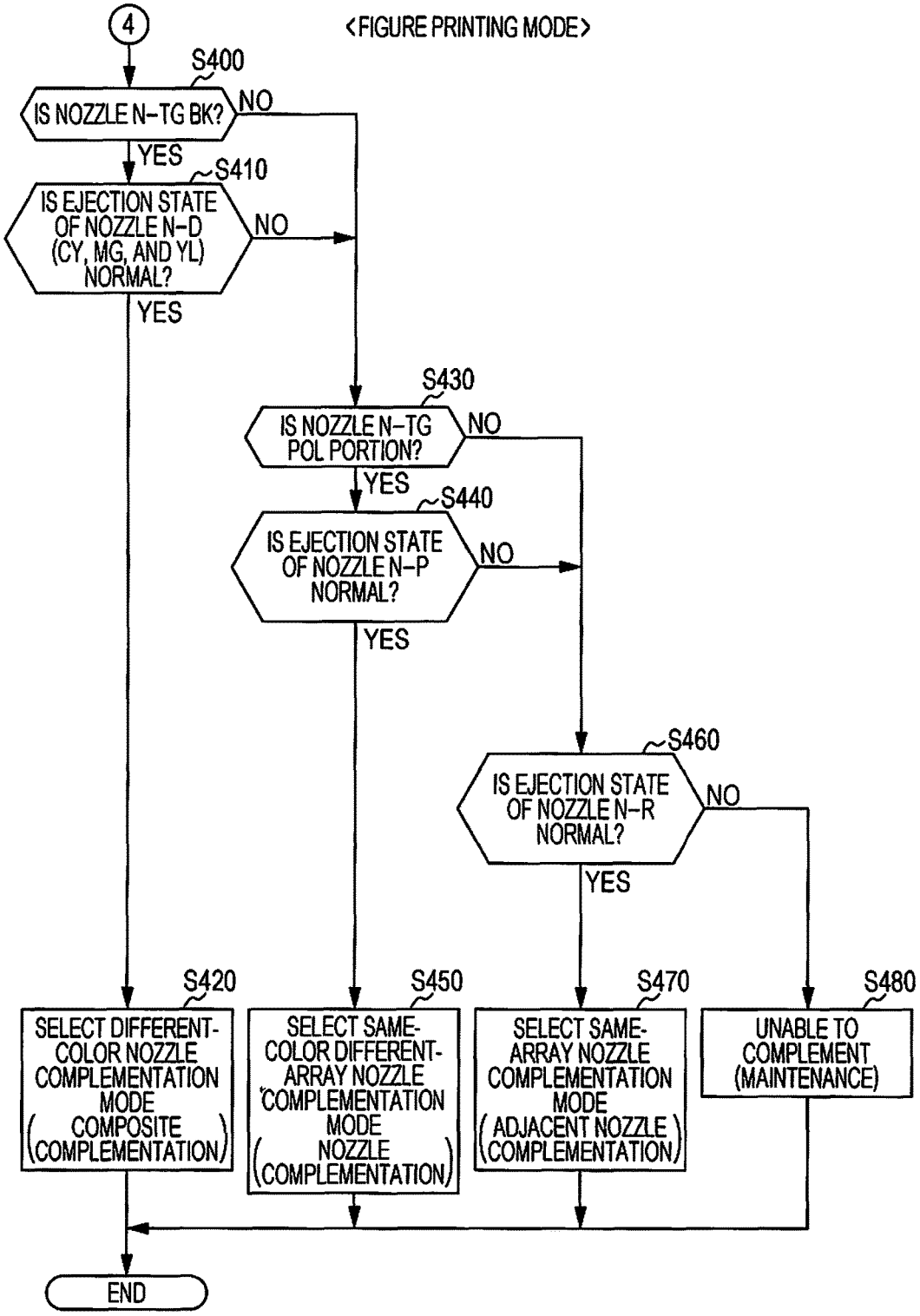
FIG. 33 is a flowchart for describing the complementation mode determining process in a figure printing mode.

FIG. 33 is a flowchart illustrating an example of the flow of the complementation mode determining process in the case where the printing process is performed using the figure printing mode.

As illustrated in FIG. 33, first, the control unit 6 determines whether the ejection abnormality nozzle N-TG is a nozzle N ejecting a black (BK) ink in a case where the determination result in Step S30 is negative, that is, the printing mode is the figure printing mode (Step S400).

The control unit 6 determines whether the ejection state of the ejection unit D having the different-color complementation nozzle N-D is normal, in other words, whether complementation of the nozzle N-TG with the nozzle N-D is possible by referring to the determination result signal Rs stored in the storage unit 62 in a case where the determination result in Step S400 is positive, that is, the nozzle N-TG is a nozzle N ejecting a black (BK) ink (Step S410).

The control unit 6 selects the different-color nozzle complementation mode (Step S420) as a complementation mode and controls execution of the complementing process using the different-color nozzle complementation mode in a case where the determination result in Step S410 is positive, that is, complementation of the nozzle N-TG with the nozzle N-D is possible.

Moreover, the figure printing mode is a printing mode for forming a figure such as a blueprint, a business form, or a graph recognized by the user of the printing system 100 as described above. Accordingly, in the present embodiment, the different-color nozzle complementation mode selected in Step S420 is limited to the composite complementation mode. That is, the nozzles N-D serving as a target of determination in Step S410 are three nozzles N-D in one-to-one correspondence with cyan (CY), magenta (MG), and yellow (YL).

As illustrated in FIG. 33, the control unit 6 determines whether the ejection abnormality nozzle N-TG is an overlapping nozzle positioned in the POL portion in a case where the determination result in Step S400 or S410 is negative, that is, the complementing process cannot be performed with respect to the nozzle-TG using the composite complementation mode (Step S430).

The control unit 6 determines whether the ejection state of the ejection unit D having the same-color different-array complementation nozzle N-P is normal, in other words, whether complementation of the nozzle N-TG with the nozzle N-P is possible by referring to the determination result signal Rs stored in the storage unit 62 in a case where the determination result in Step S430 is positive, that is, the nozzle N-TG is an overlapping nozzle (Step S440).

The control unit 6 selects the same-color and different-array nozzle complementation mode (Step S450) as a complementation mode and controls execution of the complementing process using the same-color and different-array nozzle complementation mode in a case where the determination result in Step S440 is positive, that is, complementation of the nozzle N-TG with the nozzle N-P is possible.

As described above, a figure such as a blueprint or a graph is an image for showing the shape or the position of an object. That is, in the figure printing mode, the accuracy of the position of the dot Dt to be formed in order to print a figure is important. Accordingly, in the present embodiment, the same-color and different-array nozzle complementation mode selected in Step S450 is limited to the nozzle complementation mode.

As illustrated in FIG. 33, the control unit 6 determines whether the ejection state of the ejection unit D having the same-array complementation nozzle N-R is normal, in other words, whether complementation of the nozzle N-TG with the nozzle N-R is possible by referring to the determination result signal Rs stored in the storage unit 62 in a case where the determination result in Step S430 or S440 is negative, that is, the complementing process cannot be performed with respect to the nozzle N-TG using the nozzle complementation mode (Step S460).

The control unit 6 controls execution of the complementing process using the same-array nozzle complementation mode by selecting the same-array nozzle complementation mode (Step S470) as the complementation mode in a case where the determination result in Step S460 is positive, that is, the complementation of the nozzle N-TG with the nozzle N-R is possible.

In addition, since the figure printing mode is a printing mode for performing the printing process that prioritizes the accuracy of the position or the shape, it is preferable that the dot Dt-TG which is expected to be formed by the nozzle N-TG and the dot Dt-R formed by the nozzle N-R complemented with the nozzle N-TG are as close as possible. For this reason, in the present embodiment, the same-array nozzle complementation mode selected in Step S470 is limited to the adjacent nozzle complementation mode.

In FIG. 33, in a case where the determination result in Step S460 is negative, the complementing process using any of the complementation modes of the ink jet printer 1 cannot be performed. For this reason, the control unit 6 controls operations of respective units of the ink jet printer 1 such that the maintenance process with respect to the nozzle N-TG is performed in a case where the determination result in Step S460 is negative (Step S480).

As described above, in the case of performing the printing process using the figure printing mode, the control unit 6 selects a complementation mode in order of priority of the "different-color nozzle complementation mode (composite complementation mode)," the "same-color and different-array nozzle complementation mode (nozzle complementation mode)," and the "same-color nozzle complementation mode (adjacent nozzle complementation mode)" and controls execution of the complementing process with respect to the nozzle N-TG using the selected complementation mode when ejection abnormality occurs in the ejection unit D.

In this manner, in the case of performing the printing process using the figure printing mode, an error of a dot forming position between a dot to be formed by an ink ejected from one nozzle N included in one ejection unit D having ejection abnormality and a dot to be formed by an ink ejected from another nozzle N that complements the one nozzle N is small and a complementation mode with a small error in dot size, that is, the composite complementation mode or the nozzle complementation mode is preferentially selected. For this reason, in the case of performing the printing process using the figure printing mode, it is possible to minimize the extent of a difference between positions or shapes of an image shown by the print data PD and an image to be actually formed during the printing process even when the complementing process is performed.

That is, according to the present embodiment, in the case of performing the printing process using the figure printing mode, the printing process can be performed such that the position or the shape of a figure to be formed in the case of performing the complementing process for coping with ejection abnormality and the position or the shape of a figure to be formed when ejection abnormality has not occurred become the same as each other.

In addition, the order of priority of the complementation modes in the case where the printing process is performed using the figure printing mode illustrated in FIG. 33 is merely an example and the order of priority may be in order of the "nozzle complementation mode," the "composite complementation mode," and the "adjacent nozzle complementation mode."

Among respective processes illustrated in FIGS. 29 to 33, Steps S110, S140, S160, S230, S250, S310, S330, S360, S410, S440, and S460 are referred to as a complementation propriety determining process described above. The control unit 6 functions as a complementation propriety determining unit 61 (an example of the "determining unit") by performing the complementation propriety determining process.

Further, the control unit 6 controls execution of a part or the entire printing process, the ejection state determining process, and the complementing process or functions as the print control unit 60 by performing a part or the entire complementation mode determining process and the complementation propriety determining process.

6. Conclusion of First Embodiment

As described above, the ink jet printer 1 according to the present embodiment includes a plurality of complementation modes. For this reason, the ink jet printer 1 according to the present embodiment can perform the complementing process using an appropriate complementation mode according to an image to be printed by the ink jet printer 1 compared to an ink jet printer having only a single complementation mode. In this manner, the ink jet printer 1 according to the present embodiment can form an excellent image with high quality compared to an image to be formed in a case where the ejection state of the 8M ejection units D is normal and the printing process is performed without performing the complementing process even when ejection abnormality occurs in the ejection unit D and the complementing process is performed.

B. Second Embodiment

The ink jet printer 1 according to the first embodiment described above selects one printing mode for each printing area included in the recording paper P according to an image formed on the printing area and performs the printing process using the selected printing mode. In addition, the ink jet printer 1 according to the first embodiment determines the complementation mode according to the selected printing mode.

Meanwhile, in a case where an image to be formed on one printing area has a plurality of partial images, an ink jet printer according to a second embodiment divides one printing area into a plurality of partial printing areas in one-to-one correspondence with the plurality of partial images. Further, the ink jet printer according to the second embodiment selects a printing mode for each partial printing area according to the kind of partial image to be formed on each partial printing area and performs the printing process with respect to the partial printing area using the selected printing mode. In other words, the ink jet printer according to the second embodiment can perform the printing process with respect to one printing area using two or more printing modes. Further, the ink jet printer according to the second embodiment determines the complementation mode for each partial printing area according to the selected printing mode.

Hereinafter, the printing process, the complementing process, and the complementation mode determining process according to the second embodiment will be described with reference to FIG. 35.

In addition, the ink jet printer according to the second embodiment is the same as the ink jet printer 1 except that the mode of the printing process according to the second embodiment is different from that of the printing process thereof. In the second embodiment described below, elements whose operations and functions are the same as those in the first embodiment are denoted by the same reference numerals described above and the description thereof will not be repeated (the same applies to modification examples described below).

Figure 35:
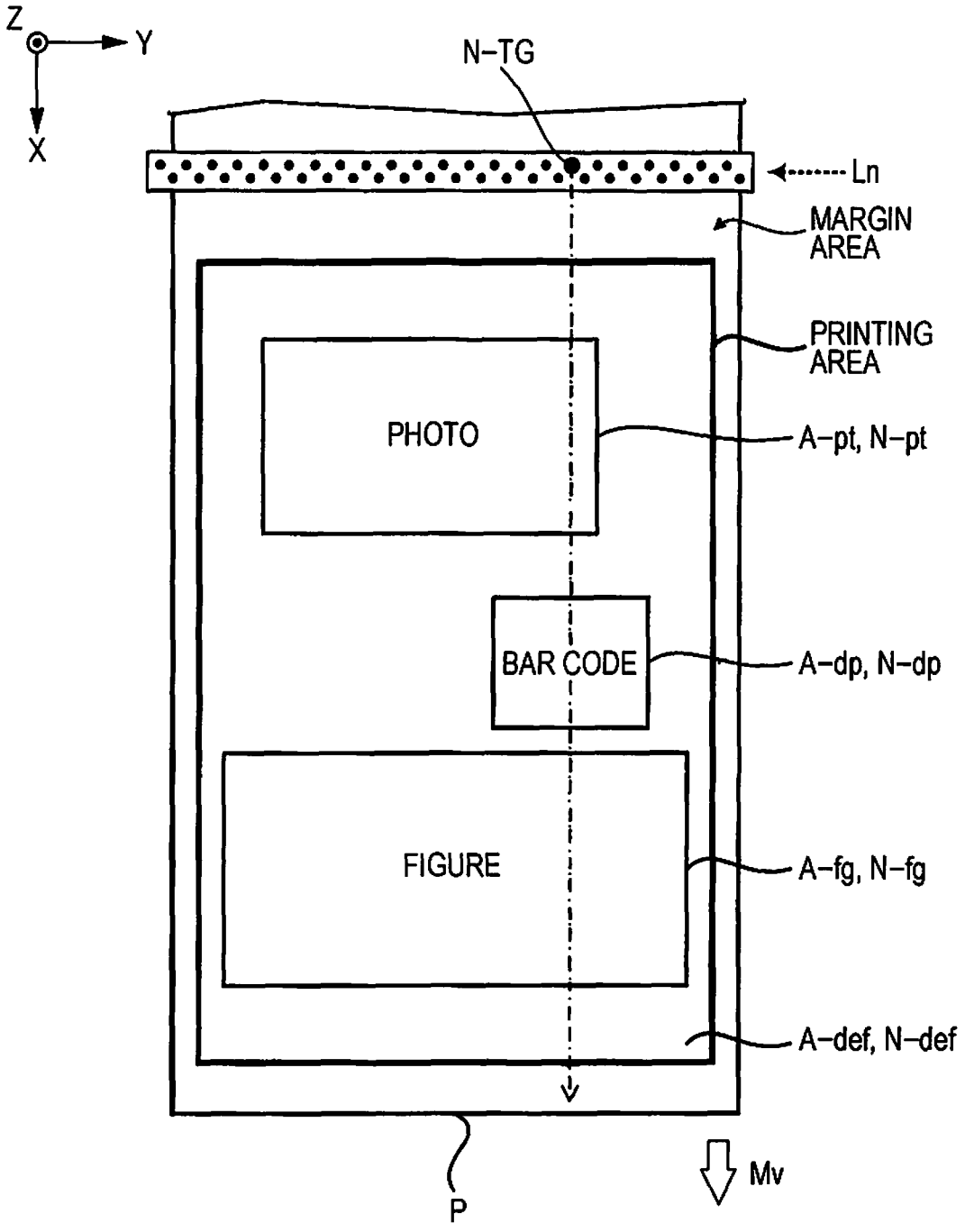
FIG. 35 is an explanatory diagram for describing a printing process and a complementing process performed by an ink jet printer according to a second embodiment of the invention.

FIG. 35 is an explanatory diagram for describing the printing process according to the second embodiment. In addition, in FIG. 35, for convenience of illustration, only one array among eight nozzle arrays Ln (Ln-BK1 to Ln-YL2) included in the recording head 30 is representatively illustrated.

FIG. 35 illustrates a case where an image to be formed in the printing area of the recording medium P has a bar code, a photo, and a figure.

As illustrated in FIG. 35, in the case where an image to be formed in the printing area has a bar code, a photo, and a figure, the ink jet printer according to the second embodiment divides the printing area into four partial printing areas, which are a data pattern area A-dp in which a data pattern of a bar code is formed; a photo forming area A-pt in which a photo is formed; a figure forming area A-fg in which a figure is formed; and a normal printing area A-def which is an area other than the above-described three areas and is an area in which an image (hereinafter, referred to as a "normal image") other than a bar code, a photo, and a figure is formed. The bar code, photo, figure, and normal image formed in each partial printing area are examples of partial images.

The control unit 6 assigns each nozzle N provided in the recording head 30 to any one kind of nozzle N among a data pattern printing nozzle N-dp for forming a bar code in the data pattern area A-dp; a photo forming nozzle N-pt for forming a photo in the photo forming area A-pt; a figure forming nozzle N-fg for forming a figure in the figure forming area A-fg; and a normal printing nozzle N-def for forming a normal image in the normal printing area A-def for each unit operation period Tu for which the printing process is performed.

For example, the nozzle N-TG illustrated in FIG. 35 is assigned to the data pattern printing nozzle N-dp when the data pattern area A-dp of the recording paper P is positioned on the lower side (−Z direction) of the nozzle N-TG, assigned to the photo forming nozzle N-pt when the photo forming area A-pt of the recording paper P is positioned on the lower side of the nozzle N-TG, assigned to the figure forming nozzle N-fg when the figure forming area A-fg of the recording paper P is positioned on the lower side of the nozzle N-TG, and assigned to the normal printing nozzle N-def when the normal printing area A-def is positioned on the lower side of the nozzle N-TG.

The control unit 6 generates the printing signal SI according to the assignment with respect to each nozzle N. Specifically, the control unit 6 generates the printing signal SI to control the operation of an ejection unit D such that the printing process is performed using the bar code printing mode with respect to the ejection unit D having a nozzle N assigned to the data pattern printing nozzle N-dp; control the operation of an ejection unit D such that the printing process is performed using the photo printing mode with respect to the ejection unit D having a nozzle N assigned to the photo forming nozzle N-pt; control the operation of an ejection unit D such that the printing process is performed using the figure printing mode with respect to the ejection unit D having a nozzle N assigned to the figure forming nozzle N-fg; and control the operation of an ejection unit D such that the printing process is performed using the normal printing mode with respect to the ejection unit D having a nozzle N assigned to the normal printing nozzle N-def.

Further, similar to the first embodiment, the control unit 6 controls execution of the complementing process that complements the nozzle N-TG included in an ejection unit D with another nozzle N in a case where ejection abnormality occurs in the ejection unit D.

Specifically, the control unit 6 determines a complementation mode by performing the complementation mode determining process in the case of the bar code printing mode illustrated in FIG. 31 and controls execution of the complementing process with respect to the nozzle N-TG using the determined complementation mode in a case where the data pattern area A-dp of the recording paper P is positioned on the lower side of the nozzle N-TG and the nozzle N-TG is assigned to the data pattern printing nozzle N-dp.

Further, the control unit 6 determines a complementation mode by performing the complementation mode determining process in the case of the photo printing mode illustrated in FIG. 32 and controls execution of the complementing process with respect to the nozzle N-TG using the determined complementation mode in a case where the photo forming area A-pt of the recording paper P is positioned on the lower side of the nozzle N-TG and the nozzle N-TG is assigned to the photo forming nozzle N-pt.

Further, the control unit 6 determines a complementation mode by performing the complementation mode determining process in the case of the figure printing mode illustrated in FIG. 33 and controls execution of the complementing process with respect to the nozzle N-TG using the determined complementation mode in a case where the figure forming area A-fg of the recording paper P is positioned on the lower side of the nozzle N-TG and the nozzle N-TG is assigned to the figure forming nozzle N-fg.

Further, the control unit 6 determines a complementation mode by performing the complementation mode determining process in the case of the normal printing mode illustrated in FIG. 30 and controls execution of the complementing process with respect to the nozzle N-TG using the determined complementation mode in a case where the normal printing area A-def of the recording paper P is positioned on the lower side of the nozzle N-TG and the nozzle N-TG is assigned to the normal printing nozzle N-def.

As described above, since the ink jet printer according to the second embodiment performs the printing process using a printing mode according to the kind of partial image and performs the complementing process using a complementation mode according to the kind of partial image in a case where a plural kinds of partial images such as a bar code, a photo, and a figure are formed in the printing area, the image quality of the plural kinds of partial images can be improved as a whole compared to the ink jet printer 1 according to the first embodiment.

C. MODIFICATION EXAMPLES

The above-described respective aspects may be variously modified. Aspects of specific modifications will be exemplified below. Two or more aspects which are randomly selected from the following exemplified modifications may be appropriately combined with each other within the scope without mutual conflict.

Modification Example 1

In the above-described embodiments, the ejection abnormality nozzle N-TG serving as a target of the complementing process is limited to the data pattern printing nozzle N-dp in the case where the printing process is performed using the bar code printing process. However, the invention is not limited to the aspect and nozzle N other than the data pattern printing nozzle N-dp may be used as targets of the complementing process.

Specifically, in a case where an ejection unit D having a nozzle N ejecting a black (BK) ink or a cyan (CY) ink, the complementing process may be performed with respect to the nozzle N regardless of whether the nozzle N is the data pattern printing nozzle N-dp. In other words, the process of Step S200 illustrated in FIG. 31 may not be performed in the complementation mode determining process.

Modification Example 2

In the above-described embodiments and Modification Example, the case where the ink jet printer includes four ink cartridges 31 corresponding to each of the four colors CMYK has been exemplified, but the invention is not limited to the aspect and may include three or less or five or more ink cartridges 31 respectively corresponding to inks having three colors or less or five colors or more. In addition, the ink jet printer may include an ink cartridge 31 filled with an ink whose color is different from the four colors CMYK or may include only an ink cartridge 31 corresponding to an ink whose color is a part of the four colors.

Further, in the above-described embodiments and Modification Examples, a black (BK) ink and a cyan (CY) ink are exemplified as an ink forming a bar code, but any ink can be used as long as the ink forming a bar code has a color capable of absorbing light having a predetermined wavelength (red light) applied from a bar code reader. For example, purple, blue, and green inks may be employed as the ink forming a bar code.

In this case, in the bar code printing mode, when the complementing process is performed using the different-color nozzle complementation mode, the nozzles N-D that complements the nozzle N-TG may include a nozzle N ejecting an ink having a color capable of absorbing light (red light) with a predetermined wavelength applied from a bar code reader, for example, purple, blue, or green exemplified in Modification Example.

Modification Example 3

In the above-described embodiments and Modification Examples, the ink jet printer can perform the perform the printing process using four printing modes of the normal printing mode, the bar code printing mode, the photo printing mode, and the figure printing mode, but the invention is not limited to the aspect and the ink jet printer may perform the printing process using at least one printing mode.

However, since the ink jet printer according to the second embodiment divides one printing area into a plurality of partial printing areas and selects a printing mode for each partial printing area, it is preferable that the printing process using two or more printing modes can be performed.

Modification Example 4

In the above-described embodiments and Modification Examples, the ink jet printer can perform the complementing process using three complementation modes of the same-array nozzle complementation mode, the different-color nozzle complementation mode, and the same-color and different-array nozzle complementation mode, but the invention is not limited to the aspect and the ink jet printer may perform the complementing process using at least two complementation modes among these three complementation modes.

Modification Example 5

In the above-described embodiments and Modification Examples, the recording head 30 includes eight nozzle arrays Ln (Ln-BK1 to Ln-YL2), but the invention is not limited to the aspect and the recording head 30 may include at least two nozzle arrays Ln.

Further, in the above-described embodiments and Modification Examples, the recording head 30 includes two nozzle arrays Ln having nozzles N ejecting inks having the same color, but the recording head 30 may include only one nozzle array Ln having nozzles N ejecting inks having the same color. That is, only one nozzle array Ln may be provided for each color of ink. In this case, each nozzle array Ln does not include a POL portion and is formed of only a non-POL portion.

In addition, the recording head 30 includes two nozzle arrays Ln having nozzles N ejecting ink having the same color and each nozzle array Ln may be formed of only a POL portion without a non-POL portion.

Modification Example 6

In the above-described embodiments and Modification Examples, the example in which the recording head 30 includes nozzle arrays Ln made by M nozzles N being arranged in a zigzag has been described as nozzle groups (Ln-BK1 to Ln-YK2) formed in the nozzle forming area (R-BK1 to R-YL2), but the invention is not limited thereto and the M nozzles N constituting the nozzle groups may be arranged in any form in the nozzle forming area.

For example, M nozzles N constituting nozzle groups may be linearly arranged in one array in the nozzle forming area in the Y axis direction. Further, the M nozzles N constituting the nozzle groups may be arranged in a matrix in the nozzle forming area.

Modification Example 7

In the above-described embodiments and Modification Examples, the print data generating unit 90 is provided in the host computer 9, but may be provided in the ink jet printer. That is, the control unit 6 may perform a print data generating process. In this case, for example, the print data generating unit 90 may be a functional block realized when the control unit 6 of the ink jet printer performs a control program of the ink jet printer which is stored in the storage unit 62.

Modification Example 8

In the above-described embodiments and Modification Examples, the operation periods of the ink jet printer are formed of the unit operation period Tu for which the printing process is performed and the unit operation period Tu for which the ejection state determining process is performed, but the invention is not limited to the aspect and the printing process and the ejection state determining process may be performed at the same unit operation period Tu. That is, the operation periods of the ink jet printer may include a unit operation period Tu for which both of the printing process and the ejection state determining process are performed.

In this case, for example, the ejection state determining process may be performed only with respect to non-recording ejection units D by supplying the driving signal Vin for printing to ejection units D forming dots and supplying the driving signal Vin for inspection having the waveform DpT instead of the driving signal Vin for printing having the waveform DpBB formed of the unit waveform PB1 and the unit waveform PB2 to non-recording ejection units D which do not form dots (see FIG. 19).

Modification Example 9

The ink jet printer according to the above-described embodiments and Modification Examples forms images in each printing area by dividing the recording paper P into a plurality of printing areas and the margin area partitioning the plurality of printing areas during the printing process, but the invention is not limited to the aspect and one image may be formed in the entire recording paper P.

The recording paper P according to the above-described embodiments and Modification Examples has a long shape but may have a square shape such as A4-size paper. In this case, the transport mechanism 7 may supply a plurality sheets of recording paper P to the platen 74 intermittently when the printing process is performed. In this case, one image may be formed on one sheet of recording paper P during the printing process. Further, in this case, the unit operation period Tu for which the ejection state determining process is performed may be a period (that is, a period for which the recording paper P is not present on the platen 74) from when one sheet of recording paper P is supplied to the platen 74 to when different recording paper P is supplied to the platen 74 for the first time after the one sheet of recording paper P.

Modification Example 10

In the above-described embodiments and Modification Examples, the ejection state determining process is performed with the assumption of so-called "non-ejection inspection" which means that determination on the ejection state of an ink in the ejection unit D is made based on the residual vibration generated in the ejection unit D when the ejection unit D is driven such that the ink is not ejected, but the invention is not limited to the aspect and the ejection state determining process is performed with the assumption of so-called "ejection inspection" which means that determination on the ejection state of an ink in the ejection unit D is made based on the residual vibration generated in the ejection unit D when the ejection unit D is driven such that the ink is ejected.

For example, the following two aspects can be exemplified as specific aspects in a case of performing the ejection state determining process using the ejection inspection.

A first aspect is an aspect in which the ejection state determining process is performed by detecting the residual vibration generated in the ejection unit D when an ejection unit D ejects an ink for forming an image shown by the print data PD during the printing process. In the first aspect, the ejection state determining process is performed during the printing process.

A second aspect is an aspect in which the ejection state determining process is performed by allowing an ejection unit D to eject an ink and detecting the residual vibration generated in the ejection unit D at the timing at which the printing process is not performed.

In the second aspect, when the ink ejected from the ejection unit D for the ejection state determining process is impacted in the printing area of the recording paper P, the image quality of an image to be formed on the recording paper P is degraded. For this reason, in the second aspect, it is necessary for the ink ejected from the ejection unit D for ejection state determining process not to impact in the printing area of the recording paper P. In order for the ink ejected from the ejection unit D during the ejection state determining process not to impact on the printing area, for example, the ink jet printer includes a moving mechanism that moves the carriage 32 on which the head unit 5 having the recording head 30 is mounted and then the ejection state determining process is performed after the carriage 32 is moved to a position in which the ink ejected from the ejection unit D is not impacted on the printing area. Further, in order for the ink ejected from the ejection unit D not to impact on the printing area during the ejection state determining process, for example, the ejection state determining process may be performed at the timing other than the unit operation period Tu for which the printing process is performed.

Modification Example 11

In the above-described embodiments and Modification Examples, the head driver 50 generates the driving signals Vin supplied to a plurality (8M) of ejection units D based on the same driving waveform signals Com, but the invention is not limited to the aspect.

The head driver 50 may generate the driving signals Vin for each nozzle group based on a plurality of driving waveform signals Com in one-to-one correspondence with the plurality of nozzle groups (nozzle array Ln). In this case, the control unit 6 may supply the plurality of driving waveform signals Com in one-to-one correspondence with the plurality of nozzle groups to the head driver 50. Moreover, in this case, the head driver 50 may include a plurality of driving signal generating units 51 in one-to-one correspondence with the plurality of nozzle groups. Further, in this case, the timing (that is, timing at which the latch signal LAT becomes active) at which the unit operation period Tu is started may be different for each nozzle group.

Further, the head driver 50 may generate driving signals Vin for each color of ink based on the plurality of driving waveform signals Com in one-to-one correspondence with plural colors of inks which can be ejected by the ink jet printer. In this case, the control unit 6 may supply the plurality of driving waveform signals Com in one-to-one correspondence with the plural colors of inks to the head driver 50. Further, in this case, the head driver 50 may include a plurality of driving signal generating units 51 in one-to-one correspondence with plural colors of inks.

Modification Example 12

In the above-described embodiments and Modification Examples, the ejection abnormality detecting unit 52 includes a plurality of ejection abnormality detection circuit CT in one-to-one correspondence with a plurality (8M) of ejection units D, but the invention is not limited to the aspect and the ejection abnormality detecting unit 52 may include at least one ejection abnormality detection circuit CT.

In this case, the control unit 6 selects one ejection unit D from the plurality of ejection units D as a target of the ejection state determining process during one unit operation period Tu for which the ejection state determining process is performed and may supply the switching control signal Sw to the switching unit 53 such that the selected ejection unit D is electrically connected with the ejection abnormality detection circuit CT.

Modification Example 13

In the above-described embodiments and Modification Examples, determination of the ejection state of an ink in the ejection unit D is performed by the ejection state determining unit 56, but the invention is not limited to the aspect, and the ejection state may be determined in the control unit 6.

In a case where the control unit 6 determines the ejection state, the ejection abnormality detection circuit CT may not include the ejection state determining unit 56, and a detection signal Tc generated by the detecting unit 55 may be output to the control unit 6.

Modification Example 14

In the above-described embodiments and Modification Examples, driving signal waveform signals Com includes three signals of Com-A, Com-B, and Com-C, but the invention is not limited to the aspect. The driving signal waveform signal Com may include one signal (for example, only Com-A) or may include two or more signals (for example, Com-A and Com-B).

In addition, in the above-described embodiments and Modification Examples, the control unit 6 simultaneously supplies, as the driving waveform signals Com, the driving waveform signals Com-A and Com-B (hereinafter, referred to as driving waveform signals for printing) for generating a driving signal Vin for printing along with the driving waveform signal Com-C (hereinafter, referred to as a "driving waveform signal for inspection") for generating a driving signal Vin for inspection in each unit operation period Tu, and the invention is not limited to the aspect.

For example, in a case where the printing process is performed in a certain unit operation period Tu, the control unit 6 supplies the driving waveform signal Com (for example, the driving waveform signals Com including only Com-A and Com-B) including the driving waveform signals for printing and, in a case where the ejection state determining process is performed in a certain unit operation period Tu, the control unit supplies the driving waveform signals Com (for example, the driving waveform signal Com including only Com-C) including only the driving waveform signal for inspection. As described above, a waveform of each signal included in the driving waveform signals Com may be changed depending on the type of process performed in each unit operation period Tu.

In addition, the number of bits of the printing signal SI is not limited to 3 bits, and may be appropriately determined according to the grayscale to be displayed or the number of signals included in the driving waveform signal Com.

Modification Example 15

In the above-described embodiments and Modification Examples, the ink jet printer ejects an ink from a nozzle N by vibrating the vibration plate 310 of the piezoelectric element 300, but the invention is not limited to the aspect. For example, a so-called thermal system in which an ink is ejected by heating a heating element (not illustrated) provided in the cavity 320 to generate bubbles in the cavity 320 and increasing the pressure in the inside of the cavity 320 may be employed.

According to an aspect of the embodiment, there is provided a printing apparatus that performs a printing process of ejecting a liquid from a nozzle to a medium and forming an image on the medium, the printing apparatus including: a head unit that includes a first nozzle group including a first nozzle which ejects a liquid having a first color, a second nozzle group including a second nozzle which ejects a liquid having a second color, and a third nozzle group including a third nozzle which ejects a liquid having the first color; and a print control unit that controls execution of the printing process, in which, in a case where execution of the printing process is controlled, when an ejection state of the liquid ejected from one nozzle which belongs to the first nozzle group, ejects the liquid having the first color, and is different from the first nozzle is abnormal, the print control unit is capable of performing complementation using at least two or more complementation modes from among a first complementation mode that performs complementation with respect to the one nozzle by increasing the amount of a liquid to be ejected from the first nozzle instead of allowing the one nozzle to eject the liquid, a second complementation mode that performs complementation with respect to the one nozzle by increasing the amount of the liquid to be ejected from the second nozzle instead of allowing the one nozzle to eject the liquid, and a third complementation mode that performs complementation with respect to the one nozzle by increasing the amount of the liquid to be ejected from the third nozzle instead of allowing the one nozzle to eject the liquid from the one nozzle.

The printing apparatus according to the embodiment is capable of performing complementation using a plurality of complementation modes. That is, in a case where the ejection state of a liquid ejected from one nozzle is abnormal, it is possible to select a nozzle for complementing the one nozzle from at least two nozzles among the first nozzle, the second nozzle, and the third nozzle. Accordingly, it is possible to minimize the possibility that complementation cannot be performed compared to a case where the printing apparatus can perform complementation using only a single complementation mode. In this manner, it is possible to minimize the extent of a decrease in the image quality of an image to be formed on a medium compared to the case where the printing apparatus can perform complementation using only a single complementation mode.

Further, since the printing apparatus according to the embodiment is capable of performing complementation using a plurality of complementation modes, it is possible to select a complementation mode according to the kind of image to be formed on the medium. Accordingly, since the possibility that complementation according to the kind of image to be formed on the medium is increased compared to the case where the printing apparatus can perform complementation using only a single complementation mode, it is possible to minimize the extent of a decrease in the image quality of an image to be formed on the medium.

In addition, the case where the ejection state of a liquid ejected from a nozzle is abnormal includes a case where a liquid cannot be ejected from a nozzle and a case where an ejecting direction of a liquid from a nozzle is different from an original ejecting direction, and, in other words, means a case where a liquid cannot be normally ejected from a nozzle.

Moreover, increasing the amount of a liquid to be ejected from a nozzle means ejecting a larger amount of liquid expected to be ejected from the nozzle in the printing process and ejecting a liquid from the nozzle for performing complementation with respect to one nozzle although the nozzle is expected not to eject a liquid in the printing process.

The printing apparatus may further include a transport mechanism that transports the medium in a first direction, the first nozzle group may be provided in a first area that extends in a second direction intersecting with the first direction in the head unit, the second nozzle group may be provided in a second area that extends in the second direction in the head unit, and the third nozzle group may be provided in a third area that extends in the second direction in the head unit.

In a printing apparatus such as a line printer in which a direction where a medium is transported (first direction) intersects a direction where an area in which a plurality of nozzles constituting a nozzle group are provided (second direction) is extended, dots formed by a liquid ejected from respective nozzles are linearly arranged in the direction where the medium is transported (first direction). For this reason, in a case where ejection abnormality in which the ejection state of a liquid ejected from a nozzle becomes abnormal occurs and dots are not formed in a position corresponding to the nozzle, and for example, a linear white stripe extending in the first direction is formed on the medium and the image quality of an image to be formed on the medium is largely degraded.

Since the printing apparatus according to the aspect is capable of performing complementation using a plurality of complementation modes, it is possible to minimize the possibility that complementation cannot be performed compared to a case where the printing apparatus can perform complementation using only a single complementation mode. For this reason, it is possible to minimize the possibility of formation of a white stripe or the like which largely degrades the image quality of an image to be formed on the medium compared to a case where the printing apparatus can perform complementation using only a single complementation mode.

In the printing apparatus, the print control unit may be capable of controlling execution of the printing process using various kinds of printing modes including a first printing mode that prioritizes accuracy of the position or the shape of an image to be formed on the medium more than the accuracy of the color of an image to be formed on the medium and a second printing mode that prioritizes the accuracy of the color of an image to be formed on the medium more than the accuracy of the position or the shape of an image to be formed on the medium, and complementation with respect to the nozzle may be performed using the complementation mode according to the kind of printing mode among two or more complementation modes when the ejection state of the liquid from the one nozzle is abnormal.

Since the printing apparatus according to the aspect performs complementation using a complementation mode according to a printing mode among the plurality of complementation modes, the possibility that complementation can be performed according to the kind of image to be formed on the medium becomes higher compared to the case where the printing apparatus can perform complementation using only a single complementation mode. Accordingly, it is possible to minimize the extent of a decrease in image quality of an image to be formed on the medium.

In the printing apparatus, the two or more complementation modes may include the first complementation mode, the second complementation mode, and the third complementation mode, the print control unit may perform complementation with respect to the one nozzle by prioritizing the second complementation mode or the third complementation mode more than the first complementation mode when the ejection state of the liquid ejected from the one nozzle is abnormal in the case of controlling execution of the printing process using the first printing mode, and the print control unit may perform complementation with respect to the one nozzle by prioritizing the first complementation mode or the third complementation mode more than the second complementation mode when the ejection state of the liquid ejected from the one nozzle is abnormal in the case of controlling execution of the printing process using the second printing mode.

The one nozzle and the first nozzle are both formed in the first area extending in the second direction which is different from the first direction in which the medium is transported. Accordingly, in a case where complementation is performed using the first complementation mode in which the one nozzle is complemented with the first nozzle, dots formed by the first nozzle are formed in a position different from the position of dots which are expected to be formed by the one nozzle. Therefore, in many cases, the complementation using the first complementation mode is not suitable for the printing process using the first printing mode for prioritizing the accuracy of the position or the shape of an image to be formed on the medium.

Further, the one nozzle ejects a liquid having a color different from the color of a liquid ejected from the second nozzle. For this reason, in a case where complementation is performed using the second complementation mode that complements the one nozzle with the second nozzle, dots formed by the second nozzle have a color different from the color of dots which are expected to be formed by the one nozzle. Accordingly, in many cases, the complementation using the second complementation mode is not suitable for the printing process using the second printing mode for prioritizing the accuracy of the color of an image to be formed on the medium.

In the printing apparatus according to the aspect, in the case where the printing process is performed using the first printing mode, the complementation is performed by prioritizing the second complementation mode or the third complementation mode more that the first complementation mode which is not suitable for the printing process using the first printing mode. In addition, in the case where the printing process is performed using the second printing mode, the complementation is performed by prioritizing the first complementation mode or the third complementation mode more than the second complementation mode which is not suitable for the printing process using the second printing mode. That is, in the printing apparatus according to the aspect, it is possible to perform complementation according to the kind of image to be formed on the medium and to minimize the extent of a decrease in image quality of an image to be formed on the medium.

In the printing apparatus, the two or more complementation modes may include the first complementation mode, the second complementation mode, and the third complementation mode, and the print control unit may perform complementation with respect to the one nozzle using the second complementation mode or the third complementation mode in a case where at least a part of an image to be formed on the medium in the printing process is a bar code and the ejection state of the liquid ejected from the one nozzle is abnormal when at least a part of the bar code is formed using the liquid ejected from the one nozzle.

A bar code shows information such as numeric values or characters by a pattern of the bar code. For this reason, in the case where a bar code is printed, a printing process that prioritizes the accuracy of the position or the shape of an image to be formed needs to be performed.

In the printing apparatus according to the aspect, complementation is performed using the second complementation mode or the third complementation mode by excluding the first complementation mode which is not suitable for the printing process for prioritizing the accuracy of the position or the shape of an image to be formed on the medium in a case of printing a bar code using a liquid to be ejected from one nozzle. Accordingly, in the printing apparatus according to the aspect, even in a case of performing complementation with respect to one nozzle, it is possible to perform a printing process in which the accuracy of the position or the shape of an image showing a bar code is secured.

In the printing apparatus, in which the two or more complementation modes may include the first complementation mode, the second complementation mode, and the third complementation mode, the print control unit may be capable of controlling execution of the printing process using a bar code printing mode for forming a bar code on the medium, and the print control unit may perform complementation with respect to the one nozzle using the second complementation mode or the third complementation mode in a case where execution of the printing process is controlled using the bar code printing mode and the ejection state of the liquid ejected from the one nozzle is abnormal.

In the case of performing the printing process using the bar code printing mode, it is necessary to perform the printing process that prioritizes the accuracy of the position or the shape of an image to be formed.

In the printing apparatus according to the aspect, in a case where the printing process is performed using the bar code printing mode, the first complementation mode which is not suitable for the printing process for prioritizing the accuracy of the position or the shape of an image to be formed on the medium is excluded and complementation is performed using the second complementation mode or the third complementation mode. Accordingly, even in a case of performing complementation with respect to one nozzle, the printing apparatus according to the aspect can perform the printing process in which the accuracy of the position or the shape of an image showing a bar code is secured.

In addition, the printing apparatus may further include a determining unit that determines whether execution of complementation using each of the two or more complementation modes is possible, the print control unit may perform complementation with respect to the one nozzle using the second complementation mode when the determining unit determines that execution of complementation with respect to the one nozzle using the second complementation mode is possible and performs complementation with respect to the one nozzle using the third complementation mode when the determining unit determines that execution of complementation with respect to the one nozzle using the second complementation mode is impossible in a case where the ejection state of the liquid ejected from the nozzle is abnormal when at least a part of the bar code is formed using the liquid ejected from the one nozzle.

According to the aspect, complementation is performed by prioritizing the second complementation mode, suitable for the printing process that prioritizes the accuracy of the position or the shape of an image to be formed, more than the third complementation mode.

Accordingly, even in a case of performing complementation with respect to one nozzle, in the printing apparatus according to the aspect can perform the printing process in which the accuracy of the position or the shape of an image showing a bar code is secured.

In the printing apparatus, the print control unit may perform complementation with respect to the one nozzle using any complementation mode among the two or more complementation modes in a case where the ejection state of the liquid ejected from the one nozzle is abnormal when a portion of a bar code other than an end portion is formed using the liquid ejected from the one nozzle and may not perform complementation with respect to the one nozzle in a case where the ejection state of the liquid ejected from the one nozzle is abnormal when the end portion of the bar code is formed using the liquid ejected from the one nozzle in a case where the bar code is formed on the medium in the printing process.

A bar code shows information such as numeric values or characters using the pattern provided in a part of the bar code other than the end portion.

In the printing apparatus according to the aspect, in a case of forming a portion of the bar code other than the end portion using the liquid ejected from one nozzle, complementation is performed with respect to the one nozzle. In addition, in a case of forming the end portion of the bar code using the liquid ejected from the one nozzle, complementation is not performed with respect to the one nozzle. Accordingly, it is possible to simplify the process performed by the printing apparatus and to shorten the processing time of the printing process compared to the case of performing complementation with respect to the one nozzle when the end portion of the bar code is formed by the liquid ejected from the one nozzle.

In the printing apparatus, the liquid having the first color and the liquid having the second color may absorb light having a predetermined wavelength.

A bar code is an image to be read by a bar code reader. Specifically, the bar code reader acquires information such as numeric values or characters indicated by the pattern of the bar code by irradiating the bar code with light having a predetermined wavelength and detecting light (light which has not been absorbed) reflected on the bar code.

According to the aspect, a bar code is formed by the liquid having the first color or the liquid having the second color that absorbs light having a predetermined wavelength to be applied to the bar code. Therefore, it is possible to form a bar code which can be read by the bar code reader on the medium.

In the printing apparatus, the two or more complementation modes may include the first complementation mode, the second complementation mode, and the third complementation mode, and the print control unit may perform complementation with respect to the one nozzle by prioritizing the first complementation mode or the third complementation mode more than the second complementation mode in a case where at least a part of an image to be formed on the medium in the printing process is a photo and the ejection state of the liquid ejected from the one nozzle is abnormal when at least a part of the photo is formed using the liquid ejected from the one nozzle.

A photo shows scenery or a facial expression of a person in many cases. In a case where a photo is printed, it becomes important to accurately reproduce the color of a photo in many cases. For this reason, in the case where a photo is printed, it is necessary to perform a printing process that prioritizes accuracy of the color in many cases.

In the printing apparatus according to the aspect, complementation is performed by prioritizing the first complementation mode or the third complementation mode more than the second complementation mode which is not suitable for the printing process that prioritizes the accuracy of the color of an image to be formed on the medium, in a case of printing a photo using the liquid ejected from one nozzle. For this reason, even in the case of performing complementation with respect to one nozzle, the printing apparatus according to the aspect can perform the printing process in which the accuracy of the color of an image showing a photo is secured.

In the printing apparatus, the two or more complementation modes may include the first complementation mode, the second complementation mode, and the third complementation mode, the print control unit may be capable of controlling execution of the printing process using a photo printing mode for forming a photo on the medium, and the print control unit may perform complementation with respect to the one nozzle by prioritizing the first complementation mode or the third complementation mode more than the second complementation mode in a case where execution of the printing process is controlled using the photo printing mode and the ejection state of the liquid ejected from the one nozzle is abnormal.

In the case of performing the printing process using the photo printing mode, it is necessary to perform the printing process that prioritizes the accuracy of color of an image to be formed.

In the printing apparatus according to the aspect, in the case of performing the printing process using the photo printing mode, complementation is performed by prioritizing the first complementation mode or the third complementation mode more than the second complementation mode which is not suitable for the printing process that prioritizes the accuracy of the color of an image to be formed on the medium. Accordingly, the printing apparatus according to the aspect can perform the printing process in which the accuracy of the color of an image showing a photo is secured even in the case of performing complementation with respect to one nozzle.

The printing apparatus according to the aspect may further include a determining unit that determines whether execution of complementation using each of the two or more complementation modes is possible, the print control unit may perform complementation with respect to the one nozzle using the third complementation mode when the determining unit determines that execution of complementation with respect to the one nozzle using the third complementation mode is possible and may perform complementation with respect to the one nozzle using the first complementation mode when the determining unit determines that execution of complementation with respect to the one nozzle using the third complementation mode is impossible and execution of complementation with respect to the one nozzle using the first complementation mode is possible in a case where the ejection state of the liquid ejected from the one nozzle is abnormal when at least a part of the photo is formed using the liquid ejected from the one nozzle.

In the printing apparatus, the two or more complementation modes may include the first complementation mode, the second complementation mode, and the third complementation mode, and the print control unit may perform complementation with respect to the one nozzle by prioritizing the second complementation mode or the third complementation mode more than the first complementation mode in a case where at least a part of an image to be formed on the medium in the printing process is a figure and the ejection state of the liquid ejected from the one nozzle is abnormal when at least a part of the figure is formed of the liquid ejected from the one nozzle.

The figure is an image that can be shown by basic geometric figures, for example, lines such as a straight line and a curve; polygons such as a rectangle and a triangle; closed surfaces such as a circle and an ellipse; and dots, or an image which can be shown by a combination of these basic geometric figures, that is, an image for showing the shape or the position of an object. In the case of printing a figure, it is necessary to perform the printing process that prioritizes the accuracy of the position or the shape of an image to be formed.

In the printing apparatus according to the aspect, complementation is performed by prioritizing the second complementation mode or the third complementation mode more than the first complementation mode which is not suitable for the printing process that prioritizes the accuracy of the position or the shape of an image to be formed on the medium in the case of printing a figure using the liquid ejected from one nozzle. Accordingly, the printing apparatus according to the aspect can perform the printing process in which the accuracy of the position or the shape of an image showing a figure is secured even in the case of performing complementation with respect to one nozzle.

In the printing apparatus, the two or more complementation modes may include the first complementation mode, the second complementation mode, and the third complementation mode, the print control unit may be capable of controlling execution of the printing process using a figure printing mode for forming an image having at least a figure on the medium, and the print control unit may perform complementation with respect to the one nozzle by prioritizing the second complementation mode or the third complementation mode more than the first complementation mode in a case where execution of the printing process is controlled using the figure printing mode and the ejection state of the liquid ejected from the one nozzle is abnormal.

In the case of performing the printing process using the figure printing mode, it is necessary to perform the printing process that prioritizes the accuracy of the position or the shape of an image to be formed.

In the printing apparatus according to the aspect, complementation is performed by prioritizing the second complementation mode or the third complementation mode more than the first complementation mode which is not suitable for the printing process that prioritizes the accuracy of the position or the shape of an image to be formed on the medium in the case of performing the printing process using the figure printing mode. Accordingly, the printing apparatus according to the aspect can perform the printing process in which the accuracy of the position or the shape of an image showing a figure is secured even in the case of performing complementation with respect to one nozzle.

The printing apparatus according to the aspect may further include a determining unit that determines whether execution of complementation using each of the two or more complementation modes is possible, the print control unit may perform complementation with respect to the one nozzle using the second complementation mode when the determining unit determines that execution of complementation with respect to the one nozzle using the second complementation mode is possible and may perform complementation with respect to the one nozzle using the third complementation mode when the determining unit determines that execution of complementation with respect to the one nozzle using the second complementation mode is impossible and execution of complementation with respect to the one nozzle using the third complementation mode is possible in a case where the ejection state of the liquid ejected from the one nozzle is abnormal when at least a part of the figure is formed using the liquid ejected from the one nozzle.

In the printing apparatus, the two or more complementation modes may include the first complementation mode, the second complementation mode, and the third complementation mode, the first area may include an overlapping area that overlaps the third area when seen from the first direction and a non-overlapping area that does not overlap the third area when seen from the first direction, and the print control unit may perform complementation with respect to the one nozzle using any complementation mode from among the two or more complementation modes when the ejection state of the liquid ejected from the one nozzle is abnormal in a case where the one nozzle is provided in the overlapping area and performs complementation with respect to the one nozzle using the first complementation mode or the second complementation mode when the ejection state of the liquid ejected from the one nozzle is abnormal in a case where the one nozzle is provided in the non-overlapping area.

According to the aspect, it is possible to perform complementation using the third complementation mode in a case where the position of one nozzle is approximately the same as the position of the third nozzle in the second direction. For this reason, in the case of performing complementation of one nozzle with the third nozzle, it is possible to perform the printing process in which the accuracy of the position or the shape of an image is secured.

According to another aspect of the embodiment, there is provided a method of controlling a printing apparatus that includes a first nozzle group including a first nozzle which ejects a liquid having a first color, a second nozzle group including a second nozzle which ejects a liquid having a second color, and a third nozzle group including a third nozzle which ejects a liquid having the first color, the method including: selecting, when an ejection state of the liquid ejected from the one nozzle which belongs to the first nozzle group, ejects the liquid having the first color, and is different from the first nozzle is abnormal, a complementation mode from at least two or more complementation modes from among a first complementation mode that performs complementation with respect to one nozzle by increasing the amount of a liquid to be ejected from the first nozzle instead of allowing the one nozzle to eject the liquid, a second complementation mode that performs complementation with respect to the one nozzle by increasing the amount of the liquid to be ejected from the second nozzle instead of allowing the one nozzle to eject the liquid, and a third complementation mode that performs complementation with respect to the one nozzle by increasing the amount of the liquid to be ejected from the third nozzle instead of allowing the one nozzle to eject the liquid; and performing complementation with respect to the one nozzle using the one selected complementation mode.

According to the aspect of the embodiment, it is possible to perform complementation using a plurality of complementation modes. Accordingly, it is possible to minimize the possibility that the complementation cannot be performed compared to the case where the printing apparatus can perform complementation using only a single complementation mode and to minimize the extent of a decrease in the image quality of an image to be formed on the medium.

According to still another aspect of the embodiment, there is provided a control program of a printing apparatus that includes a first nozzle group including a first nozzle which ejects a liquid having a first color, a second nozzle group including a second nozzle which ejects a liquid having a second color, a third nozzle group including a third nozzle which ejects a liquid having the first color, and a computer, the program causing the computer to function as: a print control unit that selects, when an ejection state of the liquid ejected from the one nozzle which belongs to the first nozzle group, ejects the liquid having the first color, and is different from the first nozzle is abnormal, a complementation mode from at least two or more complementation modes from among a first complementation mode that performs complementation with respect to one nozzle by increasing the amount of a liquid to be ejected from the first nozzle instead of allowing the one nozzle to eject the liquid, a second complementation mode that performs complementation with respect to the one nozzle by increasing the amount of the liquid to be ejected from the second nozzle instead of allowing the one nozzle to eject the liquid, and a third complementation mode that performs complementation with respect to the one nozzle by increasing the amount of the liquid to be ejected from the third nozzle instead of allowing the one nozzle to eject the liquid, and performs complementation with respect to the one nozzle using the selected complementation mode.

According to the aspect of the embodiment, it is possible to perform complementation using a plurality of complementation modes. Accordingly, it is possible to minimize the possibility that the complementation cannot be performed compared to the case where the printing apparatus can perform complementation using only a single complementation mode and to minimize the extent of a decrease in the image quality of an image to be formed on the medium.

What is claimed is:

1. A printing apparatus that performs a printing process of ejecting a liquid from a nozzle to a medium and forming an image on the medium, the printing apparatus comprising:

a head unit that includes a first nozzle group including first nozzles which eject a liquid having a first color, a second nozzle group including a second nozzle which ejects a liquid having a second color different from the first color, and a third nozzle group including a third nozzle which ejects a liquid having the first color, the first nozzle group being disposed in a first area that extends in a nozzle row direction in which the first nozzles are arranged in the head unit, the second nozzle group being disposed in a second area that extends in the nozzle row direction in the head unit, the third nozzle group being disposed in a third area that extends in the nozzle row direction in the head unit, the first area including an overlapping area that overlaps the third area in the nozzle row direction and a non-overlapping area that does not overlap the third area in the nozzle row direction, the first, second, and third areas being different from each other; and a print control unit that controls execution of the printing process, when execution of the printing process is controlled, and an ejection state of the liquid ejected from one nozzle, which belongs to the first nozzle group, ejects the liquid having the first color, and is different from one of the first nozzles, is abnormal, the print control unit being configured to perform complementation using at least two or more complementation modes from among a first complementation mode that performs complementation with respect to the one nozzle by increasing the amount of a liquid to be ejected from the one of the first nozzles instead of allowing the one nozzle to eject the liquid, a second complementation mode that performs complementation with respect to the one nozzle by increasing the amount of the liquid to be ejected from the second nozzle instead of allowing the one nozzle to eject the liquid, and a third complementation mode that performs complementation with respect to the one nozzle by increasing the amount of the liquid to be ejected from the third nozzle instead of allowing the one nozzle to eject the liquid from the one nozzle, in response to the ejection state of the liquid ejected from the one nozzle being abnormal, the print control unit being configured to select one mode from the complementation modes according to an attribute of the one nozzle being abnormal and being configured to determine whether or not an ejection state of the third nozzle is normal in response to determining that the one nozzle is positioned in the overlapping area, select the third complementation mode in response to determining that the ejection state of the third nozzle is normal, determine whether or not an ejection state of the second nozzle is normal in response to determining the ejection state of the third nozzle is not normal, and select the second complementation mode in response to determining that the ejection state of the second nozzle is normal.

2. The printing apparatus according to claim 1, further comprising a transport mechanism that transports the medium in a first direction, wherein the first nozzle group is provided in the first area that extends in a second direction intersecting with the first direction in the head unit, the second nozzle group is provided in the second area that extends in the second direction in the head unit, and the third nozzle group is provided in the third area that extends in the second direction in the head unit.

3. The printing apparatus according to claim 1, wherein the print control unit is capable of controlling execution of the printing process using various kinds of printing modes including a first printing mode that prioritizes accuracy of the position or the shape of an image to be formed on the medium more than the accuracy of the color of an image to be formed on the medium and a second printing mode that prioritizes the accuracy of the color of an image to be formed on the medium more than the accuracy of the position or the shape of an image to be formed on the medium, and complementation with respect to the nozzle is performed using the complementation mode according to the kind of printing mode among two or more complementation modes when the ejection state of the liquid from the one nozzle is abnormal.

4. The printing apparatus according to claim 3, wherein the two or more complementation modes include the first complementation mode, the second complementation mode, and the third complementation mode, the print control unit performs complementation with respect to the one nozzle by prioritizing the second complementation mode or the third complementation mode more than the first complementation mode when the ejection state of the liquid ejected from the one nozzle is abnormal in the case of controlling execution of the printing process using the first printing mode, and the print control unit performs complementation with respect to the one nozzle by prioritizing the first complementation mode or the third complementation mode more than the second complementation mode when the ejection state of the liquid ejected from the one nozzle is abnormal in the case of controlling execution of the printing process using the second printing mode.

5. The printing apparatus according to claim 1, wherein the two or more complementation modes include the first complementation mode, the second complementation mode, and the third complementation mode, and the print control unit performs complementation with respect to the one nozzle using the second complementation mode or the third complementation mode in a case where at least a part of an image to be formed on the medium in the printing process is a bar code and the ejection state of the liquid ejected from the one nozzle is abnormal when at least a part of the bar code is formed using the liquid ejected from the one nozzle.

6. The printing apparatus according to claim 1, wherein the two or more complementation modes include the first complementation mode, the second complementation mode, and the third complementation mode, the print control unit is capable of controlling execution of the printing process using a bar code printing mode for forming a bar code on the medium, and the print control unit performs complementation with respect to the one nozzle using the second complementation mode or the third complementation mode in a case where execution of the printing process is controlled using the bar code printing mode and the ejection state of the liquid ejected from the one nozzle is abnormal.

7. The printing apparatus according to claim 5, further comprising a determining unit that determines whether execution of complementation using each of the two or more complementation modes is possible, wherein the print control unit performs complementation with respect to the one nozzle using the second complementation mode when the determining unit determines that execution of complementation with respect to the one nozzle using the second complementation mode is possible and performs complementation with respect to the one nozzle using the third complementation mode when the determining unit determines that execution of complementation with respect to the one nozzle using the second complementation mode is impossible in a case where the ejection state of the liquid ejected from the one nozzle is abnormal when at least a part of the bar code is formed using the liquid ejected from the one nozzle.

8. The printing apparatus according to claim 1, wherein the print control unit performs complementation with respect to the one nozzle using any complementation mode among the two or more complementation modes in a case where the ejection state of the liquid ejected from the one nozzle is abnormal when a portion of a bar code other than an end portion is formed using the liquid ejected from the one nozzle and does not perform complementation with respect to the one nozzle in a case where the ejection state of the liquid ejected from the one nozzle is abnormal when the end portion of the bar code is formed using the liquid ejected from the one nozzle in a case where the bar code is formed on the medium in the printing process.

9. The printing apparatus according to claim 1, wherein the liquid having the first color and the liquid having the second color absorb light having a predetermined wavelength.

10. The printing apparatus according to claim 1, wherein the two or more complementation modes include the first complementation mode, the second complementation mode, and the third complementation mode, and the print control unit performs complementation with respect to the one nozzle by prioritizing the first complementation mode or the third complementation mode more than the second complementation mode in a case where at least a part of an image to be formed on the medium in the printing process is a photo and the ejection state of the liquid ejected from the one nozzle is abnormal when at least a part of the photo is formed using the liquid ejected from the one nozzle.

11. The printing apparatus according to claim 1, wherein the two or more complementation modes include the first complementation mode, the second complementation mode, and the third complementation mode, the print control unit is capable of controlling execution of the printing process using a photo printing mode for forming a photo on the medium, and the print control unit performs complementation with respect to the one nozzle by prioritizing the first complementation mode or the third complementation mode more than the second complementation mode in a case where execution of the printing process is controlled using the photo printing mode and the ejection state of the liquid ejected from the one nozzle is abnormal.

12. The printing apparatus according to claim 1, wherein the two or more complementation modes include the first complementation mode, the second complementation mode, and the third complementation mode, and the print control unit performs complementation with respect to the one nozzle by prioritizing the second complementation mode or the third complementation mode more than the first complementation mode in a case where at least a part of an image to be formed on the medium in the printing process is a figure and the ejection state of the liquid ejected from the one nozzle is abnormal when at least a part of the figure is formed by the liquid ejected from the one nozzle.

13. The printing apparatus according to claim 1, wherein the two or more complementation modes include the first complementation mode, the second complementation mode, and the third complementation mode, the print control unit is capable of controlling execution of the printing process using a figure printing mode for forming an image having at least a figure on the medium, and the print control unit performs complementation with respect to the one nozzle by prioritizing the second complementation mode or the third complementation mode more than the first complementation mode in a case where execution of the printing process is controlled using the figure printing mode and the ejection state of the liquid ejected from the one nozzle is abnormal.

14. The printing apparatus according to claim 2, wherein the two or more complementation modes include the first complementation mode, the second complementation mode, and the third complementation mode, the first area includes an overlapping area that overlaps the third area when seen from the first direction and a non-overlapping area that does not overlap the third area when seen from the first direction, and the print control unit performs complementation with respect to the one nozzle using any complementation mode from among the two or more complementation modes when the ejection state of the liquid ejected from the one nozzle is abnormal in a case where the one nozzle is provided in the overlapping area and performs complementation with respect to the one nozzle using the first complementation mode or the second complementation mode when the ejection state of the liquid ejected from the one nozzle is abnormal in a case where the one nozzle is provided in the non-overlapping area.

15. A method of controlling a printing apparatus, the method comprising:

selecting, when ejection state of a liquid ejected from one nozzle is abnormal, a complementation mode according to an attribute of the one nozzle being abnormal, the one nozzle belonging to a first nozzle group of a head unit of the printing apparatus, ejecting the liquid having a first color, and being different from one of first nozzles of the first nozzle group, the head unit including the first nozzle group including the first nozzles which eject a liquid having the first color, a second nozzle group including a second nozzle which ejects a liquid having a second color different from the first color, a third nozzle group including a third nozzle which ejects a liquid having the first color, the first nozzle group being disposed in a first area that extends in a nozzle row direction in which the first nozzles are arranged in the head unit, the second nozzle group being disposed in a second area that extends in the nozzle row direction in the head unit, the third nozzle group being disposed in a third area that extends in the nozzle row direction in the head unit, the first area including an overlapping area that overlaps the third area in the nozzle row direction and a non-overlapping area that does not overlap the third area in the nozzle row direction, the first, second, and third areas being different from each other, the selecting of the complementation mode including selecting the complementation mode from at least two or more complementation modes from among a first complementation mode that performs complementation with respect to the one nozzle by increasing the amount of a liquid to be ejected from the one of the first nozzles instead of allowing the one nozzle to eject the liquid, a second complementation mode that performs complementation with respect to the one nozzle by increasing the amount of the liquid to be ejected from the second nozzle instead of allowing the one nozzle to eject the liquid, and a third complementation mode that performs complementation with respect to the one nozzle by increasing the amount of the liquid to be ejected from the third nozzle instead of allowing the one nozzle to eject the liquid; and performing complementation with respect to the one nozzle using the one selected complementation mode, the selecting of the complementation mode further including determining whether or not an ejection state of the third nozzle is normal in response to determining that the one nozzle is positioned in the overlapping area, selecting the third complementation mode in response to determining that the ejection state of the third nozzle is normal, determining whether or not an ejection state of the second nozzle is normal in response to determining the election state of the third nozzle is not normal, and selecting the second complementation mode in response to determining that the ejection state of the second nozzle is normal.

16. A non-transitory computer-readable medium storing control program of a printing apparatus, the program causing a computer to function as:

a print control unit that selects, when ejection state of a liquid ejected from one nozzle is abnormal, a complementation mode according to an attribute of the one nozzle being abnormal, the one nozzle belonging to a first nozzle group of a head unit of the printing apparatus, ejecting the liquid having a first color, and being different from one of first nozzles of the first nozzle group, the head unit including the first nozzle group including the first nozzles which eject a liquid having the first color, a second nozzle group including a second nozzle which ejects a liquid having a second color different from the first color, a third nozzle group including a third nozzle which ejects a liquid having the first color, the first nozzle group being disposed in a first area that extends in a nozzle row direction in which the first nozzles are arranged in the head unit, the second nozzle group being disposed in a second area that extends in the nozzle row direction in the head unit, the third nozzle group being disposed in a third area that extends in the nozzle row direction in the head unit, the first area including an overlapping area that overlaps the third area in the nozzle row direction and a non-overlapping area that does not overlap the third area in the nozzle row direction, the first second, and third areas being different from each other, the print control unit selecting the complementation mode from at least two or more complementation modes from among a first complementation mode that performs complementation with respect to the one nozzle by increasing the amount of a liquid to be ejected from the one of the first nozzles instead of allowing the one nozzle to eject the liquid, a second complementation mode that performs complementation with respect to the one nozzle by increasing the amount of the liquid to be ejected from the second nozzle instead of allowing the one nozzle to eject the liquid, and a third complementation mode that performs complementation with respect to the one nozzle by increasing the amount of the liquid to be ejected from the third nozzle instead of allowing the one nozzle to eject the liquid, and performs complementation with respect to the one nozzle using the selected complementation mode, and to select the complementation mode, the print control unit being configured to determine whether or not an ejection state of the third nozzle is normal in response to determining that the one nozzle is positioned in the overlapping area, select the third complementation mode in response to determining that the ejection state of the third nozzle is normal, determine whether or not an ejection state of the second nozzle is normal in response to determining the election state of the third nozzle is not normal, and select the second complementation mode in response to determining that the ejection state of the second nozzle is normal.

17. The printing apparatus according to claim 1, wherein the print control unit is configured to select one mode from the complementation modes according to the attribute of the one nozzle being abnormal and an attribute of a complementation nozzle.

18. The printing apparatus according to claim 1, wherein the attribute of the one nozzle being abnormal is a position of the nozzle.

19. The printing apparatus according to claim 1, wherein the attribute of the one nozzle being abnormal is a color of ink ejected from the nozzle.

20. The printing apparatus according to claim 1, wherein the print control unit is configured to select a maintenance mode that performs maintenance process with respect to the one nozzle instead of allowing the one nozzle to eject the liquid from the one nozzle when the print control unit does not select one mode from the complementation modes according, to the attribute of the one nozzle being abnormal.

* * * * *